US007229752B2

(12) United States Patent
Kuwano et al.

(10) Patent No.: US 7,229,752 B2
(45) Date of Patent: Jun. 12, 2007

(54) SILVER SALT PHOTOTHERMOGRAPHIC DRY IMAGING MATERIAL

(75) Inventors: Koji Kuwano, Hachioji (JP); Takayuki Sasaki, Hachioji (JP)

(73) Assignee: Konica Minolta Medical & Graphic, Inc., Tokyo (JP)

( * ) Notice: Subject to any disclaimer, the term of this patent is extended or adjusted under 35 U.S.C. 154(b) by 94 days.

(21) Appl. No.: 11/194,547

(22) Filed: Aug. 2, 2005

(65) Prior Publication Data

US 2006/0029892 A1 Feb. 9, 2006

(30) Foreign Application Priority Data

Aug. 5, 2004 (JP) ..... 2004-229152
Sep. 16, 2004 (JP) ..... 2004-269647

(51) Int. Cl.
*G03C 1/00* (2006.01)
*G03C 1/76* (2006.01)
*G03C 1/85* (2006.01)

(52) U.S. Cl. ..... 430/617; 430/618; 430/619; 430/620; 430/523; 430/527; 430/531; 430/533

(58) Field of Classification Search ..... 430/617–620, 430/523, 527, 531, 533
See application file for complete search history.

(56) References Cited

U.S. PATENT DOCUMENTS 6,641,989 B2 * 11/2003 Sasaki et al. ..... 430/523
2005/0084809 A1 * 4/2005 Kong et al. ..... 430/502

FOREIGN PATENT DOCUMENTS

JP 05197073 A * 8/1993

* cited by examiner

*Primary Examiner*—Geraldina Visconti
(74) *Attorney, Agent, or Firm*—Finnegan, Henderson, Farabow, Garrett & Dunner, L.L.P.

(57) ABSTRACT

A photothermographic imaging material containing a support having thereon: (i) a photosensitive layer containing photosensitive silver halide grains, light-insensitive organic silver salt grains, a binder, and a reducing agent for silver ions; and (ii) one or more non-photosensitive layers, wherein a powder compound which is preliminarily dried at a lower temperature than a temperature used for thermal development is incorporated in the photosensitive layer or in the non-photosensitive layer.

6 Claims, No Drawings

SILVER SALT PHOTOTHERMOGRAPHIC DRY IMAGING MATERIAL

This application is based on Japanese Patent Application Nos. 2004-229152 and 2004-269647, each being filed respectively on Aug. 5, 2004 and Sep. 16, 2004 in Japanese Patent Office, the entire contents of which are hereby incorporated by reference.

TECHNICAL FIELD

The present invention relates to silver salt photothermographic dry imaging materials (hereinafter referred also to as heat developable photosensitive materials and photothermographic imaging materials), as well as the development method thereof.

BACKGROUND

Heretofore, in the medical, and printing and plate making fields, effluent generated by processing image forming materials employing the wet processing system has caused operational problems. In recent years, in view of environmental protection as well as space saving, it is increasingly demanded to decrease the amount of processing effluent. Accordingly, heat developable photosensitive materials capable of forming images by applying only heat have been realized and are increasingly spreading into the above fields.

Heat developable photosensitive materials have been proposed for a long time. The above heat developable materials are commonly processed employing a thermal processor which applies uniform heat onto the heat developable materials to form images. As noted above, along with the above recent rapid spreading, a number of differing thermal processors have been supplied to the market. On the other hand, problems have occurred in which depending on storage conditions as well as ambient conditions during thermal processing, the resulting density on the heat developable materials suffers from variation. It has been found that such phenomena occur markedly in heat developable photosensitive materials which are imagewise exposed to laser beams and then thermally developed to form images. Further, in recent years, it has been sought to downsize laser imagers, as well as to raise processing rate.

To meet the above demands, it is essential to enhance specific characteristics of heat developable photosensitive materials. In order to achieve sufficient density of heat developable photosensitive materials even during quick processing, effective methods include an increase in covering power by increasing the number of color forming points with use of silver halide of a smaller average grain size (refer, for example, to Patent Documents 1 and 2), the use of highly active reducing agents having a secondary or tertiary alkyl group (refer, for example, to Patent Document 3), and the use of development accelerators such as hydrazine compounds, vinyl compounds, phenol derivatives, or naphthol derivatives (refer, for example, to Patent Document 3). Further, in order to meet requirements for quick processing, a technique is disclosed in which exposure and heat development are simultaneously performed. However, problems occur in which the low molecular weight components in heat developable photosensitive materials generated from a film via heat development affect even exposed portions due to the short distance between the exposure and the development sections, whereby the exposure device is stained, and trials to overcome the above drawbacks have been conducted (refer, for example, to Patent Documents 6 and 7). Heretofore, in the medical, and printing and plate making fields, effluent generated by processing image forming materials employing the wet system has caused operational problems. In recent years, in view of environmental protection as well as space saving, it is increasingly demanded to decrease the amount of processing effluent. Accordingly, heat developable photosensitive materials capable of forming images by applying only heat have been realized and are increasingly spreading into the above fields.

Heat developable photosensitive materials have been proposed for a long time. The above heat developable materials are commonly processed employing a thermal processor which applies uniform heat to the heat developable materials to form images. As noted above, along with the above recent rapid spreading, a number of differing thermal processors have been supplied to the market. However, compared to the conventional wet process photosensitive materials, since images are formed via heat development, volatilities are occasionally formed in the resulting images or in the interior of thermal processors, and the resulting volatilities occasionally cause operators' discomfort. Proposed as methods to overcome such drawbacks are a decrease in unpleasant odor causing discomfort by the addition of perfumes (Patent Document 1), the addition of a certain type of compounds to the protective layer (Patent Documents 2 and 3), the use of compounds which do not readily volatile (Patent Documents 4, 5, 6, and 7), and the use of development devices which are inventively structured so that unpleasant odor are not readily formed (Patent Documents 8 and 9). However, these attempts have not sufficiently overcome the above drawbacks.

Further, in heat developable photosensitive materials employing photosensitive silver halide, since silver halide remains in the emulsion layer, problems occur in which the light-fastness of images is degraded. Heretofore, the light-fastness has been improved (Patent Documents 10 and 11). However, in cases in which the resulting techniques are employed, the light-fastness of images is improved to some extent, but it has been difficult to maintain sufficiently high image density, especially when quick processing is performed.

On the other hand, technical trials have been conducted in which an image forming layer is composed of a multilayer and by controlling the amount of silver saving agents, the coated silver amount, the Tg of binders, and the influential region to separate the function of each of the layers, whereby image quality is enhanced (Patent Documents 12–14).

However, in cases in which these techniques are employed, especially when rapid processing is performed, it has been difficult to simultaneously improve the light-fastness of images, as well as the storage stability, while still achieving sufficient image density.

(Patent Document 1) Japanese Patent Publication for Public Inspection (hereinafter referred to as JP-A) No. 51-10925

(Patent Document 2) U.S. Pat. No. 4,742,992

(Patent Document 3) JP-A No. 2001-356447

(Patent Document 4) JP-A No. 2000-112070

(Patent Document 5) JP-A No. 2000-250167

(Patent Document 6) JP-A No. 2000-250168

(Patent Document 7) JP-A No. 2000-267221

(Patent Document 8) JP-A No. 11-338114

(Patent Document 9) JP-A No. 2000-284461

(Patent Document 10) JP-A No. 2003-270755 (claims)

(Patent Document 11) JP-A No. 2004-004522 (claims)

(Patent Document 12) JP-A No. 2002-006443 (claims)

(Patent Document 13) JP-A No. 2002-365756 (claims)
(Patent Document 14) JP-A No. 2002-365765 (claims)

SUMMARY

In view of the foregoing, the present invention was achieved. An object of the present invention is to provide silver salt photothermographic dry imaging material which minimizes unpleasant odor and results in excellent light-fastness, and a development method thereof.

It is possible to achieve the above object of the present invention employing the embodiments below.

(1) An aspect of the present invention includes a photothermographic imaging material comprising a support having thereon:

(i) a photosensitive layer containing photosensitive silver halide grains, light-insensitive organic silver salt grains, a binder, and a reducing agent for silver ions; and (ii) one or more non-photosensitive layers, wherein a powder compound which is preliminarily dried at a lower temperature than a temperature used for thermal development is incorporated in the photosensitive layer or in the non-photosensitive layer.

(2) Another aspect of the present invention includes a photothermographic imaging material comprising a support having thereon:

(i) a photosensitive layer containing photosensitive silver halide grains, light-insensitive organic silver salt grains, a binder, and a reducing agent for silver ions; and (ii) one or more non-photosensitive layers, wherein one of the non-photosensitive layers is a protective layer containing:

(a) a cross-linking agent;

(b) a polymer having a vinyl alcohol repeating unit and having a saponification degree of not more than 75%; and (c) an acid group trapping agent capable of trapping a volatile compound during thermal development.

(3) Another aspect of the present invention includes a photothermographic imaging material comprising a support having thereon:

(i) a photosensitive layer containing photosensitive silver halide grains, light-insensitive organic silver salt grains, a binder, and a reducing agent for silver ions; and (ii) one or more non-photosensitive layers, wherein one of the non-photosensitive layers is a protective layer containing:

(a) a cross-linking agent;

(b) a cellulose acetate having an acetylation degree of 50 to 58%; and (c) an acid group trapping agent capable of trapping a volatile compound during thermal development.

(4) Another aspect of the present invention includes a photothermographic imaging material, wherein the non-photosensitive layer contains tablet shaped grains.

(5) Another aspect of the present invention includes a photothermographic imaging material, wherein the silver halide grains produce a larger number of inner latent images than surface latent images after the imaging material is subjected to thermal development.

(6) Another aspect of the present invention includes a method of forming an image comprising the steps of:

(a) setting the photothermographic imaging material in a thermal developing apparatus having a exposure portion and a thermal development portion;

(b) exposing the photothermographic imaging material with the exposure portion to obtain an latent image, and (c) thermally developing the latent image with the thermal developing portion, wherein a distance from the exposure portion and the thermal developing portion is between 0 and 20 cm.

(7) Another aspect of the present invention includes a photothermographic imaging material, wherein the cross-linking agent is a blocked isocyanate compound.

(8) Another aspect of the present invention includes a photothermographic imaging material, wherein the cross-linking agent is a carbodiimide compound.

The silver salt photothermographic dry imaging materials (hereinafter sometimes referred to as heat developable photosensitive materials, or photosensitive materials) and a development method thereof according to the present invention minimize generation of unpleasant odor and result in excellent image retention properties against light irradiation.

The present invention will now be detailed.

<Protective Layer>

It is preferable that a protective layer exhibits functions in such a way that contaminants formed during thermal development are neither volatized nor adhere to the exterior of heat developable photosensitive materials.

In the present invention, in view of further exhibiting desired effects of the present invention, it is preferable that the binders of the above protective layer are composed of cellulose acetate of the degree of acetylation between 50 and 58 percent and vinyl alcohol of the degree of saponification of 75 percent or less. The lower limit of the degree of saponification is preferably 40 percent, but is more preferably 60 percent.

Further, it is possible to use a protective layer blended with the polymers below. The blending ratio is preferably 0–90 percent by volume, but is more preferably 0–40 percent.

Employed as polymers other than those described above may be any of the polymers described, for example, in U.S. Pat. Nos. 6,352,819, 6,352,820, and 6,350,561.

It is preferable to incorporate at least one polymer selected from the group consisting, for example, of cellulose derivatives, polyvinyl alcohols, polystyrene and copolymers thereof, vinyl chloride/vinyl acetate copolymers, water-insoluble polyester, gelatin and derivatives thereof, and polyvinylpyrrolidone. Of these, particularly preferred are cellulose derivatives and polymers having vinyl alcohol units.

Particularly preferred polymers having polyvinyl alcohol units include vinyl acetate polymers and polyvinyl alcohols. Preferred as polyvinyl alcohols are low crystalline polyvinyl alcohols of a degree of saponification of at most 75 percent.

Any of the cellulose acetates are acceptable as long as they exhibit a degree of acetylation between 50 and 58 percent. In the present invention, cellulose acetate is preferably employed while blended with cellulose derivatives. The blending ratio is commonly 0–90 percent by volume with respect to cellulose acetate, but is more preferably 0–40 percent by weight.

The degree of acetylation is an index which shows a degree of substitution, also shows the ratio of acetic acid liberated during saponification of cellulose acetate, and is represented by the formula below.

$$\text{Degree of substitution} = \text{degree of acetylation} \times 162 / (6005 - \text{degree of acetylation} \times 42)$$

Examples of cellulose derivatives include cellulose acetate, cellulose acetate butyrate, hydroxypropyl cellulose, hydroxypropylmethyl cellulose, methyl cellulose, hydroxmethyl cellulose, and carboxymethyl cellulose, as well as mixtures thereof.

The thickness of the protective layer is preferably 0.2–10 μm to realize its functions, is more preferably 1–5 μm, but is most preferably 1.5–3.0 μm. The protective layer may be, a single layer or a multilayer.

Incorporated into the protective layer may be additives such as surface active agents, lubricants, matting agents, cross-linking agents, toners for heat development, and anti-irradiation dyes.

<Cross-linking Agents of the Protective Layer>

Employed as cross-linking agents usable in the present invention are various ones conventionally used as compounds for silver halide photosensitive materials, such as aldehyde based, epoxy based, ethyleneimine based, vinylsulfone based, sulfonic acid ester based, acryloyl based, carbodiimide based, and silane compound based cross-linking agents described, for example, in JP-A No. 50-96216. Of these, preferred are the isocyanate based compounds, silane compounds, epoxy compounds or acid anhydrides described below.

Isocyanate based and thioisocyanate based cross-linking agents, represented by General Formula (IC) below, which are suitably usable will now be described.

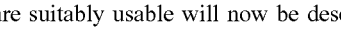

$$X_1{=}C{=}N\text{-}L_1\text{-}(N{=}C{=}X_1)_v \qquad \text{General Formula (IC)}$$

wherein v represents 1 or 2, $L_1$ represents an alkyl group of a valance of (v+1), an alkenyl group, an aryl group, a heterocyclic group, or a combined group thereof, and $X_1$ is an oxygen or sulfur atom.

Incidentally, in the compounds represented by above General Formula (IC), the aryl group and the aryl ring may have a substituent. Examples of preferred substituents are those selected from the group consisting of a halogen atom (for example, a bromine atom or a chlorine atom), a hydroxyl group, an amino group, a carboxyl group, an alkyl group, or an alkoxy group.

The above isocyanate cross-linking agents include isocyanates having at least two isocyanate groups and adducts thereof. More specifically described are aliphatic diisocyanates, aliphatic diisocyanates having a ring group, benzene isocyanates, naphthalene diisocyanates, biphenyl isocyanates, diphenylmethane diisocyanate, triphenylmethane diisocyanates, triisocyanates, and tetraisocyanates, as well as addition products thereof and addition products of these isocyanates with dihydric or trihydric polyalcohols.

Employed as specific compounds may be isocyanate compounds described on pages 10–12 of JP-A No. 56-5535.

Incidentally, the above isocyanate cross-linking agents more preferably are addition compounds (block isocyanates) which are subjected to addition of blocking agents.

Employed as the above blocking agents may be phenol based, alcohol based, active methylene based, mercaptan based, acid amide based, imide based, amine based, imidazole based, urea based, carbamic acid based, imine based, oxime based, and sulfite salt based blocking agents.

Examples of the above block isocyanate cross-linking agents include DESMODULE AP STABLE, DESMODULE CT STABLE, and DESUMOCUP 11 (available from Sumitomo Bayer Co.), BARNOCK D-500 (available from Dainippon Ink & Chemical Industries, Ltd.), DURANATE MF-B60X and DURANATE MF-60X (available from Asahi Chemical Industry Co., Ltd.), and JA925 (available from Jujo Chemical Co., Ltd.).

Further, as thioisocyanate cross-linking agents usable in the present invention, compounds having a thioisocyanate structure corresponding to the above isocyanates are also beneficial.

The amount of the above cross-linking agents employed in the present invention is preferably in the range of $1\times10^{-6}$–$1\times10^{-2}$ mol/m$^2$, but is more preferably in the range of $1\times10^{-5}$–$1\times10^{-3}$ mol/m$^2$.

Isocyanate compounds and thioisocyanate compounds capable of being incorporated in the present invention are preferably compounds which function as the above cross-linking agents. However, desired results are obtained even by employing compounds in which "v" in the above General Formula is zero (0), namely those which have one functional group.

Listed as silane compounds usable as a cross-linking agent in the present invention are the compounds represented by General Formula (1) or (2) described in JP-A No. 2002-22203.

In these General Formulas, at least one of the substituents is a non-diffusive group or an adsorptive group. Incidentally, the non-diffusive group is also called a ballast group and is preferably an aryl group into which an aliphatic group having at least 6 carbon atoms, or an alkyl group having at least 3 carbon atoms, are introduced. The resulting nondiffusion properties vary depending on binders and the amount of cross-linking agents. By introducing a non-diffusive group, it is possible to retard reaction during storage due to the limiting mobile distance in the molecule at room temperature.

Compounds, which can be used as a cross-linking agent, may be those having at least one epoxy group. The number of epoxy groups and corresponding molecular weight are not limited. It is preferable that the epoxy group be incorporated in the molecule as a glycidyl group via an ether bond or an imino bond. Further, the epoxy compound may be a monomer, an oligomer, or a polymer. The number of epoxy groups in the molecule is commonly from about 1 to about 10, and is preferably from 2 to 4. When the epoxy compound is a polymer, it may be either a homopolymer or a copolymer, and its number average molecular weight Mn is most preferably in the range of about 2,000 to about 20,000.

Preferred as epoxy compounds are those represented by General Formula (EP) described below.

General Formula (EP)

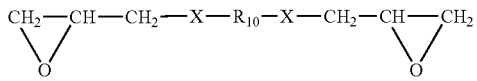

In General Formula (EP), the substituent of the alkylene group represented by $R_{10}$ is preferably a group selected from a halogen atom, a hydroxyl group, a hydroxyalkyl group, or an amino group. Further, the linking group represented by $R_{10}$ preferably has an amido linking portion, an ether linking portion, or a thioether linking portion. The divalent linking group, represented by X, is preferably —$SO_2$—, —$SO_2NH$—, —S—, —O—, or —$NR_{11}$—, wherein $R_{11}$ represents a univalent group, which is preferably an electron attractive group.

These epoxy compounds may be employed individually or in combinations of at least two types. The added amount is not particularly limited but is preferably in the range of $1\times10^{-6}$ to $1\times10^{-2}$ mol/m$^2$, and is more preferably in the range of $1\times10^{-5}$ to $1\times10^{-3}$ mol/m$^2$.

The epoxy compounds may be incorporated in optional layers on the photosensitive layer side of a support, such as a photosensitive layer, a surface protective layer, an interlayer, an anti-halation layer, and a subbing layer, and may be incorporated in at least two layers. In addition, the epoxy compounds may be incorporated in optional layers on the side opposite the photosensitive layer on the support. Incidentally, when a photosensitive material has a photosensitive layer on both sides, the epoxy compounds may be incorporated in any layer.

Acid anhydrides are compounds which have at least one acid anhydride group having the structural formula described below.

—CO—O—CO—

The acid anhydrites are to have at least one such acid anhydride group. The number of acid anhydride groups, and the molecular weight are not limited, but the compounds represented by General Formula (SA) are preferred.

General Formula (SA)

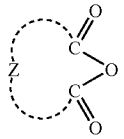

In General Formula (SA), Z represents a group of atoms necessary for forming a single ring or a polycyclic system. These cyclic systems may be unsubstituted or substituted. Example of substituents include an alkyl group (for example, a methyl group, an ethyl group, or a hexyl group), an alkoxy group (for example, a methoxy group, an ethoxy group, or an octyloxy group), an aryl group (for example, a phenyl group, a naphthyl group, or a tolyl group), a hydroxyl group, an aryloxy group (for example, a phenoxy group), an alkylthio group (for example, a methylthio group or a butylthio group), an arylthio group (for example, a phenylthio group), an acyl group (for example, an acetyl group, a propionyl group, or a butyryl group), a sulfonyl group (for example, a methylsulfonyl group, or a phenylsulfonyl group), an acylamino group, a sulfonylamino group, an acyloxy group (for example, an acetoxy group or a benzoxy group), a carboxyl group, a cyano group, a sulfo group, and an amino group. Substituents are preferably those which do not contain a halogen atom.

These acid anhydrides may be employed individually or in combinations of at least two types. The added amount is not particularly limited, but is preferably in the range of $1\times10^{-6}$ to $1\times10^{-2}$ mol/m$^2$ and is more preferably in the range of $1\times10^{-6}$ to $1\times10^{-3}$ mol/m$^2$.

In the present invention, the acid anhydrides may be incorporated in optional layers on the photosensitive layer side on a support, such as a photosensitive layer, a surface protective layer, an interlayer, an anti-halation layer, or a subbing layer, and may be incorporated in at least two layers. Further, the acid anhydrides may be incorporated in the layer(s) in which the epoxy compounds are incorporated.

<Acid Group Capturing Agent of the Protective Layer>

In the present invention, by employing acid capturing agents, it is possible to reduce the amount of substances which volatilize from image carrying films during development.

Listed as acid group capturing agents employed in the present invention may be the isocyanate based compounds represented by General Formula (X-1) below, the epoxy based compounds represented by General Formula (X-2) below, the phenol based compounds represented by General Formula (X-3) below, and the phenol based compounds represented by General Formula (X-4) below, as well as the carbodiimide based compounds represented by General Formula (CI), described later.

General Formula (X-1)

General Formula (X-2)

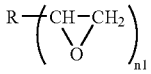

General Formula (X-3)

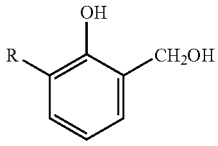

General Formula (X-4)

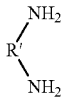

wherein R represents a substituent, R' represents a divalent linking group, and n1 represents an integer of 1–4.

Carbodiimide based compounds are those having at least two carbodiimide groups and addition compounds (adducts) thereof, and specific examples include aliphatic carbodiimides, aliphatic carbodiimides having a ring group, benzene dicarbodiimides, naphthalene dicarbodiimides, biphenylcarbodiimides, diphenylmethane carbodiimides, triphenylmethanedicarbodiimides, tricarbidiimides, tetracarbodiimides, as well as addition compounds thereof, and addition compounds of these carbodiimides with dihydric or trihydric polyalcohols. It is possible to prepare these carbodiimides by allowing each of the corresponding isocyanates to react with primary amines in the presence of phosphorus catalysts, such as phosphorane compounds.

Multifunctional carbodiimide compounds, as described in the present invention, are compounds having at least two carbodiimide groups or carbodithioimide groups in the molecular structure, but are more preferably polyfunctional aromatic carbodiimide compounds and compounds having a carbodiimide group as well as an aromatic group in the molecular structure.

Employed as multifunctional carbodiimide compounds may be any of those having a bifunctional or higher value functional carbodiimide group, and compounds having the structure represented by General Formula (CI) below are particularly preferred.

$$R_1\text{-}J_1\text{-}N{=}C{=}N\text{-}J_2{=}(L)_n\text{-}(J_3\text{-}N{=}C{=}N\text{-}J_4\text{-}R_2)_v \quad \text{General Formula (CI)}$$

wherein $R_1$ and $R_2$ each represent an aryl group or an alkyl group, $J_1$ and $J_4$ each represent a divalent linking group, $J_2$ and $J_3$ each represent an arylene group or an alkylene group, L represent a (v1+1) valent alkyl group, an alkenyl group, an aryl group, and a heterocyclic group, as well as a group in which the above groups are combined via a linking group, while v1 represents an integer of 1 or more, and n represent 0 or 1.

In the alkyl groups and aryl groups represented by $R_1$ and $R_2$ of General Formula (CI), examples of the alkyl groups include a methyl group, an ethyl group, a propyl group, a butyl group, and a pentyl group, and examples of the aryl groups include residual groups of benzene, naphthalene, toluene, and xylene, while examples of the heterocyclic groups include the residual groups of furan, thiophene, dioxane, pyridine, piperazine, and morpholine, and examples may also include groups in which the above groups are combined via a linking group.

The linking groups represented by $J_1$ and $J_4$ may be a single linking group or a linking group composed of oxygen atom(s), nitrogen atom(s), sulfur atom(s), phosphorous atom(s) which may incorporate carbon atom(s), such as O, S, NH, CO, COO, SO, $SO_2$, NHCO, NHCONH, PO, or PS. In the alkylene groups or arylene groups represented by $J_2$ and $J_3$, examples of the alkylene groups include a methylene group, an ethylene group, a trimethylene group, a tetramethylene group, or a hexamethylene group, while examples of the arylene group include a phenylene group, a tolylene group, or a naphthalene group.

Examples of the (v1+1) valent alkyl group, represented by L include a methyl group, an ethyl group, a propyl group, a butyl group, and a pentyl group, while examples of the alkenyl groups include an ethenyl group, a propenyl group, a butadiene group, or a pentadiene group. Examples of the aryl group include the residual group of benzene, naphthalene, toluene, or xylene, while the heterocyclic groups include the residual groups of furan, thiophene, dioxane, pyridine, piperazine, or morpholine. Groups are allowed in which the above groups are combined via a linking group. The linking groups represented by $J_1$ and $J_4$ may be a single linking group or a linking group composed of oxygen atom(s), nitrogen atom(s), sulfur atom(s), phosphorous atom(s) which may incorporate carbon atom(s), such as O, S, NH, CO, COO, SO, $SO_2$, NHCO, NHCONH, PO, or PS. The integer represented by v is preferably an integer of 1–6, but is more preferably 1–3.

Specific examples of acid group capturing agents usable in the present invention will now be described.

X-2-1

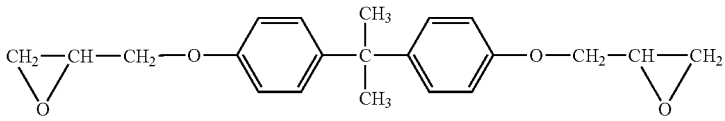

X-2-2

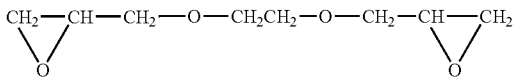

X-2-3

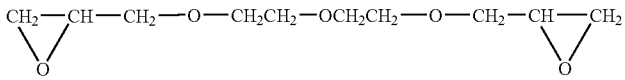

X-2-4

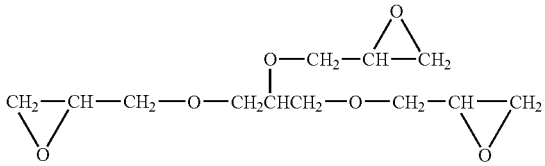

X-4-1

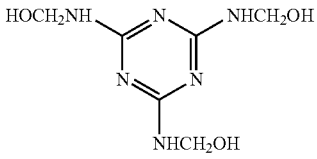

X-4-2

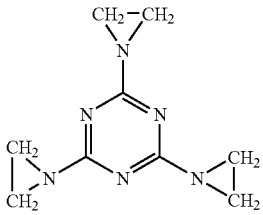

X-4-3

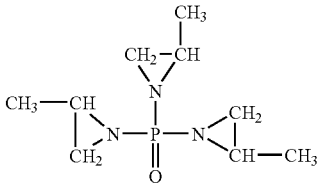

X-4-4

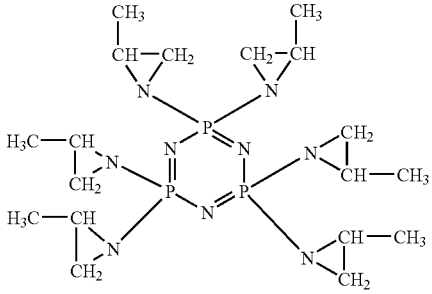

X-4-5

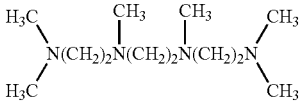

-continued
Cl-1
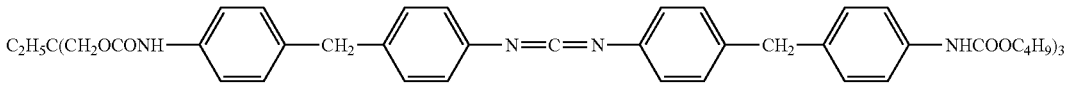
Cl-2
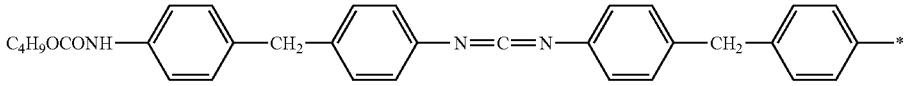
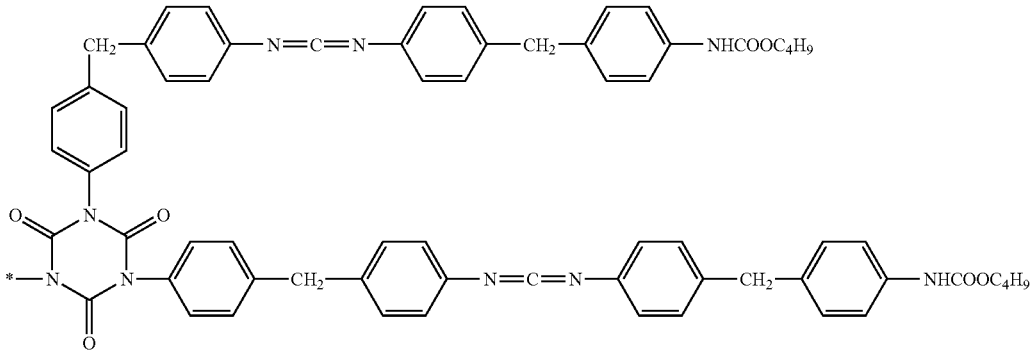
Cl-3
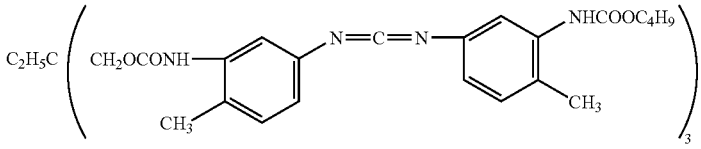
Cl-4
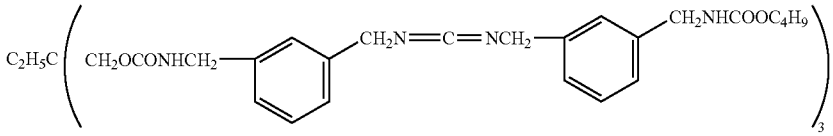
Cl-5
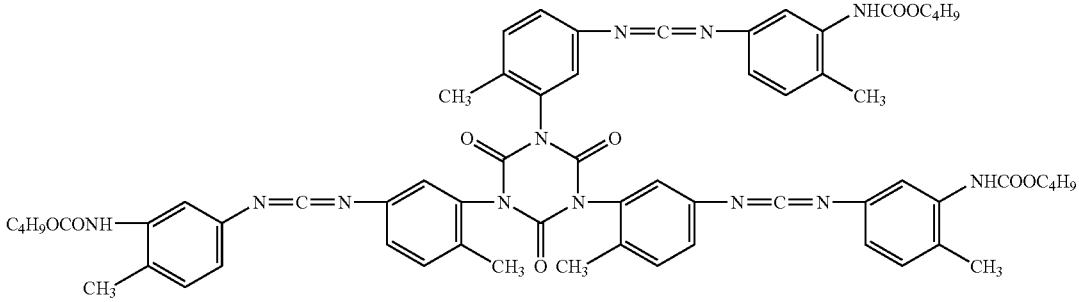
Cl-6
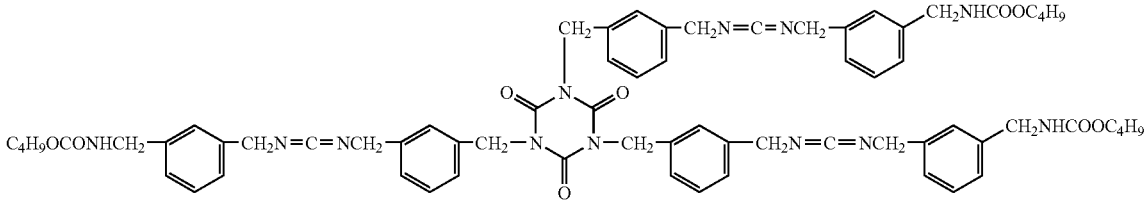
Cl-7
$C_2H_5C(CH_2OCONH(CH_2)_6N{=}C{=}N(CH_2)_6NHCOOC_4H_9)_3$
Cl-8
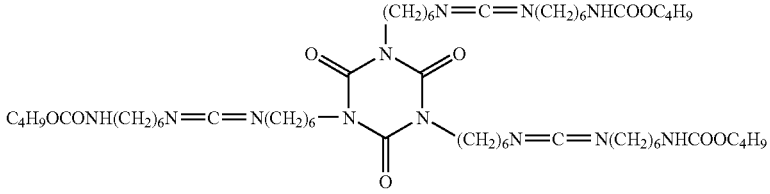

-continued
Cl-9
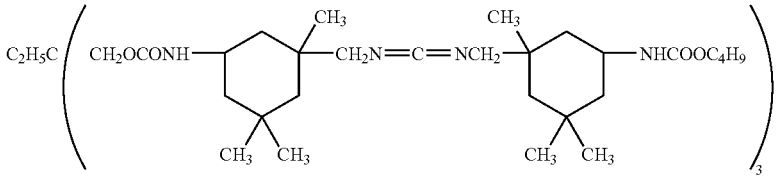
Cl-10
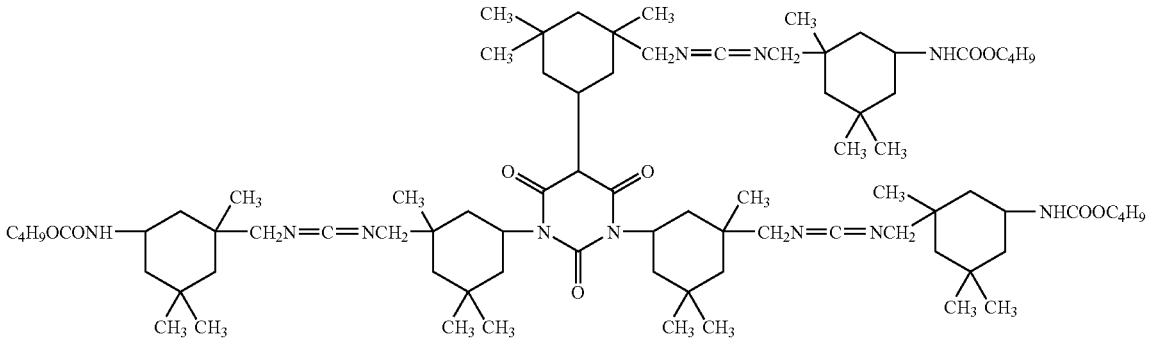
Cl-11
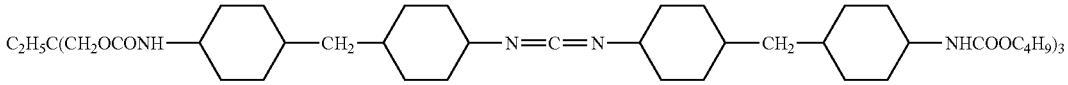
Cl-12
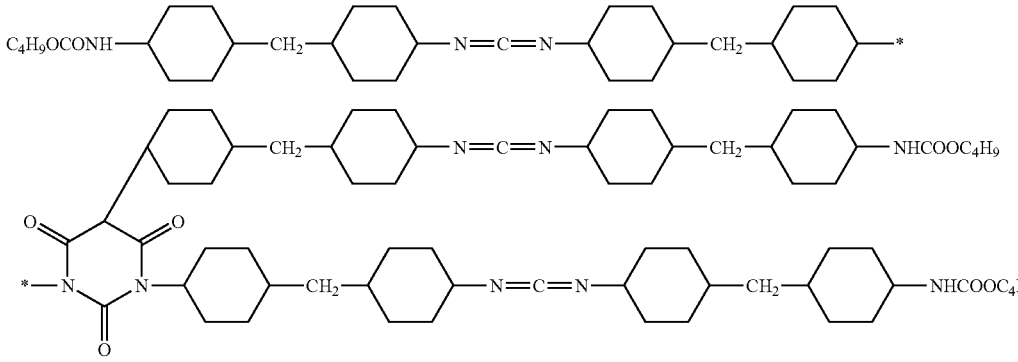
Cl-13
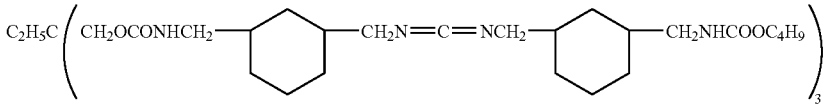
Cl-14
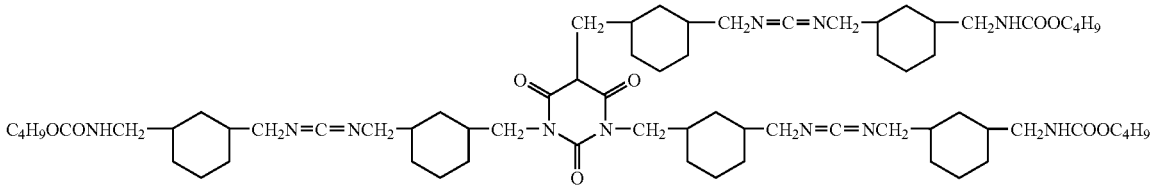
Cl-15
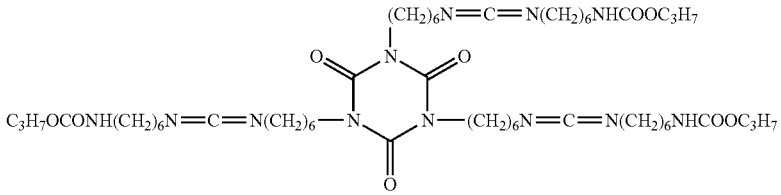

-continued

CI-16

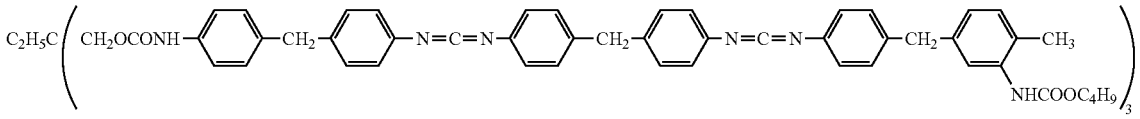

CI-17

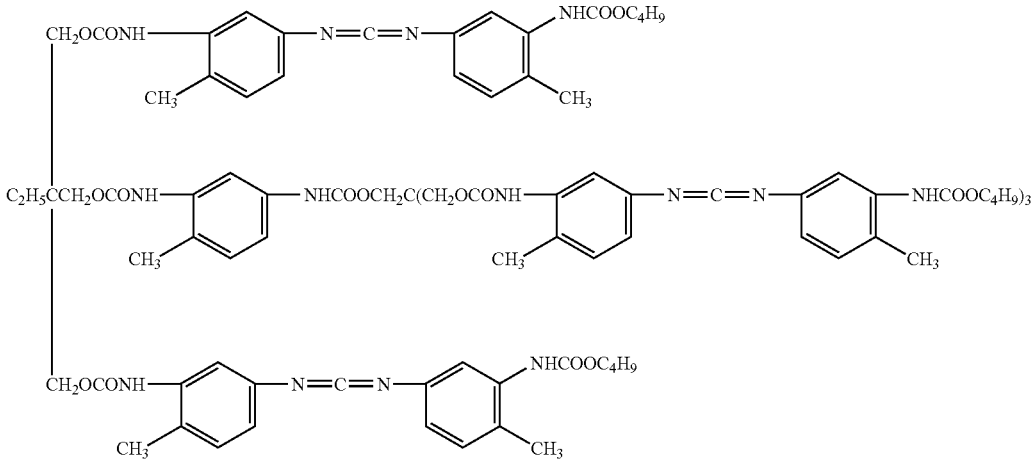

CI-18

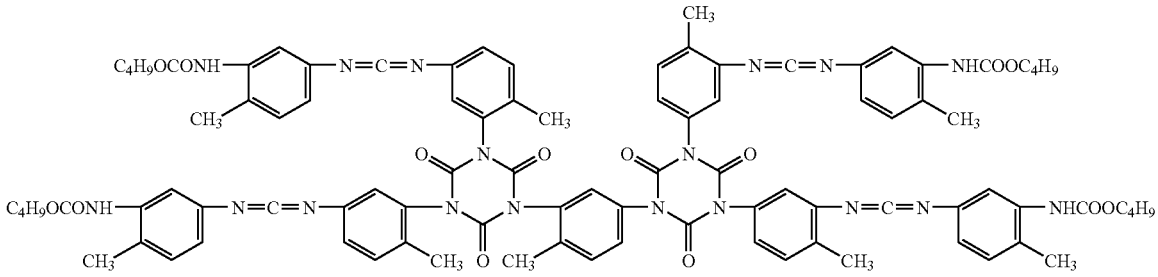

Among the above-exemplified compounds, preferred compounds are carbodiimides (CI-1) to (CI-18).

<Binder of the Photosensitive Layer>

Suitable binders for the silver salt photothermographic material of the present invention are to be transparent or translucent and commonly colorless, and include natural polymers, synthetic resin polymers and copolymers, as well as media to form film. The binders include, for example, gelatin, gum Arabic, casein, starch, poly(acrylic acid), poly (methacrylic acid), poly(vinyl chloride), poly(methacrylic acid), copoly(styrene-maleic anhydride), coply(styrene-acrylonitrile), coply(styrene-butadiene), poly(vinyl acetals) (for example, poly(vinyl formal) and poly(vinyl butyral), poly(esters), poly(urethanes), phenoxy resins, poly(vinylidene chloride), poly(epoxides), poly(carbonates), poly (vinyl acetate), cellulose esters, poly(amides).

Preferable binders for the photosensitive layer of the silver salt photothermographic dry imaging material of the present invention are poly(vinyl acetals), and a particularly preferable binder is poly(vinyl butyral), which will be detailed hereunder. Polymers such as cellulose esters, especially polymers such as triacetyl cellulose, cellulose acetate butyrate, which exhibit higher softening temperature, are preferable for an overcoating layer as well as an undercoating layer, specifically for a light-insensitive layer such as a protective layer and a backing layer. Incidentally, if desired, the binders may be employed in combination of at least two types.

In the present invention, it is preferable that thermal transition point temperature, after development is at higher or equal to 100° C., is from 46 to 200° C. and is more preferably from 70 to 105° C.

Thermal transition point temperature, as described in the present invention, refers to the VICAT softening point or the value shown by the ring and ball method, and also refers to the endothermic peak which is obtained by measuring the individually peeled photosensitive layer which has been thermally developed, employing a differential scanning calorimeter (DSC), such as EXSTAR 6000 (manufactured by Seiko Denshi Co.), DSC220C (manufactured by Seiko Denshi Kogyo Co.), and DSC-7 (manufactured by Perkin-Elmer Co.).

Commonly, polymers exhibit a glass transition point, Tg. In silver salt photothermographic dry imaging materials, a large endothermic peak appears at a temperature lower than the Tg value of the binder resin employed in the photosensitive layer. The inventors of the present invention conducted diligent investigations while paying special attention to the thermal transition point temperature. As a result, it was discovered that by regulating the thermal transition point temperature to the range of 46 to 200° C., durability of the resultant coating layer increased and in addition, photographic characteristics such as speed, maximum density and image retention properties were markedly improved. Based on the discovery, the present invention was achieved.

The glass transition temperature (Tg) is determined employing the method, described in Brandlap, et al., "Polymer Handbook", pages from III-139 through III-179, 1966 (published by Wiley and Son Co.). The Tg of the binder comprised of copolymer resins is obtained based on the following formula.

$$Tg \text{ of the copolymer (in } ^\circ \text{ C.)} = v_1 Tg_1 + v_2 Tg_2 + \ldots + v_n Tg_n$$

wherein $v_1$, $v_2$, . . . $v_n$ each represents the mass ratio of the monomer in the copolymer, and $Tg_1$, $Tg_2$, . . . $Tg_n$ each represents Tg (in ° C.) of the homopolymer which is prepared employing each monomer in the copolymer. The accuracy of Tg, calculated based on the formula calculation, is ±5° C.

In the silver salt photothermographic dry imaging material of the present invention, employed as binders, which are incorporated in the photosensitive layer, on the support, comprising aliphatic carboxylic acid silver salts, photosensitive silver halide grains and reducing agents, may be conventional polymers known in the art. The polymers have a Tg of 70 to 105° C., a number average molecular weight of 1,000 to 1,000,000, preferably from 10,000 to 500,000, and a degree of polymerization of about 50 to about 1,000. Examples of such polymers include polymers or copolymers comprised of constituent units of ethylenic unsaturated monomers such as vinyl chloride, vinyl acetate, vinyl alcohol, maleic acid, acrylic acid, acrylic acid esters, vinylidene chloride, acrylonitrile, methacrylic acid, methacrylic acid esters, styrene, butadiene, ethylene, vinyl butyral, and vinyl acetal, as well as vinyl ether, and polyurethane resins and various types of rubber based resins.

Further listed are phenol resins, epoxy resins, polyurethane hardening type resins, urea resins, melamine resins, alkyd resins, formaldehyde resins, silicone resins, epoxy-polyamide resins, and polyester resins. Such resins are detailed in "Plastics Handbook", published by Asakura Shoten. These polymers are not particularly limited, and may be either homopolymers or copolymers as long as the resultant glass transition temperature, Tg is in the range of 70 to 105° C.

Listed as homopolymers or copolymers which comprise the ethylenic unsaturated monomers as constitution units are alkyl acrylates, aryl acrylates, alkyl methacrylates, aryl methacrylates, alkyl cyano acrylate, and aryl cyano acrylates, in which the alkyl group or aryl group may not be substituted. Specific alkyl groups and aryl groups include a methyl group, an ethyl group, an n-propyl group, an isopropyl group, an n-butyl group, an isobutyl group, a sec-butyl group, a tert-butyl group, an amyl group, a hexyl group, a cyclohexyl group, a benzyl group, a chlorophenyl group, an octyl group, a stearyl group, a sulfopropyl group, an N-ethyl-phenylaminoethyl group, a 2-(3-phenylpropyloxy) ethyl group, a dimethylaminophenoxyethyl group, a furfuryl group, a tetrahydrofurfuryl group, a phenyl group, a cresyl group, a naphthyl group, a 2-hydroxyethyl group, a 4-hydroxybutyl group, a triethylene glycol group, a dipropylene glycol group, a 2-methoxyethyl group, a 3-methoxybutyl group, a 2-actoxyethyl group, a 2-acetacttoxyethyl group, a 2-methoxyethyl group, a 2-iso-proxyethyl group, a 2-butoxyethyl group, a 2-(2-methoxyethoxy)ethyl group, a 2-(2-ethoxyetjoxy)ethyl group, a 2-(2-bitoxyethoxy)ethyl group, a 2-diphenylphsophorylethyl group, an ω-methoxypolyethylene glycol (the number of addition mol n=6), an ally group, and dimethylaminoethylmethyl chloride.

In addition, employed may be the monomers described below. Vinyl esters: specific examples include vinyl acetate, vinyl propionate, vinyl butyrate, vinyl isobutyrate, vinyl corporate, vinyl chloroacetate, vinyl methoxyacetate, vinyl phenyl acetate, vinyl benzoate, and vinyl salicylate; N-substituted acrylamides, N-substituted methacrylamides and acrylamide and methacrylamide: N-substituents include a methyl group, an ethyl group, a propyl group, a butyl group, a tert-butyl group, a cyclohexyl group, a benzyl group, a hydroxymethyl group, a methoxyethyl group, a dimethylaminoethyl group, a phenyl group, a dimethyl group, a diethyl group, a β-cyanoethyl group, an N-(2-acetacetoxyethyl) group, a diacetone group; olefins: for example, dicyclopentadiene, ethylene, propylene, 1-butene, 1-pentane, vinyl chloride, vinylidene chloride, isoprene, chloroprene, butadiene, and 2,3-dimethylbutadiene; styrenes; for example, methylstyrene, dimethylstyrene, trimethylstyrene, ethylstyrene, isopropylstyrene, tert-butylstyrene, chloromethylstryene, methoxystyrene, acetoxystyrene, chlorostyrene, dichlorostyrene, bromostyrene, and vinyl methyl benzoate; vinyl ethers: for example, methyl vinyl ether, butyl vinyl ether, hexyl vinyl ether, methoxyethyl vinyl ether, and dimethylaminoethyl vinyl ether; N-substituted maleimides: N-substituents include a methyl group, an ethyl group, a propyl group, a butyl group, a tert-butyl group, a cyclohexyl group, a benzyl group, an n-dodecyl group, a phenyl group, a 2-methylphenyl group, a 2,6-diethylphenyl group, and a 2-chlorophenyl group; others include butyl crotonate, hexyl crotonate, dimethyl itaconate, dibutyl itaconate, diethyl maleate, dimethyl maleate, dibutyl maleate, diethyl fumarate, dimethyl fumarate, dibutyl fumarate, methyl vinyl ketone, phenyl vinyl ketone, methoxyethyl vinyl ketone, glycidyl acrylate, glycidyl methacrylate, N-vinyl oxazolidone, N-vinyl pyrrolidone, acrylonitrile, metaacrylonitrile, methylene malonnitrile, vinylidene chloride.

Of these, listed as preferable examples are alkyl methacrylates, aryl methacrylates, and styrenes. Of such polymers, those having an acetal group are preferably employed because they exhibit excellent compatibility with the resultant aliphatic carboxylic acid, whereby an increase in flexibility of the resultant layer is effectively minimized.

Particularly preferred as polymers having an acetal group are the compounds represented by General Formula (V) described below.

General Formula (V)

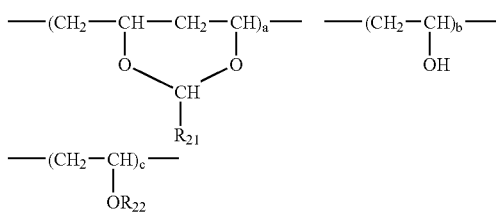

wherein $R_{21}$ represents a substituted or unsubstituted alkyl group, and a substituted or unsubstituted aryl group, however, groups other than the aryl group are preferred; $R_{22}$ represents a substituted or unsubstituted alkyl group, a substituted or unsubstituted aryl group, —$COR_{23}$ or —$CONHR_{23}$, wherein $R_{23}$ represents the same as defined above for $R_{21}$.

Unsubstituted alkyl groups represented by $R_{21}$, $R_{22}$, and $R_{23}$ preferably have from 1 to 20 carbon atoms and more preferably have from 1 to 6 carbon atoms. The alkyl groups may have a straight or branched chain, but preferably have a straight chain. Listed as such unsubstituted alkyl groups are, for example, a methyl group, an ethyl group, an n-propyl group, an isopropyl group, an n-butyl group, an isobutyl group, a t-butyl group, an n-amyl group, a t-amyl group, an n-hexyl group, a cyclohexyl group, an n-heptyl group, an n-octyl group, a t-octyl group, a 2-ethylhexyl group, an n-nonyl group, an n-decyl group, an n-dodecyl group, and an n-octadecyl group. Of these, particularly preferred is a methyl group or a propyl group.

Unsubstituted aryl groups preferably have from 6 to 20 carbon atoms and include, for example, a phenyl group and a naphthyl group. Listed as groups which can be substituted for the alkyl groups as well as the aryl groups are an alkyl group (for example, a methyl group, an n-propyl group, a t-amyl group, a t-octyl group, an n-nonyl group, and a dodecyl group), an aryl group (for example, a phenyl group), a nitro group, a hydroxyl group, a cyano group, a sulfo group, an alkoxy group (for example, a methoxy group), an aryloxy group (for example, a phenoxy group), an acyloxy group (for example, an acetoxy group), an acylamino group (for example, an acetylamino group), a sulfonamido group (for example, methanesulfonamido group), a sulfamoyl group (for example, a methylsulfamoyl group), a halogen atom (for example, a fluorine atom, a chlorine atom, and a bromine atom), a carboxyl group, a carbamoyl group (for example, a methylcarbamoyl group), an alkoxycarbonyl group (for example, a methoxycarbonyl group), and a sulfonyl group (for example, a methylsulfonyl group). When at least two of the substituents are employed, they may be the same or different. The number of total carbons of the substituted alkyl group is preferably from 1 to 20, while the number of total carbons of the substituted aryl group is preferably from 6 to 20.

$R_{22}$ is preferably —$COR_{23}$ (wherein $R_{23}$ represents an alkyl group or an aryl group) and —$CONHR_{23}$ (wherein $R_{23}$ represents an aryl group). "a", "b", and "c" each represents the value in which the weight of repeated units is shown utilizing mol percent; "a" is in the range of 40 to 86 mol percent; "b" is in the range of from 0 to 30 mol percent; "c" is in the range of 0 to 60 mol percent, so that a+b+c=100 is satisfied. Most preferably, "a" is in the range of 50 to 86 mol percent, "b" is in the range of 5 to 25 mol percent, and "c" is in the range of 0 to 40 mol percent. The repeated units having each composition ratio of "a", "b", and "c" may be the same or different.

Employed as polyurethane resins usable in the present invention may be those, known in the art, having a structure of polyester polyurethane, polyether polyurethane, polyether polyester polyurethane, polycarbonate polyurethane, polyester polycarbonate polyurethane, or polycaprolactone polyurethane. It is preferable that, if desired, all polyurethanes described herein are substituted, through copolymerization or addition reaction, with at least one polar group selected from the group consisting of —COOM, —$SO_3M$, —$OSO_3M$, —P═O$(OM)_2$, —O—P═O$(OM)_2$ (wherein M represents a hydrogen atom or an alkali metal salt group), —$N(R_{24})_2$, —$N^+(R_{24})_3$ (wherein $R_{24}$ represents a hydrocarbon group, and a plurality of $R_{54}$ may be the same or different), an epoxy group, —SH, and —CN. The amount of such polar groups is commonly from $10^{-1}$ to $10^{-8}$ mol/g, and is preferably from $10^{-2}$ to $10^{-6}$ mol/g. Other than the polar groups, it is preferable that the molecular terminal of the polyurethane molecule has at least one OH group and at least two OH groups in total. The OH group cross-links with polyisocyanate as a hardening agent so as to form a 3-dimensional net structure. Therefore, the more OH groups which are incorporated in the molecule, the more preferred. It is particularly preferable that the OH group is positioned at the terminal of the molecule since thereby the reactivity with the hardening agent is enhanced. The polyurethane preferably has at least three OH groups at the terminal of the molecules, and more preferably has at least four OH groups. When polyurethane is employed, the polyurethane preferably has a glass transition temperature of 70 to 105° C., a breakage elongation of 100 to 2,000 percent, and a breakage stress of 0.5 to 100 M/mm$^2$.

Polymers represented by aforesaid General Formula (V) of the present invention can be synthesized employing common synthetic methods described in "Sakusan Binihru Jushi (Vinyl Acetate Resins)", edited by Ichiro Sakurada (Kohbunshi Kagaku Kankoh Kai, 1962).

Examples of representative synthetic methods will now be described. However, the present invention is not limited to these: representative synthetic examples.

SYNTHETIC EXAMPLE 1

Synthesis of P-1

Charged into a reaction vessel were 20 g of polyvinyl alcohol (Gosenol GH18) manufactured by Nihon Gosei Co., Ltd. and 180 g of pure water, and the resulting mixture was dispersed in pure water so that 10 weight percent polyvinyl alcohol dispersion was obtained. Subsequently, the resultant dispersion was heated to 95° C. and polyvinyl alcohol was dissolved. Thereafter, the resultant solution was cooled to 75° C., whereby an aqueous polyvinyl alcohol solution was prepared. Subsequently, 1.6 g of 10 percent by weight hydrochloric acid, as an acid catalyst, was added to the solution. The resultant solution was designated as Dripping Solution A. Subsequently, 11.5 g of a mixture consisting of butylaldehyde and acetaldehyde in a mol ratio of 4:5 was prepared and was designated as Dripping Solution B. Added to a 1,000 ml four-necked flask fitted with a cooling pipe and a stirring device was 100 ml of pure water which was heated to 85° C. and stirred well. Subsequently, while stirring, Dripping Solution A and Dripping Solution B were simultaneously added dropwise into the pure water over 2 hours, employing a dripping funnel. During the addition, the reaction was conducted while minimizing coalescence of deposit particles by controlling the stirring rate. After the dropwise addition, 7 g of 10 weight percent hydrochloric acid, as an acid catalyst, was further added, and the resultant mixture was stirred for 2 hours at 85° C., whereby the reaction had sufficiently progressed. Thereafter, the reaction mixture was cooled to 40° C. and was neutralized employing sodium bicarbonate. The resultant product was washed with water 5 times, and the resultant polymer was collected through filtration and dried, whereby P-1 was prepared. The Tg of obtained P-1 was determined employing a DSC, resulting in 83° C.

Other polymers described in Table 1 were synthesized in the same manner as above.

These polymers may be employed individually or in combinations of at least two types as a binder. The polymers are employed as a main binder in the photosensitive silver salt containing layer (preferably in a photosensitive layer) of the present invention. The main binder, as described herein, refers to the binder in "the state in which the proportion of the aforesaid binder is at least 50 percent by weight of the total binders of the photosensitive silver salt containing layer". Accordingly, other binders may be employed in the range of less than 50 weight percent of the total binders. The other polymers are not particularly limited as long as they are soluble in the solvents capable of dissolving the polymers of the present invention. More preferably listed as the polymers are poly(vinyl acetate), acrylic resins, and urethane resins.

Compositions of polymers, which are preferably employed in the present invention, are shown in Table 1. Incidentally, Tg in Table 1 is a value determined employing a differential scanning calorimeter (DSC), manufactured by Seiko Denshi Kogyo Co., Ltd.

TABLE 1

| Polymer Name | Acetoacetal mol % | Butyral mol % | Acetal mol % | Acetyl mol % | Hydroxyl Group mol % | Tg Value (° C.) |
|---|---|---|---|---|---|---|
| P-1 | 6 | 4 | 73.7 | 1.7 | 24.6 | 85 |
| P-2 | 3 | 7 | 75.0 | 1.6 | 23.4 | 75 |
| P-3 | 10 | 0 | 73.6 | 1.9 | 24.5 | 110 |
| P-4 | 7 | 3 | 71.1 | 1.6 | 27.3 | 88 |
| P-5 | 10 | 0 | 73.3 | 1.9 | 24.8 | 104 |
| P-6 | 10 | 0 | 73.5 | 1.9 | 24.6 | 104 |
| P-7 | 3 | 7 | 74.4 | 1.6 | 24.0 | 75 |
| P-8 | 3 | 7 | 75.4 | 1.6 | 23.0 | 74 |
| P-9 | — | — | — | — | — | 60 |

Incidentally, in Table 1, P-9 is a polyvinyl butyral resin B-79, manufactured by Solutia Ltd. "-" in the table 1 means "not measured".

In the present invention, it is known that by employing cross-linking agents in the aforesaid binders, uneven development is minimized due to the improved adhesion of the layer to the support. In addition, it results in such effects that fogging during storage is minimized and the creation of printout silver after development is also minimized.

Organic solvent-insoluble non-aqueous dispersion particles (hereinafter also referred to simply as dispersion particles) capable of being added to the silver salt photothermographic materials of the present invention will now be described.

Employed as the non-aqueous dispersion particles are, for example, organic polymer particles (for example, particles known as non-aqueous dispersion particles (NAD)), and organic and inorganic composite particles without any limitation. Of these, preferably employed may be polymerizable monomers having an unsaturated double bond, and the resin cross-linking particles, as described below. Incidentally, non-aqueous dispersion particles, as described herein, refer to particles which are present in a suspension state in solvents incorporating water in an amount of at least 80 percent.

When binders and non-aqueous dispersion particles are employed during preparation of a photosensitive emulsion coating composition, dispersibility is enhanced and storage stability is also improved. Further, the liquid particle coating composition results in less stitches, and when silver salt photothermographic dry imaging materials are prepared by coating the above coating composition and subsequently drying the resulting coating at relatively low temperature, staining is reduced.

It is preferable that polymerizable monomers, having an unsaturated double bond, which are employed to produce the dispersion particles, preferably employed in the present invention, incorporate hydroxyl such as hydroxyalkyl acrylate, hydroxyalkyl methacrylate, and lactone modified compounds thereof. Examples of hydroxyalkyl acrylates include those in which the number of carbon atoms of the alkyl group is also 1–6, such as 2-hydroxyethyl acrylate and 2-hydroxypropyl acrylate, while examples of hydroxyalkyl methacrylates includes those in which the number of carbon atoms of the alkyl group is 1–6, such as 2-hydroxyethyl methacrylate and 2-hydroxypropyl methacrylate.

Further, listed as specific examples of lactone modified compounds, of the above hydroxyalkyl acrylates and hydroxyalkyl methacrylates, are lactone-modified 2-hydroxyethyl acrylate and lactone-modified 2-hydroxyethyl methacrylate. The blending ratio of polymerizable monomers having a hydroxyl group and an unsaturated double bond in the polymerizable monomers having an unsaturated double bond is preferably 0.5–35 percent by weight, but is more preferably 1–30 percent by weight.

Further, examples of polymerizable monomers having a carboxyl group and an unsaturated double bond employed to produce the dispersion particles usable in the present invention include acrylic acid, methacrylic acid, maleic acid, and fumaric acid. A carboxyl group may be present in the form of an acid anhydride group, and it is also possible to use maleic anhydride. The former components are employed individually or in combinations of at least two types. The blending ratio of the polymerizable monomers having a carboxyl group and an unsaturated double bond in polymerizable monomers having an unsaturated double bond is preferably 0.1–10 percent by weight, but is more preferably 0.5–8 percent by weight. These polymerizable monomers having an unsaturated double bond may be employed individually or in combinations of at least two types.

In the present invention, are also preferably employed cross-linking resinous particles. Preferably employed are those which are prepared by copolymerizing cross-linking monomers (hereinafter also referred to as "cross-linking monomers") having at least two unsaturated polymerizable groups. It is more preferable that other monomers are selected so that monomers having a functional group other than the polymerizable group such as a carboxyl group, an epoxy group, an amino group, an isocyanate group, or a hydroxyl group are included.

Listed as examples of the above "cross-linking monomers" may be compounds having a plurality of polymerizable unsaturated groups, such as divinylbenzene, diallyl phthalate, ethylene glycol di(meth)acrylate, trimethylolpropane tri(meth)acrylate, or pentaerythritol acrylate.

Exemplified as examples of "other monomers" may be butadiene, isoprene, dimethylbutadiene, chloroprene, and 1,3-pentadiene; unsaturated nitrile compounds such as (meth)acrylonitrile, α-chloroacrylonitrile, α-ethoxyacrylonitrile, crotonic acid nitrile, cinnamic acid nitrile, itaconic acid dinitrile, maleic acid dinitrile, fumaric acid dinitrile, unsaturated nitrile compounds such as (meth)acrylonitrile, α-chloroacrylonitrile, α-methoxyacrylonitrile, α-ethoxyacrylonitrile, crotonic acid nitrile, cinnamic acid nitrile, itaconic acid dinitrile, maleic acid dinitrile, and fumaric acid dinitrile; unsaturated amides such as (meth)acrylamide, N,N'-methylenebis(meth)acrylamide, N,N'-ethylenebis(meth)acrylamide, N,N'-hexamethylenebis(meth)acrylamide, N-hydroxymethyl(meth)acrylamide, N-(2-hydroxyethyl)(meth)acrylamide, N,N-bis(2-hydroxyerthyl)(meth)acrylamide, crotonic acid amide, and cinnamic acid amide; (meth)acrylic acid esters such as methyl (meth)acrylate, ethyl (meth)acrylate, propyl (meth)acrylate, butyl (meth)acrylate, hexyl (meth)acrylate, lauryl (meth)acrylate, polyethylene glycol (meth)acrylate, and polyethylene glycol (meth)acrylate; aromatic vinyl compounds such as styrene, α-methylstyrene, and o-methoxystyrene; epoxy(meth)acrylates which are prepared by allowing glycidyl ether of bisphenol A or diglycidyl ether of glycol to react with (meth)acrylic acid or hydroxyalkyl (meth)acrylate; urethane (meth)acrylates which are prepared by allowing hydroxyalkyl (meth)acrylate to react with polyisocyanate; epoxy groups containing unsaturated compounds such as glycidyl (meth)acrylate or (meth)acryl glycidyl ether; unsaturated oxides such as (meth)acrylic acid, itaconic acid, β-(meth) acryloxyethyl succinate, β-(meth)acryloxyethyl maleate, β-(meth)acryloxyethyl phthalate, or (meth)acryloxethyl hexahydrophthalate; amino groups containing unsaturated compounds such as dimethylamino(meth)acrylate and diethylamino(meth)acrylate; amide groups containing unsaturated compounds such as (meth)acrylamide and dimethyl (meth)acrylamide; and hydroxyl groups containing unsaturated compounds such as hydroxyethyl (meth)acrylate and hydroxypropyl (meth)acrylate.

Preferably employed as the dispersion particles of the present invention are urethane based cross-linking particles. Employed as dispersion stabilizers required to achieve dispersion stability of urethane components added to dispersion media may be one or more types selected from the group consisting of polyvinyl alcohol, hydroxyalkyl cellulose, carboxyalkyl cellulose, gum Arabic, polyacrylates, polyacrylamide, polyvinylpyrrolidone, and ethylene-maleic anhydride copolymers, as well as conventionally employed various types of nonionic, anionic or cationic surface active agents, and various types of protective colloids.

In the dispersion particles of the present invention, the average diameter (φn) of the primary particles in a dry state is commonly 0.05–2 μm, but is preferably 0.05–0.5 μm. When the above average particle diameter (φn) is less than 0.05 μm, the particles tend to coagulate, whereby it is difficult to uniformly disperse them into organic solvents. On the other hand, when the average particle diameter (φn) exceeds 2 μm, the resulting coating haze is increased.

Further, in the present invention, it is a feature that the above dispersion particles are insoluble in organic solvents.

Specific examples of the dispersion particles of the present invention will now be listed below, however the present invention is not limited thereto.

PB-1: STAFLOID IM-101 (produced by Ganz Chemical Industry Co., Ltd.)

PB-2: STAFLOID IM-203 (produced by Ganz Chemical Industry Co., Ltd.)

PB-3: STAFLOID IM-401 (produced by Ganz Chemical Industry Co., Ltd.)

PB-4: STAFLOID IM-601 (produced by Ganz Chemical Industry Co., Ltd.)

PB-5: STAFLOID AC3355 (produced by Ganz Chemical Industry Co., Ltd.)

PB-6: STAFLOID AC3354 (produced by Ganz Chemical Industry Co., Ltd.)

PB-7: NARPOW VP-101 (available from Sanyo Trading Co., Ltd.)

PB-8: NARPOW VP-101 (available from Sanyo Trading Co., Ltd.)

PB-9: NARPOW VP-101 (available from Sanyo Trading Co., Ltd.)

PB-10: NARPOW VP-101 (available from Sanyo Trading Co., Ltd.)

PB-11: AQUABRID 4735 (available from Daicel Chemical Industries, Ltd.)

Further, the glass transition temperature (Tg) of the dispersion particle binders of the present invention is preferably from −40 to 105° C. When it is excessively low, the dispersion particles are adversely affected by external stress, while when it is excessively high, heat development is deactivated.

The used amount of the following binders containing dispersion particles is in such a range in which functions as binders are effectively exhibited. It is possible for a person skilled in the art to readily determine the affective range. For example, an index in cases in which aliphatic carboxylic acid silver salts are held in a photosensitive layer is such that the ratio of the binders to the aliphatic carboxylic acid silver salts is preferably 15:1–1:2, but is more preferably 8:1–1:1. Namely, the amount of binders in the photosensitive layer is preferably 1.5–6 g/m$^2$, but is more preferably 1.7–5 g/m$^2$. When the amount is less than 1.5 g/m$^2$, density of unexposed portions excessively increases, resulting occasionally in commercial unviability.

<Cross-linking Agents of the Photosensitive Layer>

Listed as photosensitive layer cross-linking agents usable in the present invention may be various ones which have been employed for silver halide light-sensitive photographic materials and listed may be hardening agents preferably employed in the above protective layer.

The amount of the compounds represented by above General Formula (IC) employed in the present invention is commonly in the range of 0.001–2 mol per mol of silver, but is preferably in the range of 0.005–0.5 mol.

Epoxy compounds represented by above General Formula (EP) may be employed individually or in combinations of at least two types. The added amount is not particularly limited, and is preferably in the range of $1\times10^{-6}$–$1\times10^{-2}$ mol/m$^2$, but is more preferably in the range of $1\times10^{-5}$–$1\times10^{-3}$ mol/m$^2$.

It is possible to incorporate epoxy compounds into any of the layers on the photosensitive layer side of the support such as a photosensitive layer, a surface protective layer, an interlayer, or a sublayer, as well as into one or more layers. Further, it is possible to incorporate them into any of the layers on the support opposite the photosensitive layer. Incidentally, when the above epoxy compounds are incorporated into photosensitive materials carrying a photosensitive layer on both sides, they may be incorporated into any of the layers.

The amount of the acid anhydrides represented by above General Formula (SA) is preferably in the range of $1\times10^{-6}$–$1\times10^{-2}$ mol/m$^2$, but is more preferably in the range of $1\times10^{-5}$–$1\times10^{-3}$ mol/m$^2$.

In the present invention, it is possible to incorporate acid anhydrides into any of the layers on the photosensitive layer side of the support such as a photosensitive layer, a surface protective layer, an interlayer, an anti-halation layer or a sublayer, and into one or more layers. Further, they may be incorporated into the same layer as for the above epoxy compounds.

<Silver Halide Grains>

Photosensitive silver halide grains (hereinafter simply referred to as silver halide grains) will be described which are employed in the silver salt photothermographic dry imaging material of the present invention (hereinafter simply referred to as the photosensitive material of the present invention).

The photosensitive silver halide grains, as described in the present invention, refer to silver halide crystalline grains which can originally absorb light as an inherent quality of silver halide crystals, can absorb visible light or infrared radiation through artificial physicochemical methods and are treatment-produced so that physicochemical changes occur in the interior of the silver halide crystal and/or on the crystal surface, when the crystals absorb any radiation from ultraviolet to infrared.

Silver halide grains employed in the present invention can be prepared in the form of silver halide grain emulsions, employing methods described in P. Glafkides, "Chimie et Physique Photographiques" (published by Paul Montel Co., 1967), G. F. Duffin, "Photographic Emulsion Chemistry" (published by The Focal Press, 1955), and V. L. Zelikman et al., "Making and Coating Photographic Emulsion", published by The Focal Press, 1964). Namely, any of an acidic method, a neutral method, or an ammonia method may be employed. Further, employed as methods to allow water-soluble silver salts to react with water-soluble halides may be any of a single-jet precipitation method, a double-jet precipitation method, or combinations thereof. However, of these methods, the so-called controlled double-jet precipitation method is preferably employed in which silver halide grains are prepared while controlling formation conditions.

Halogen compositions are not particularly limited. Any of silver chloride, silver chlorobromide, silver chloroiodobromide, silver bromide, silver iodobromide, or silver iodide may be employed. Of these, silver bromide or silver iodobromide is particularly preferred.

The content ratio of iodine in silver iodobromide is preferably in the range of 0.02 to 16 mol percent per Ag mol. Iodine may be incorporated so that it is distributed into the entire silver halide grain. Alternatively, a core/shell structure may be formed in which, for example, the concentration of iodine in the central portion of the grain is increased, while the concentration near the grain surface is simply decreased or substantially decreased to zero.

Grain formation is commonly divided into two stages, that is, the formation of silver halide seed grains (being nuclei) and the growth of the grains. Either method may be employed in which two stages are continually carried out, or in which the formation of nuclei (seed grains) and the growth of grains are carried out separately. A controlled double-jet precipitation method, in which grains are formed while controlling the pAg and pH which are grain forming conditions, is preferred, since thereby it is possible to control grain shape as well as grain size. For example, when the method, in which nucleus formation and grain growth are separately carried out, is employed, initially, nuclei (being seed grains) are formed by uniformly and quickly mixing water-soluble silver salts with water-soluble halides in an aqueous gelatin solution. Subsequently, under the controlled pAg and pH, silver halide grains are prepared through a grain growing process which grows the grains while supplying water-soluble silver salts as well as water-soluble halides.

In order to minimize milkiness (or white turbidity) as well as coloration (yellowing) after image formation and to obtain excellent image quality, the average grain diameter of the silver halide grains, employed in the present invention, is preferably rather small. The average grain diameter, when grains having a grain diameter of less than 0.02 μm is beyond practical measurement, is preferably 0.035 to 0.055 μm.

Incidentally, grain diameter, as described herein, refers to the edge length of silver halide grains which are so-called regular crystals such as a cube or an octahedron. Further, when silver halide gains are planar, the grain diameter refers to the diameter of the circle which has the same area as the projection area of the main surface.

In the present invention, silver halide grains are preferably in a state of monodispersion. Monodispersion, as described herein, means that the variation coefficient, obtained by the formula described below, is less than or equal to 30 percent. The aforesaid variation coefficient is preferably less than or equal to 20 percent, and is more preferably less than or equal to 15 percent.

Variation coefficient (in percent) of grain diameter=standard deviation of grain diameter/average of grain diameter×100

Cited as shapes of silver halide grains may be cubic, octahedral and tetradecahedral grains, planar grains, spherical grains, rod-shaped grains, and roughly elliptical-shaped grains. Of these, cubic, octahedral, tetradecahedral, and planar silver halide grains are particularly preferred.

When the aforesaid planar silver halide grains are employed, their average aspect ratio is preferably 1.5 to 100, and is more preferably 2 to 50. These are described in U.S. Pat. Nos. 5,264,337, 5,314,798, and 5,320,958, and incidentally it is possible to easily prepare the aforesaid target planar grains. Further, it is possible to preferably employ silver halide grains having rounded corners.

The crystal habit of the external surface of silver halide grains is not particularly limited. However, when spectral sensitizing dyes, which exhibit crystal habit (surface) selectiveness are employed, it is preferable that silver halide grains are employed which have the crystal habit matching their selectiveness in a relatively high ratio. For example, when sensitizing dyes, which are selectively adsorbed onto a crystal plane having a Miller index of (100), it is preferable that the ratio of the (100) surface on the external surface of silver halide grains is high. The ratio is preferably at least 50 percent, is more preferably at least 70 percent, and is most preferably at least 80 percent. Incidentally, it is possible to obtain a ratio of the surface having a Miller index of (100), based on T. Tani, J. Imaging Sci., 29, 165 (1985), utilizing adsorption dependence of sensitizing dye in a (111) plane as well as a (100) surface.

The silver halide grains, employed in the present invention, are preferably prepared employing low molecular weight gelatin, having an average molecular weight of less than or equal to 50,000 during the formation of the grains, which are preferably employed during formation of nuclei. The low molecular weight gelatin refers to gelatin having an average molecular weight of less than or equal to 50,000. The molecular weight is preferably from 2,000 to 40,000, and is more preferably from 5,000 to 25,000. It is possible to measure the molecular weight of gelatin employing gel filtration chromatography.

The concentration of dispersion media during the formation of nuclei is preferably less than or equal to 5 percent by weight. It is more effective to carry out the formation at a low concentration of 0.05 to 3.00 percent by weight.

During formation of the silver halide grains employed in the present invention, it is possible to use polyethylene oxides represented by the general formula described below.

$$YO(CH_2CH_2O)_{ma}(CH(CH_3)CH_2O)_{pa}(CH_2CH_2O)_{na}Y \quad \text{General Formula}$$

wherein Y represents a hydrogen atom, —$SO_3M$, or —CO—B—COOM; M represents a hydrogen atom, an alkali metal atom, an ammonium group, or an ammonium group substituted with an alkyl group having less than or equal to 5 carbon atoms; B represents a chained or cyclic group which forms an organic dibasic acid; ma and na each represents 0 through 50; and pa represents 1 through 100.

When silver halide photosensitive photographic materials are produced, polyethylene oxides, represented by the above general formula, have been preferably employed as anti-foaming agents to counter marked foaming which occurs while stirring and transporting emulsion raw materials in a process in which an aqueous gelatin solution is prepared, in the process in which water-soluble halides as well as water-soluble silver salts are added to the gelatin solution, and in a process in which the resultant emulsion is applied onto a support. Techniques to employ polyethylene oxides as an anti-foaming agent are disclosed in, for example, JP-A No. 44-9497. The polyethylene oxides represented by the above general formula function as an anti-foaming agent during nuclei formation.

The content ratio of polyethylene oxides, represented by the above general formula, is preferably less than or equal to 1 percent by weight with respect to silver, and is more preferably from 0.01 to 0.10 percent by weight.

It is desired that polyethylene oxides, represented by the above general formula, are present during nuclei formation. It is preferable that they are previously added to the dispersion media prior to nuclei formation. However, they may also be added during nuclei formation, or they may be employed by adding them to an aqueous silver salt solution or an aqueous halide solution which is employed during nuclei formation. However, they are preferably employed by adding them to an aqueous halide solution, or to both aqueous solutions in an amount of 0.01 to 2.00 percent by weight. Further, it is preferable that they are present during at least 50 percent of the time of the nuclei formation process, and it is more preferable that they are present during at least 70 percent of the time of the same. The polyethylene oxides, represented by the above general formula, may be added in the form of powder or they may be dissolved in a solvent such as methanol and then added.

Incidentally, temperature during nuclei formation is commonly from 5 to 60° C., and is preferably from 15 to 50° C. It is preferable that the temperature is controlled within the range, even when a constant temperature, a temperature increasing pattern (for example, a case in which temperature at the initiation of nuclei formation is 25° C., subsequently, temperature is gradually increased during nuclei formation and the temperature at the completion of nuclei formation is 40° C.), or a reverse sequence may be employed.

The concentration of an aqueous silver salt solution and an aqueous halide solution, employed for nuclei formation, is preferably less than or equal to 3.5 M, and is more preferably in the lower range of 0.01 to 2.50 M. The silver ion addition rate during nuclei formation is preferably from $1.5\times10^{-3}$ to $3.0\times10^{-1}$ mol/minute, and is more preferably from $3.0\times10^{-3}$ to $8.0\times10^{-2}$ mol/minute.

The pH during nuclei formation can be set in the range of 1.7 to 10.0. However, since the pH on the alkali side broadens the particle size distribution of the formed nuclei, the preferred pH is from 2 to 6. Further, the pBr during nuclei formation is usually from about 0.05 to about 3.00, is preferably from 1.0 to 2.5, and is more preferably from 1.5 to 2.0.

<Silver Halide Grains of Internal Latent Formation after Thermal Development>

The photosensitive silver halide grains according to the present invention are characterized in that they have a property to change from a surface latent image formation type to an internal latent image formation type after subjected to thermal development. This change is caused by decreasing the speed of the surface latent image formation by the effect of thermal development.

When the silver halide grains are exposed to light prior to thermal development, latent images capable of functioning as a catalyst of development reaction are formed on the surface of the aforesaid silver halide grains. "Thermal development" is a reduction reaction by a reducing agent for silver ions. On the other hand, when exposed to light after the thermal development process, latent images are more formed in the interior of the silver halide grains than the surface thereof. As a result, the silver halide grains result in retardation of latent image formation on the surface.

It was not known in the field of a photothermographic material to employ the above-mentioned silver halide grains which largely change their latent image formation function before and after thermal development.

Generally, when photosensitive silver halide grains are exposed to light, silver halide grains themselves or spectral sensitizing dyes, which are adsorbed on the surface of photosensitive silver halide grains, are subjected to photoexcitation to generate free electrons. Generated electrons are competitively trapped by electron traps (sensitivity centers) on the surface or interior of silver halide grains.

Accordingly, when chemical sensitization centers (chemical sensitization specks) and dopants, which are useful as an electron trap, are much more located on the surface of the silver halide grains than the interior thereof and the number is appropriate, latent images are dominantly formed on the surface, whereby the resulting silver halide grains become developable. Contrary to this, when chemical sensitization centers (chemical sensitization specks) and dopants, which are useful as an electron trap, are much more located in the interior of the silver halide grains than the surface thereof and the number is appropriate, latent images are dominantly formed in the interior, whereby it becomes difficult to develop the resulting silver halide grains. In other words, in the former, the surface speed is higher than interior speed, while in the latter, the surface speed is lower than the interior speed. The former type of latent image is called "a surface latent image", and the latter is called "an internal latent image". Examples of the references are:

(1) T. H. James ed., "The Theory of the Photographic Process" $4^{th}$ edition, Macmillan Publishing Co., Ltd. 1977; and (2) Japan Photographic Society, "Shashin Kogaku no Kiso" (Basics of Photographic Engineering), Corona Publishing Co. Ltd., 1998.

The photosensitive silver halide grains of the present invention are preferably provided with dopants which act as electron trapping in the interior of silver halide grains at least in a stage of exposure to light after thermal development. This is required so as to achieve high photographic speed grains as well as high image keeping properties.

It is especially preferred that the dopants act as a hole trap during an exposure step prior to thermal development, and the dopants change after a thermal development step resulting in functioning as an electron trap.

Electron trapping dopants, as described herein, refer to silver, elements except for halogen or compounds constituting silver halide, and the aforesaid dopants themselves which exhibit properties capable of trapping free electron, or the aforesaid dopants are incorporated in the interior of silver halide grains to generate electron trapping portions such as lattice defects. For example, listed are metal ions other than silver ions or salts or complexes thereof, chalcogen (such as elements of oxygen family) sulfur, selenium, or tellurium, inorganic or organic compounds comprising nitrogen atoms, and rare earth element ions or complexes thereof.

Listed as metal ions, or salts or complexes thereof may be lead ions, bismuth ions, and gold ions, or lead bromide, lead carbonate, lead sulfate, bismuth nitrate, bismuth chloride, bismuth trichloride, bismuth carbonate, sodium bismuthate, chloroauric acid, lead acetate, lead stearate, and bismuth acetate.

Employed as compounds comprising chalcogen such as sulfur, selenium, and tellurium may be various chalcogen releasing compounds which are generally known as chalcogen sensitizers in the photographic industry. Further, preferred as organic compounds comprising chalcogen or nitrogen are heterocyclic compounds which include, for example, imidazole, pyrazole, pyridine, pyrimidine, pyrazine, pyridazine, triazole, triazine, indole, indazole, purine, thiazole, oxadiazole, quinoline, phthalazine, naphthylizine, quinoxaline, quinazoline, cinnoline, pteridine, acridine, phenanthroline, phenazine, tetrazole, thiazole, oxazole, benzimidazole, benzoxazole, benzothiazole, indolenine, and tetraazaindene. Of these, preferred are imidazole, pyrazine, pyrimidine, pyrazine, pyridazine, triazole, triazine, thiadiazole, oxadiazole, quinoline, phthalazine, naphthylizine, quinoxaline, quinazoline, cinnoline, tetrazole, thiazole, oxazole, benzimidazole, benzoxazole, benzothiazole, and tetraazaindene.

Incidentally, the aforesaid heterocyclic compounds may have substituent(s). Preferable substituents include an alkyl group, an alkenyl group, an aryl group, an alkoxy group, an aryloxy group, an acyloxy group, an acyl group, an alkoxycarbonyl group, an aryloxycarbonyl group, an acyloxy group, an acylamino group, an alkoxycarbonylamino group, an aryloxycarbonylamino group, a sulfonylamino group, a sulfamoyl group, a carbamoyl group, a sulfonyl group, a ureido group, a phosphoric acid amide group, a halogen atom, a cyano group, a sulfo group, a carboxyl group, a nitro group, a heterocyclic group. Of these, more preferred are an alkyl group, an aryl group, an alkoxy group, an aryloxy group, an acyl group, an acylamino group, an alkoxycarbonylamino group, an aryloxycarbonylamino group, a sulfonylamino group, a sulfamoyl group, a carbamoyl group, a ureido group, a phosphoric acid amido group, a halogen atom, a cyano group, a nitro group, and a heterocyclic group. More preferred are an alkyl group, an aryl group, an alkoxy group, an aryloxy group, an acyl group, an acylamino group, a sulfonylamino group, a sulfamoyl group, a carbamoyl group, a halogen atom, a cyano group, a nitro group, and a heterocyclic group.

Incidentally, ions of transition metals which belong to Groups 6 through 11 in the Periodic Table may be chemically modified to form a complex employing ligands of the oxidation state of the ions and incorporated in silver halide grains employed in the present invention so as to function as an electron trapping dopant, as described above, or as a hole trapping dopant. Preferred as aforesaid transition metals are W, Fe, Co, Ni, Cu, Ru, Rh, Pd, Re, Os, Ir, and Pt.

In the present invention, aforesaid various types of dopants may be employed individually or in combination of at least two of the same or different types. It is required that at least one of the dopants act as an electron trapping dopant during an exposure time after being thermal developed. They may be incorporated in the interior of the silver halide grains in any forms of chemical states.

It is not recommended to use a complex or a salt of Ir or Cu as a single dopant without combining with other dopant.

The content ratio of dopants is preferably in the range of $1\times10^{-9}$ to $1\times10$ mol per mol of silver, and is more preferably $1\times10^{-6}$ to $1\times10^{-2}$ mol.

However, the optimal amount varies depending the types of dopants, the diameter and shape of silver halide grains, and ambient conditions. Accordingly, it is preferable that addition conditions are optimized taking into account these conditions.

In the present invention, preferred as transition metal complexes or complex ions are those represented by the general formula described below.

$$[ML_6]^m \qquad \text{General Formula}$$

wherein M represents a transition metal selected from the elements of Groups 6 through 11 in the Periodic Table; L represents a ligand; and m represents 0, -, 2-, 3-, or 4-. Listed as specific examples of ligands represented by L are a halogen ion (a fluoride ion, a chloride ion, a bromide ion, or an iodide ion), a cyanide, a cyanate, a thiocyanate, a selenocyanate, a tellurocyanate, an azide, and an aqua ligand, and nitrosyl and thionitrosyl. Of these, aqua, nitrosyl, and thionitrosyl are preferred. When the aqua ligand is present, one or two ligands are preferably occupied by the aqua ligand. L may be the same or different.

It is preferable that compounds, which provide ions of these metals or complex ions, are added during formation of silver halide grains so as to be incorporated in the silver halide grains. The compounds may be added at any stage of, prior to or after, silver halide grain preparation, namely nuclei formation, grain growth, physical ripening or chemical ripening. However, they are preferably added at the stage of nuclei formation, grain growth, physical ripening, are more preferably added at the stage of nuclei formation and growth, and are most preferably added at the stage of nuclei formation. They may be added over several times upon dividing them into several portions. Further, they may be uniformly incorporated in the interior of silver halide grains. Still further, as described in JP-A Nos. 63-29603, 2-306236, 3-167545, 4-76534, 6-110146, and 5-273683, they may be incorporated so as to result in a desired distribution in the interior of the grains.

These metal compounds may be dissolved in water or suitable organic solvents (for example, alcohols, ethers, glycols, ketones, esters, and amides) and then added. Further, addition methods include, for example, a method in which either an aqueous solution of metal compound powder or an aqueous solution prepared by dissolving metal compounds together with NaCl and KCl is added to a water-soluble halide solution, a method in which silver halide grains are formed by a silver salt solution, and a halide solution together with a the compound solution as a third aqueous solution employing a triple-jet precipitation method, a method in which, during grain formation, an aqueous metal compound solution in a necessary amount is charged into a reaction vessel, or a method in which, during preparation of silver halide, other silver halide grains which have been doped with metal ions or complex ions are added and dissolved. Specifically, a method is preferred in which either an aqueous solution of metal compound powder or an aqueous solution prepared by dissolving metal compounds together with NaCl and KCl is added to a water-soluble halide solution. When added onto the grain surface, an aqueous metal compound solution in a necessary amount may be added to a reaction vessel immediately after grain formation, during or after physical ripening, or during chemical ripening.

Incidentally, it is possible to introduce non-metallic dopants into the interior of silver halide employing the same method as the metallic dopants.

In the imaging materials in accordance with the present invention, it is possible to evaluate whether the aforesaid dopants exhibit electron trapping properties or not, while employing a method which has commonly employed in the photographic industry. Namely a silver halide emulsion comprised of silver halide grains, which have been doped with the aforesaid dopant or decomposition product thereof so as to be introduced into the interior of grains, is subjected to photoconduction measurement, employing a microwave photoconduction measurement method. Subsequently, it is possible to evaluate the aforesaid electron trapping properties by comparing the resulting decrease in photoconduction to that of the silver halide emulsion comprising no dopant as a standard. It is also possible to evaluate the same by performing experiments in which the internal speed of the aforesaid silver halide grains is compared to the surface speed.

Further, a method follows which is applied to a finished photothermographic dry imaging material to evaluate the electron trapping dopant effect in accordance with the present invention. For example, prior to exposure, the aforesaid imaging material is heated under the same conditions as the commonly employed thermal development conditions. Subsequently, the resulting material is exposed to white light or infrared radiation through an optical wedge for a definite time (for example, 30 seconds), and thermally developed under the same thermal development conations as above, whereby a characteristic curve (or a densitometry curve) is obtained. Then, it is possible to evaluate the aforesaid electron trapping dopant effect by comparing the speed obtained based on the characteristic curve to that of the imaging material which is comprised of the silver halide emulsion which does not comprise the aforesaid electron trapping dopant. Namely, it is necessary to confirm that the speed of the former sample comprised of the silver halide grain emulsion comprising the dopant in accordance with the present invention is lower than the latter sample which does not comprise the aforesaid dopant.

Speed of the aforesaid material is obtained based on the characteristic curve which is obtained by exposing the aforesaid material to white light or infrared radiation through an optical wedge for a definite time (for example 30 seconds) followed by developing the resulting material under common thermal development conditions. Further, speed of the aforesaid material is obtained based on the characteristic curve which is obtained by heating the aforesaid material under common thermal development conditions prior to exposure and giving the same definite exposure as above to the resulting material for the same definite time as above followed by thermally developing the resulting material under common thermal development conditions. The ratio of the latter speed to the former speed is preferably at most 1/10, and is more preferably at most 1/20. When the silver halide emulsion is chemically sensitized, the preferred photographic speed ratio is as low as not more than 1/50.

The silver halide grains of the present invention may be incorporated in a photosensitive layer employing an optional method. In such a case, it is preferable that the aforesaid silver halide grains are arranged so as to be adjacent to reducible silver sources (being aliphatic carboxylic silver salts) in order to get an imaging material having a high covering power (CP).

The silver halide of the present invention is previously prepared and the resulting silver halide is added to a solution which is employed to prepare aliphatic carboxylic acid silver salt particles. By so doing, since a silver halide preparation process and an aliphatic carboxylic acid silver salt particle preparation process are performed independently, production is preferably controlled. Further, as described in British Patent No. 1,447,454, when aliphatic carboxylic acid silver salt particles are formed, it is possible to almost simultaneously form aliphatic carboxylic acid silver salt particles by charging silver ions to a mixture consisting of halide components such as halide ions and aliphatic carboxylic acid silver salt particle forming components. Still further, it is possible to prepare silver halide grains utilizing conversion of aliphatic carboxylic acid silver salts by allowing halogen-containing components to act on aliphatic carboxylic acid silver salts. Namely, it is possible to convert some of aliphatic carboxylic acid silver salts to photosensitive silver halide by allowing silver halide forming components to act on the previously prepared aliphatic carboxylic acid silver salt solution or dispersion, or sheet materials comprising aliphatic carboxylic acid silver salts.

Silver halide grain forming components include inorganic halogen compounds, onium halides, halogenated hydrocarbons, N-halogen compounds, and other halogen containing compounds.

Specific examples are disclosed in; U.S. Pat. Nos. 4,009,039, 3,4757,075, 4,003,749; GB Pat. No. 1,498,956; and JP-A Nos. 53-27027, 53-25420.

Further, silver halide grains may be employed in combination which are produced by converting some part of separately prepared aliphatic carboxylic acid silver salts.

The aforesaid silver halide grains, which include separately prepared silver halide grains and silver halide grains prepared by partial conversion of aliphatic carboxylic acid silver salts, are employed commonly in an amount of 0.001 to 0.7 mol per mol of aliphatic carboxylic acid silver salts and preferably in an amount of 0.03 to 0.5 mol.

The separately prepared photosensitive silver halide particles are subjected to desalting employing desalting methods known in the photographic art, such as a noodle method, a flocculation method, an ultrafiltration method, and an electrophoresis method, while they may be employed without desalting.

<Light-insensitive Aliphatic Carboxylic Acid Silver Salt>

The light-insensitive aliphatic carboxylic acid silver salts according to the present invention are reducible silver sources which are preferably silver salts of long chain aliphatic carboxylic acids, having from 10 to 30 carbon atoms and preferably from 15 to 25 carbon atoms. Listed as examples of appropriate silver salts are those described below.

For example, listed are silver salts of gallic acid, oxalic acid, behenic acid, stearic acid, arachidic acid, palmitic acid, and lauric acid. Of these, listed as preferable silver salts are silver behenate, silver arachidate, and silver stearate.

Further, in the present invention, it is preferable that at least two types of aliphatic carboxylic acid silver salts are mixed since the resulting developing ability is enhanced and high contrast silver images are formed. Preparation is preferably carried out, for example, by mixing a mixture consisting of at least two types of aliphatic carboxylic acid with a silver ion solution.

On the other hand, from the viewpoint of enhancing retaining properties of images, the melting point of aliphatic carboxylic acids, which are employed as a raw material of aliphatic carboxylic acid silver, is commonly at least 50° C., and is preferably at least 60° C. The content ratio of aliphatic carboxylic acid silver salts is commonly at least 60 percent, is preferably at least 70 percent, and still more preferably at least 80 percent. From this viewpoint, specifically, it is preferable that the content ratio of silver behenate is higher.

Aliphatic carboxylic acid silver salts are prepared by mixing water-soluble silver compounds with compounds which form complexes with silver. When mixed, a normal precipitation method, a reverse precipitating method, a double-jet precipitation method, or a controlled double-jet precipitation method, described in JP-A No. 9-127643, are preferably employed. For example, after preparing a metal salt soap (for example, sodium behenate and sodium arachidate) by adding alkali metal salts (for example, sodium hydroxide and potassium hydroxide) to organic acids, crystals of aliphatic carboxylic acid silver salts are prepared by mixing the soap with silver nitrate. In such a case, silver halide grains may be mixed together with them.

The kinds of alkaline metal salts employed in the present invention include sodium hydroxide, potassium hydroxide, and lithium hydroxide, and it is preferable to simultaneously use sodium hydroxide and potassium hydroxide. When simultaneously employed, the mol ratio of sodium hydroxide to potassium hydroxide is preferably in the range of 10:90–75:25. When the alkali metal salt of aliphatic carboxylic acid is formed via a reaction with an aliphatic carboxylic acid, it is possible to control the viscosity of the resulting liquid reaction composition within the desired range.

Further, in the case in which aliphatic carboxylic acid silver is prepared in the presence of silver halide grains at an average grain diameter of at most 0.050 μm, it is preferable that the ratio of potassium among alkaline metals in alkaline metal salts is higher than the others, since dissolution of silver halide grains as well as Ostwald ripening is retarded. Further, as the ratio of potassium salts increases, it is possible to decrease the size of fatty acid silver salt particles. The ratio of potassium salts is preferably 50–100 percent with respect to the total alkaline metal salts, while the concentration of alkaline metal salts is preferably 0.1–0.3 mol/1,000 ml.

<Silver Salt Particles at a High Silver Ratio>

An emulsion containing aliphatic carboxylic acid silver salt particles according to the present invention is a mixture consisting of free aliphatic carboxylic acids which do not form silver salts, and aliphatic carboxylic acid silver salts. In view of storage stability of images, it is preferable that the ratio of the former is lower than the latter. Namely, the aforesaid emulsion according to the present intention preferably contains aliphatic carboxylic acids in an amount of 3–10 mol percent with respect to the aforesaid aliphatic carboxylic acid silver salt particles, and most preferably 4–8 mol percent.

Incidentally, in practice, each of the amount of total aliphatic carboxylic acids and the amount of free aliphatic carboxylic acids is determined employing the methods described below. Whereby, the amount of aliphatic carboxylic acid silver salts and free aliphatic carboxylic acids, and each ratio, or the ratio of free carboxylic acids to total aliphatic carboxylic acids, are calculated.

(Quantitative Analysis of the Amount of Total Aliphatic Carboxylic Acids (the Total Amount of These being Due to Both of the Aforesaid Aliphatic Carboxylic Acid Silver Salts and Free Acids))

(1) A sample in an amount (the weight when peeled from a photosensitive material) of approximately 10 mg is accurately weighed and placed in a 200 ml egg plant type flask.
(2) Subsequently, 15 ml of methanol and 3 ml of 4 mol/L hydrochloric acid are added and the resulting mixture is subjected to ultrasonic dispersion for one minute.
(3) Boiling stones made of Teflon (registered trade name) are placed and refluxing is performed for 60 minutes.
(4) After cooling, 5 ml of methanol is added from the upper part of the cooling pipe and those adhered to the cooling pipe are washed into the ovoid flask (this is repeated twice).
(5) The resulting liquid reaction composition is subjected to extraction employing ethyl acetate (separation extraction is performed twice by adding 100 ml of ethyl acetate and 70 ml of water).
(6) Vacuum drying is then performed at normal temperature for 30 minutes.
(7) Placed in a 10 ml measuring flask is 1 ml of a benzanthrone solution as an internal standard (approximately 100 mg of benzanthrone is dissolved in toluene and the total volume is made to 100 ml by the addition of toluene).
(8) The sample is dissolved in toluene and placed in the measuring flask described in (7) and the total volume is adjusted by the addition of toluene.
(9) Gas chromatography (GC) measurements are performed under the measurement conditions below.

Apparatus: HP-5890+HP-Chemistation
Column: HP-1 30 m×0.32 mm×0.25 μm (manufactured by Hewlett-Packard)
Injection inlet: 250° C.
Detector: 280° C.
Oven: maintained at 250° C.
Carrier gas: He
Head pressure: 80 kPa (Quantitative Analysis of Free Aliphatic Carboxylic Acids)

(1) A sample in an amount of approximately 20 mg is accurately weighed and placed in a 200 ml ovoid flask. Subsequently, 100 ml of methanol was added and the resulting mixture is subjected to ultrasonic dispersion (free organic carboxylic acids are extracted).
(2) The resulting dispersion is filtered. The filtrate is placed in a 200 ml ovoid flask and then dried up (free organic carboxylic acids are separated).
(3) Subsequently, 15 ml of methanol and 3 ml of 4 mol/L hydrochloric acid are added and the resulting mixture is subjected to ultrasonic dispersion for one minute.
(4) Boiling stones made of Teflon (registered trade mark) were added, and refluxing is performed for 60 minutes.
(5) Added to the resulting liquid reaction composition are 60 ml of water and 60 ml of ethyl acetate, and a methyl-esterificated product of organic carboxylic acids is then extracted to an ethyl acetate phase. Ethyl acetate extraction is performed twice.
(6) The ethyl acetate phase is dried, followed by vacuum drying for 30 minutes.
(7) Placed in a 10 ml measuring flask is 1 ml of a benzanthrone solution (being an internal standard and prepared in such a manner that approximately 100 mg of benzanthrone is dissolved in toluene and the total volume is made to 100 ml by the addition of toluene).
(8) The product obtained in (6) is dissolved in toluene and placed in the measuring flask described in (7) and the total volume is adjusted by the addition of more toluene.
(9) Carried out GC measurement using the conditions described below.

Apparatus: HP-5890+HP-Chemistation
Column: HP-1 30 m×0.32 mm×0.25 μm (manufactured by Hewlett-Packard)
Injection inlet: 250° C.
Detector: 280° C.
Oven: maintained at 250° C.

Carrier gas: He

Head pressure: 80 kPa

<Morphology of Aliphatic Carboxylic Acid Silver Salts>

Aliphatic carboxylic acid silver salts according to the present invention may be crystalline grains which have the core/shell structure disclosed in European Patent No. 1168069A1 and Japanese Patent Application Open to Public Inspection No. 2002-023303. Incidentally, when the core/shell structure is formed, organic silver salts, except for aliphatic carboxylic acid silver, such as silver salts of phthalic acid and benzimidazole may be employed wholly or partly in the core portion or the shell portion as a constitution component of the aforesaid crystalline grains.

In the aliphatic carboxylic acid silver salts according to the present invention, it is preferable that the average circle equivalent diameter is from 0.05 to 0.80 μm, and the average thickness is from 0.005 to 0.070 μm. It is still more preferable that the average circle equivalent diameter is from 0.2 to 0.5 mm, and it is more preferable that the average circle equivalent diameter is from 0.2 to 0.5 μm and the average thickness is from 0.01 to 0.05 μm.

When the average circle equivalent diameter is less than or equal to 0.05 μm, excellent transparency is obtained, while image retention properties are degraded. On the other hand, when the average grain diameter is less than or equal to 0.8 μm, transparency is markedly degraded. When the average thickness is less than or equal to 0.005 μm, during development, silver ions are abruptly supplied due to the large surface area and are present in a large amount in the layer, since specifically in the low density section, the silver ions are not used to form silver images. As a result, the image retention properties are markedly degraded. On the other hand, when the average thickness is more than or equal to 0.07 μm, the surface area decreases, whereby image stability is enhanced. However, during development, the silver supply rate decreases and in the high density section, silver formed by development results in non-uniform shape, whereby the maximum density tends to decrease.

The average circle equivalent diameter can be determined as follows. Aliphatic carboxylic acid silver salts, which have been subjected to dispersion, are diluted, are dispersed onto a grid covered with a carbon supporting layer, and imaged at a direct magnification of 5,000, employing a transmission type electron microscope (Type 2000FX, manufactured by JEOL, Ltd.). The resultant negative image is converted to a digital image employing a scanner. Subsequently, by employing appropriate software, the grain diameter (being a circle equivalent diameter) of at least 300 grains is determined and an average grain diameter is calculated.

It is possible to determine the average thickness, employing a method utilizing a transmission electron microscope (hereinafter referred to as a TEM) as described below.

First, a photosensitive layer, which has been applied onto a support, is adhered onto a suitable holder, employing an adhesive, and subsequently, cut in the perpendicular direction with respect to the support plane, employing a diamond knife, whereby ultra-thin slices having a thickness of 0.1 to 0.2 μm are prepared. The ultra-thin slice is supported by a copper mesh and transferred onto a hydrophilic carbon layer, employing a glow discharge. Subsequently, while cooling the resultant slice at less than or equal to −130° C. employing liquid nitrogen, a bright field image is observed at a magnification of 5,000 to 40,000, employing TEM, and images are quickly recorded employing either film, imaging plates, or a CCD camera. During the operation, it is preferable that the portion of the slice in the visual field is suitably selected so that neither tears nor distortions are imaged.

The carbon layer, which is supported by an organic layer such as extremely thin collodion or Formvar, is preferably employed. The more preferred carbon layer is prepared as follows. The carbon layer is formed on a rock salt substrate which is removed through dissolution. Alternately, the organic layer is removed employing organic solvents and ion etching whereby the carbon layer itself is obtained. The acceleration voltage applied to the TEM is preferably from 80 to 400 kV, and is more preferably from 80 to 200 kV.

Other items such as electron microscopic observation techniques, as well as sample preparation techniques, may be obtained while referring to either "Igaku-Seibutsugaku Denshikenbikyo Kansatsu Gihoh (Medical-Biological Electron Microscopic Observation Techniques", edited by Nippon Denshikembikyo Gakkai Kanto Shibu (Maruzen) or "Denshikembikyo Seibutsu Shiryo Sakuseihoh (Preparation Methods of Electron Microscopic Biological Samples", edited by Nippon Denshikenbikyo Gakkai Kanto Shibu (Maruzen).

It is preferable that a TEM image, recorded in a suitable medium, is decomposed into preferably at least 1,024×1,024 pixels and subsequently subjected to image processing, utilizing a computer. In order to carry out the image processing, it is preferable that an analogue image, recorded on a film strip, is converted into a digital image, employing any appropriate means such as scanner, and if desired, the resulting digital image is subjected to shading correction as well as contrast-edge enhancement. Thereafter, a histogram is prepared, and portions, which correspond to aliphatic carboxylic acid silver salts, are extracted through a binarization processing.

At least 300 of the thickness of aliphatic carboxylic acid silver salt particles, extracted as above, are manually determined employing appropriate software, and an average value is then obtained.

Methods to prepare aliphatic carboxylic acid silver salt particles, having the shape as above, are not particularly limited. It is preferable to maintain a mixing state during formation of an organic acid alkali metal salt soap and/or a mixing state during addition of silver nitrate to the soap as desired, and to optimize the proportion of organic acid to the soap, and of silver nitrate which reacts with the soap.

It is preferable that, if desired, the planar aliphatic carboxylic acid silver salt particles (referring to aliphatic carboxylic acid silver salt particles, having an average circle equivalent diameter of 0.05 to 0.80 μm as well as an average thickness of 0.005 to 0.070 μm) are preliminarily dispersed together with binders as well as surface active agents, and thereafter, the resultant mixture is dispersed employing a media homogenizer or a high pressure homogenizer. The preliminary dispersion may be carried out employing a common anchor type or propeller type stirrer, a high speed rotation centrifugal radial type stirrer (being a dissolver), and a high speed rotation shearing type stirrer (being a homomixer).

Further, employed as the aforesaid media homogenizers may be rotation mills such as a ball mill, a planet ball mill, and a vibration ball mill, media stirring mills such as a bead mill and an attritor, and still others such as a basket mill. Employed as high pressure homogenizers may be various types such as a type in which collision against walls and plugs occurs, a type in which a liquid is divided into a plurality of portions which are collided with each other at high speed, and a type in which a liquid is passed through narrow orifices.

Preferably employed as ceramics, which are used in ceramic beads employed during media dispersion are, for example, yttrium-stabilized zirconia, and zirconia-reinforced alumina (hereafter ceramics containing zirconia are abbreviated to as zirconia). The reason of the preference is that impurity formation due to friction with beads as well as the homogenizer during dispersion is minimized.

In apparatuses which are employed to disperse the planar aliphatic carboxylic acid silver salt particles of the present invention, preferably employed as materials of the members which come into contact with the aliphatic carboxylic acid silver salt particles are ceramics such as zirconia, alumina, silicon nitride, and boron nitride, or diamond. Of these, zirconia is preferably employed. During the dispersion, the concentration of added binders is preferably from 0.1 to 10.0 percent by weight with respect to the weight of aliphatic carboxylic acid silver salts. Further, temperature of the dispersion during the preliminary and main dispersion is preferably maintained at less than or equal to 45° C. The examples of the preferable operation conditions for the main dispersion are as follows. When a high pressure homogenizer is employed as a dispersion means, preferable operation conditions are from 29 to 100 MPa, and at least double operation frequency. Further, when the media homogenizer is employed as a dispersion means, the peripheral rate of 6 to 13 m/second is cited as the preferable condition.

In the present invention, light-insensitive aliphatic carboxylic acid silver salt particles are preferably formed in the presence of compounds which function as a crystal growth retarding agent or a dispersing agent. Further, the compounds which function as a crystal growth retarding agent or a dispersing agent are preferably organic compounds having a hydroxyl group or a carboxyl group.

In the present invention, compounds, which are described herein as crystal growth retarding agents or dispersing agents for aliphatic carboxylic acid silver salt particles, refer to compounds which, in the production process of aliphatic carboxylic acid silver salts, exhibit more functions and greater effects to decrease the grain diameter, and to enhance monodispersibility when the aliphatic carboxylic acid silver salts are prepared in the presence of the compounds, compared to the case in which the compounds are not employed. Listed as examples are monohydric alcohols having 10 or fewer carbon atoms, such as preferably secondary alcohol and tertiary alcohol; glycols such as ethylene glycol and propylene glycol; polyethers such as polyethylene glycol; and glycerin. The preferable addition amount is from 10 to 200 percent by weight with respect to aliphatic carboxylic acid silver salts.

On the other hands, preferred are branched aliphatic carboxylic acids, each containing an isomer, such as isoheptanic acid, isodecanoic acid, isotridecanoic acid, isomyristic acid, isopalmitic acid, isostearic acid, isoarachidinic acid, isobehenic acid, or isohexaconic acid. Listed as preferable side chains are an alkyl group or an alkenyl group having 4 or fewer carbon atoms. Further, listed are aliphatic unsaturated carboxylic acids such as palmitoleic acid, oleic acid, linoleic acid, linolenic acid, moroctic acid, eicosenoic acid, arachidonic acid, eicosapentaenoic acid, erucic acid, docosapentaenoic acid, and selacholeic acid. The preferable addition amount is from 0.5 to 10.0 mol percent of aliphatic carboxylic acid silver salts.

Preferable compounds include glycosides such as glucoside, galactoside, and fructoside; trehalose type disaccharides such as trehalose and sucrose; polysaccharides such as glycogen, dextrin, dextran, and alginic acid; cellosolves such as methyl cellosolve and ethyl cellosolve; water-soluble organic solvents such as sorbitan, sorbitol, ethyl acetate, methyl acetate, and dimethylformamide; and water-soluble polymers such as polyvinyl alcohol, polyacrylic acid, acrylic acid copolymers, maleic acid copolymers, carboxymethyl cellulose, hydroxypropyl cellulose, hydroxypropyl methyl cellulose, polyvinylpyrrolidone, and gelatin. The preferable addition amount is from 0.1 to 20.0 percent by weight with respect to aliphatic carboxylic acid silver salts.

Alcohols having 10 or fewer carbon atoms, being preferably secondary alcohols and tertiary alcohols, increase the solubility of sodium aliphatic carboxylates in the emulsion preparation process, whereby the viscosity is lowered so as to enhance the stirring efficiency and to enhance monodispersibility as well as to decrease particle size. Branched aliphatic carboxylic acids, as well as aliphatic unsaturated carboxylic acids, result in higher steric hindrance than straight chain aliphatic carboxylic acid silver salts as a main component during crystallization of aliphatic carboxylic acid silver salts to increase the distortion of crystal lattices whereby the particle size decreases due to non-formation of over-sized crystals.

<Antifoggant and Image Stabilizer>

As mentioned above, being compared to conventional silver halide photosensitive photographic materials, the greatest different point in terms of the structure of silver salt photothermographic dry imaging materials is that in the latter materials, a large amount of photosensitive silver halide, organic silver salts and reducing agents is contained which are capable of becoming causes of generation of fogging and printout silver, irrespective of prior and after photographic processing. Due to that, in order to maintain storage stability before development and even after development, it is important to apply highly effective fog minimizing and image stabilizing techniques to silver salt photothermographic dry imaging materials. Other than aromatic heterocyclic compounds which retard the growth and development of fog specks, heretofore, mercury compounds, such as mercury acetate, which exhibit functions to oxidize and eliminate fog specks, have been employed as a markedly effective storage stabilizing agents. However, the use of such mercury compounds may cause problems regarding safety as well as environmental protection.

The important points for achieving technologies for antifogging and image stabilizing are:

to prevent formation of metallic silver or silver atoms caused by reduction of silver ion during preserving the material prior to or after development; and to prevent the formed silver from effecting as a catalyst for oxidation (to oxidize silver into silver ions) or reduction (to reduce silver ions to silver).

Antifoggants as well as image stabilizing agents which are employed in the silver salt photothermographic dry imaging material of the present invention will now be described.

In the silver salt photothermographic dry imaging material of the present invention, one of the features is that bisphenols are mainly employed as a reducing agent, as described below. It is preferable that compounds are incorporated which are capable of deactivating reducing agents upon generating active species capable of extracting hydrogen atoms from the aforesaid reducing agents.

Preferred compounds are those which are capable of: preventing the reducing agent from forming a phenoxy radial; or trapping the formed phenoxy radial so as to stabilize the phenoxy radial in a deactivated form to be effective as a reducing agent for silver ions.

Preferred compounds having the above-mentioned properties are non-reducible compounds having a functional group capable of forming a hydrogen bonding with a hydroxyl group in a bis-phenol compound. Examples are compounds having in the molecule such as, a phosphoryl group, a sulfoxide group, a sulfonyl group, a carbonyl group, an amido group, an ester group, a urethane group, a ureido group, a tertiary amino group, or a nitrogen containing aromatic group.

More preferred are compounds having a sulfonyl group, a sulfoxide group or a phosphoryl group in the molecule.

Specific examples are disclosed in, JP-A Nos. 6-208192, 20001-215648, 3-50235, 2002-6444, 2002-18264. Another examples having a vinyl group are disclosed in, Japanese translated PCT Publication No. 2000-515995, JP-A Nos. 2002-207273, and 2003-140298.

Further, it is possible to simultaneously use compounds capable of oxidizing silver (metallic silver) such as compounds which release a halogen radical having oxidizing capability, or compounds which interact with silver to form a charge transfer complex. Specific examples of compounds which exhibit the aforesaid function are disclosed in JP-A Nos. 50-120328, 59-57234, 4-232939, 6-208193, and 10-197989, as well as U.S. Pat. No. 5,460,938, and JP-A No. 7-2781. Specifically, in the imaging materials according to the present invention, specific examples of preferred compounds include halogen radical releasing compounds which are represented by General Formula (OFI) below.

$$Q_{12}\text{-}Y_{11}\text{—}C(X_{11})(X_{12})(X_{13}) \qquad \text{General Formula (OFI):}$$

In General Formula (OFI), $Q_{12}$ represents an aryl group or a heterocyclic group; $X_{11}$, $X_{12}$, and $X_{13}$ each represent a hydrogen atom, a halogen atom, an acyl group, an alkoxycarbonyl group, an aryloxycarbonyl group, a sulfonyl group, or an aryl group, at least one of which is a halogen atom; and $Y_{11}$ represents —C(═O)—, —SO— or —$SO_2$—.

The aryl group represented by $Q_{12}$ may be in the form of a single ring or a condensed ring, and is preferably a single ring or double ring aryl group having 6–30 carbon atoms (for example, phenyl and naphthyl) and is more preferably a phenyl group and a naphthyl group, and is still more preferably a phenyl group.

The heterocyclic group represented by $Q_{12}$ is a 3- to 10-membered saturated or unsaturated heterocyclic group containing at least one of N, O, or S, which may be a single ring or may form a condensed ring with another ring.

The heterocyclic group is preferably a 5- to 6-membered unsaturated heterocyclic group which may have a condensed ring, is more preferably a 5- to 6-membered aromatic heterocyclic group which may have a condensed ring, and is most preferably a 5- to 6-membered aromatic heterocyclic group which may have a condensed ring containing 1 to 4 nitrogen atoms. Heterocycles in such heterocyclic groups are preferably imidazole, pyrazole, pyridine, pyrazine, pyridazine, triazole, triazine, indole, indazole, purine, thiadiazole, oxadiazole, quinoline, phthalazine, naphthyridine, quinoxaline, quinazoline, cinnoline, pteridine, acridine, phenanthroline, phenazine, tetrazole, thiazole, oxazole, benzimidazole, benzoxazole, benzthiazole, indolenine, and tetraazaindene; are more preferably imidazole, pyridine, pyrimidine, pyrazine, pyridazine, triazole, triazine, thiadiazole, oxadiazole, quinoline, phthalazine, naphthyridine, quinoxaline, quinazoline, cinnoline, tetrazole, thiazole, oxazole, benzimidazole, benzoxazole, benzthiazole, and tetraazaindene; are still more preferably imidazole, pyridine, pyrimidine, pyrazine, pyridazine, triazole, triazine, thiadiazole, quinoline, phthalazine, naphthyridine, quinoxaline, quinazoline, cinnoline, tetrazole, triazole, benzimidazole, and benzthiazole; and are most preferably pyridine, thiadiazole, quinoline, and benzthiazole.

The aryl group and heterocyclic group represented by $Q_{12}$ may have a substituent other than —$Y_{11}$—$C(X_{11})(X_{12})(X_{13})$ Substituents are preferably an alkyl group, an alkenyl group, an aryl group, an alkoxy group, an aryloxy group, an acyloxy group, an acyl group, an alkoxycarbonyl group, an aryloxycarbonyl group, an acyloxy group, an acylamino group, an alkoxycarbonylamino group, an aryloxycarbonylamino group, a sulfonylimino group, a sulfamoyl group, a carbamoyl group, a sulfonyl group, a ureido group, a phosphoric acid amide group, a halogen atom, a cyano group, a sulfo group, a carboxyl group, a nitro group, and a heterocyclic group; are more preferably an alkyl group, an aryl group, an alkoxy group, an aryloxy group, an acyl group, an acylamino group, an alkoxycarbonylamino group, an aryloxycarbonylamino group, a sulfonylamino group, a sulfamoyl group, a carbamoyl group, a ureido group, a phosphoric acid amide group, a halogen atom, a cyano group, a nitro group, and a heterocyclic group; are more preferably an alkyl group, an aryl group, an alkoxy group, an aryloxy group, an acyl group, an acylamino group, a sulfonylimino group, a sulfamoyl group, a carbamoyl group, a halogen atom, a cyano group, a nitro group, and a heterocyclic group; and are most preferably an alkyl group, an aryl group, are a halogen atom.

Each of $X_{11}$, $X_{12}$, and $X_{13}$ is preferably a halogen atom, a haloalkyl group, an acyl group, an alkoxycarbonyl group, an aryloxycarbonyl group, a carbamoyl group, a sulfamoyl group, a sulfonyl group, or a heterocyclic group; is more preferably a halogen atom, a haloalkyl group, an acyl group, an alkoxycarbonyl group, an aryloxycarbonyl group, or a sulfonyl group; is still more preferably a halogen atom or a trihalomethyl group; and is most preferably a halogen atom. Of halogen atoms preferred are a chlorine atom, a bromine atom and an iodine atom. Of these, a chlorine atom and a bromine atom are more preferred and a bromine atom is particularly preferred.

$Y_{11}$ represents —C(═O)— or —$SO_2$—, and is preferably —$SO_2$—.

The added amount of these compounds is commonly $1\times10^{-4}$–1 mol per mol of silver, and is preferably $1\times10^{-3}$–$5\times10^{-2}$ mol.

Incidentally, in the imaging materials according to the present invention, it is possible to use those disclosed in JP-A No. 2003-5041 in the manner as the compounds represented by aforesaid General Formula (OFI).

(Polymer PO Inhibitors)

Further, in view of the capability of more stabilizing of silver images, as well as an increase in photographic speed and CP, it is preferable to use, in the photothermographic imaging materials according to the present invention, as an image stabilizer, polymers which have at least one repeating unit of the monomer having a radical releasing group disclosed in JP-A No. 2003-91054. Specifically, in the photothermographic imaging materials according to the present invention, desired results are unexpectedly obtained.

Incidentally, other than the above-mentioned compounds, compounds which are conventionally known as an antifogging agent may be incorporated in the silver salt photothermographic dry imaging materials of the present invention.

For example, listed are the compounds described in U.S. Pat. Nos. 3,589,903, 4,546,075, and 4,452,885, and JP-A Nos. 9-288328 and 9-90550. Listed as other antifogging agents are compounds disclosed in U.S. Pat. No. 5,028,523, and European Patent Nos. 600,587, 605,981 and 631,176.

<Polycarboxyl Compounds>

In the imaging materials according to the present invention, it is preferable to use the compounds represented by the following General Formula (PC) as an antifogging agent and a storage stabilizer.

$$R_{30}—(CO—O-M_{30})_{n3} \qquad \text{General Formula (PC):}$$

wherein $R_{30}$ represents a linkable atom, an aliphatic group, an aromatic group, a heterocyclic group, or a group of atoms capable of forming a ring as they combine with each other; $M_{30}$ represents a hydrogen atom, a metal atom, a quaternary ammonium group, or a phosphonium group; and n3 represents an integer of 2–20.

Listed as linkable atoms in General Formula (PC) represented by $R_{30}$ are those such as nitrogen, oxygen, sulfur or phosphor.

Listed as aliphatic groups represented by $R_{30}$ are straight or branched alkyl, alkenyl, alkynyl, and cycloalkyl groups having 1–30 and preferably 1–20 carbon atoms. Specific examples include methyl, ethyl, butyl, hexyl, decyl, dodecyl, isopropyl, t-butyl, 2-ethylhexyl, allyl, butenyl, 7-octenyl, propagyl, 2-butynyl, cyclopropyl, cyclopentyl, cyclohexyl, and cyclododecyl groups.

Listed as aromatic groups represented by $R_{30}$ are those having 6–20 carbon atoms, and specific examples include phenyl, naphthyl, and anthranyl groups.

Heterocyclic groups represented by $R_{30}$ may be in the form of a single ring or a condensed ring and include 5- to 6-membered heterocyclic groups which have at least O, S, or N atoms, or an amineoxido group. Listed as specific examples are pyrrolidine, piperidine, tetrahydrofuran, tetrahydropyran, oxirane, morpholine, thiomorpholine, thiopyran, tetrahydrothiophene, pyrrole, pyridine, furan, thiophene, imidazole, pyrazole, oxazole, thiazole, isoxazole, isothiazole, triazole, tetrazole, thiadiazole, and oxadiazole, and groups derived from these benzelogues.

In the case in which $R_{30}$ is formed employing $R_{31}$ and $R_{32}$, each $R_{31}$ or $R_{32}$ is defined as $R_{30}$, and $R_{31}$ and $R_{32}$ may be the same or different. Listed as rings which are formed employing $R_{31}$ and $R_{32}$ may be 4- to 7-membered rings. Of these, are preferred 5- to 7-membered rings. Preferred groups represented by $R_{31}$ and $R_{32}$ include aromatic groups as well as heterocyclic groups. Aliphatic groups, aromatic groups, or heterocyclic rigs may be further substituted with a substituent. Listed as the above substituents are a halogen atom (e.g., a chlorine atom or a bromine atom), an alkyl group (e.g., a methyl group, an ethyl group, an isopropyl group, a hydroxyethyl group, a methoxymethyl group, a trifluoromethyl group, or a t-butyl group), a cycloalkyl group (e.g., a cyclopentyl group or a cyclohexyl group), aralkyl group (e.g., a benzyl group or a 2-phenetyl group), an aryl group (e.g., phenyl group, a naphthyl group, a p-tolyl group, or a p-chlorophenyl group), an alkoxy group (e.g., a methoxy group, an ethoxy group, an isopropoxy group, or a butoxy group), an aryloxy group (e.g., a phenoxy group or a 4-methoxyphenoxy group), a cyano group, an acylamino group (e.g., an acetylamino group or a propionylamino group), an alkylthio group (e.g., a methylthio group, an ethylthio group, or a butylthio group), an arylthio group (e.g., a phenylthio group or a p-methylphenylthio group), a sulfonylamino group (e.g, a methanesulfonylamino group or a benzenesulfonylamino group), a ureido group (e.g., a 3-methylureido group, a 3,3-dimethylureido group, or a 1,3-dimethylureido group), a sulfamoylamino group (a dimethylsulfamoylamino group or a diethylsulfamoylamino group), a carbamoyl group (e.g., a methylcarbamoyl group, an ethylcarbmoyl group, or a dimerthylcarbamoyl group), a sulfamoyl group (e.g., an ethylsulfamoyl group or a dimethylsulfamoyl group), an alkoxycarbonyl group (e.g., a methoxycarbonyl group or an ethoxycarbonyl group), an aryloxycarbonyl group (e.g., a phenoxycarbonyl group or a p-chlorophenoxycarbonyl group), a sulfonyl group (e.g., a methanesulfonyl group, a butanesulfonyl group, or a phenylsulfonyl group), an acyl group (e.g., an acetyl group, a propanoyl group, or a butyroyl group), an amino group (e.g., a methylamino group, an ethylamino group, and a dimethylamino group), a hydroxy group, a nitro group, a nitroso group, an amineoxide group (e.g., a pyridine-oxide group), an imido group (e.g., a phthalimido group), a disulfide group (e.g., a benzenedisulfide group or a benzthiazoryl-2-disulfide group), and a heterocyclic group (e.g., a pyridyl group, a benzimidazolyl group, a benzthiazoyl group, or a benzoxazolyl group). $R_{31}$ and $R_{32}$ may each have a single substituent or a plurality of substituents selected from the above. Further, each of the substituents maybe further substituted with the above substituents. Still further, $R_{31}$ and $R_{32}$ may be the same or different. Yet further, when General Formula (PC-1) is an oligomer or a polymer $(R_{30}—(COOM_{30})_{n3})_{m3}$, desired effects are obtained, wherein n3 is preferably an integer of 2–20, and m3 is preferably an integer of 1–100, or the molecular weight is preferably at most 50,000.

Acid anhydrides of General Formula (PC-1), as described in the present invention, refer to compounds which are formed in such a manner that two carboxyl groups of the compound represented by General Formula (PC-1) undergo dehydration reaction. Acid anhydrides are preferably prepared from compounds having 3–10 carboxyl groups and derivatives thereof.

Further preferably employed are simultaneously dicarboxylic acids described in JP-A Nos. 58-95338, 10-288824, 11-174621, 11-218877, 2000-10237, 2000-10236, and 2000-10231.

<Thiosulfonic Acid Restrainers>

It is preferable that imaging materials according to the present invention contain the compounds represented by General Formula (ST):

$$Z_4\text{-}SO_2.S\text{-}M_4 \qquad \text{General Formula (ST)}$$

wherein $Z_4$ represents an unsubstituted or substituted alkyl group, an aryl group or a heterocyclic group; and $M_4$ represents a metal atom or an organic cation.

In the compounds represented by General Formula (ST), the alkyl group, aryl group, heterocyclic group, aromatic ring and heterocyclic ring, which are represented by $Z_4$ may be substituted. Listed as the substituents may be, for example, a lower alkyl group such as a methyl group or an ethyl group, an aryl group such as a phenyl group, an alkoxyl group having 1–8 carbon atoms, a halogen atom such as chlorine, a nitro group, an amino group, or a carboxyl group. Metal atoms represented by $M_4$ are alkaline metals such as a sodium ion or a potassium ion, while as the organic cation preferred are an ammonium ion or a guanidine group.

It is possible to synthesize the compounds represented by General Formula (ST), employing methods which are generally well known. For example, it is possible to synthesize them employing a method in which corresponding sulfonyl fluoride is allowed to react with sodium sulfide, or corresponding sodium sulfinate is allowed to react with sulfur. On the other hand, these compounds are also easily available on the market.

The compounds represented by General Formula (ST) may be added at any time prior to the coating process of the production process of the imaging materials according to the present invention. However, it is preferable that they are added to a liquid coating composition just before the coating.

The added amount of the compounds represented by General Formula (ST) is not particularly limited, but is preferably in the range of $1\times10^{-6}$–1 g per mol of the total silver amount, including silver halides.

Incidentally, similar compounds are disclosed in JP-A No. 8-314059.

<Electron Attractive Group Containing Vinyl Type Restrainers>

In the present invention, it is preferable to simultaneously use the fog restrainers represented by General Formula (CV).

General Formula (CV)

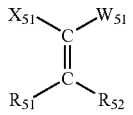

wherein, $X_{51}$ represents an electron withdrawing group; $W_{51}$ represents a hydrogen atom, an alkyl group, an alkenyl group, an alkynyl group, an aryl group, a heterocyclic group, a halogen atom, a cyano group, an acyl group, a thioacyl group, an oxalyl group, an oxyoxalyl group, a —S-oxalyl group, an oxamoyl group, an oxycarbonyl group, a —S-carbonyl group, a carbamoyl group, a thiocarbamoyl group, a sulfonyl group, a sulfinyl group, an oxysulfonyl group, a —S-sulfonyl group, a sulfamoyl group, an oxysulfinyl group, a —S-sulfinyl group, a sulfinamoyl group, a phosphoryl group, a nitro group, an imino group, a N-carbonylimino group, a N-sulfonylimino group, an ammonium group, a sulfonium group, a phosphonium group, a pyrylium group or an immonium group; $R_{51}$ represents a hydroxyl group or a salt thereof; and $R_{52}$ represents an alkyl group, an alkenyl group, an alkynyl group, an aryl group or a heterocyclic group, provided that $X_{51}$ and $W_{51}$ may form a ring structure by bonding to each other, $X_{51}$ and $R_{51}$ may be a cis-form or a trans-form.

In General Formula (CV), an electron withdrawing group represented by $X_{51}$ is a substituent, Hammett's σp of which is positive. Specifically, listed are substituted alkyl groups (such as halogen-substituted alkyl), substituted alkenyl groups (such as cyanovinyl), substituted and non-substituted alkynyl groups (such as trifluoroacetylenyl, cyanoacetylenyl and formylacetylenyl), substituted aryl groups (such as cyan ophenyl), substituted and non-substituted heterocyclic groups (pyridyl, triazinyl and benzooxazolyl), a halogen atom, a cyano group, acyl groups (such as acetyl, trifluoroacetyl and formyl), thioacyl groups (such as thioformyl and thioacetyl), oxalyl groups (such as methyloxalyl), oxyoxalyl groups (such as ethoxalyl), —S-oxalyl groups (such as ethylthiooxalyl), oxamoyl groups (such as methyloxamoyl), oxycarbonyl groups (such as ethoxycarbonyl and carboxyl), —S-carbonyl groups (such as ethylthiocarbonyl), a carbamoyl group, a thiocarbamoyl group, a sulfonyl group, a sulfinyl group, oxysulfonyl groups (such as ethoxysulfonyl), —S-sulfonyl groups (such as ethylthiosulfonyl), a sulfamoyl group, oxysulfinyl groups (such as methoxysulfinyl), —S-sulfinyl groups (such as methylthiosulfinyl), a sulfinamoyl group, a phosphoryl group, a nitro group, imino groups (such as imino, N-methylimino, N-phenylimino, N-pyridylimino, N-cyanoimino and N-nitroimino), N-carbonylimino groups (such as N-acetylimino, N-ethoxycarbonylimino, N-ethoxalylimino, N-formylimino, N-trifluoroacetylimino and N-carbamoylimino), N-sulfonylimino groups (such as N-methanesulfonylimino, N-trifluoromethanesulfonylimino, N-methoxysulfonylimino and N-sulfamoylimino), an ammonium group, a sulfonium group, a phosphonium group, a pyrilium group or an immonium group, and also listed are heterocyclic groups in which rings are formed by such as an ammonium group, a sulfonium group, a phosphonium group and an immonium group. Provided that X does not represent a formyl group. The σp value is preferably not less than 0.2 and more preferably not less than 0.3.

$W_{51}$ includes a hydrogen atom, alkyl groups (such as methyl, ethyl and trifluoromethyl), alkenyl groups (such as vinyl, halogen substituted vinyl and cyano vinyl), alkynyl groups (such as acetylenyl and cyanoacetylenyl), aryl groups (such as phenyl, chlorophenyl, nitrophenyl, cyanophenyl and pentafluorophenyl), a heterocyclic group (such as pyridyl, pyrimidyl, pyrazinyl, quinoxalinyl, triazinyl, succineimido, tetrazonyl, triazolyl, imidazolyl and benzooxazolyl), in addition to these, also include those explained in aforesaid X such as a halogen atom, a cyano group, an acyl group, a thioacyl group, an oxalyl group, an oxyoxalyl group, a —S-oxalyl group, an oxamoyl group, an oxycarbonyl group, a —S-carbonyl group, a carbamoyl group, a thiocarbamoyl group, a sulfonyl group, a sulfinyl group, an oxysulfonyl group, a —S-sulfonyl group, a sulfamoyl group, an oxysulfinyl group, a —S-sulfinyl group, a sulfinamoyl group, a phosphoryl group, a nitro group, an imino group, a N-carbonylimino group, N-sulfonylimino group, an ammonium group, a sulfonium group, a phosphonium group, a pyrilium group and an immonium group.

Preferable as $W_{51}$ are also aryl groups and heterocyclic groups as described above, in addition to electron withdrawing groups having a positive Hammett's substituent constant σp, except a formyl group.

$X_{51}$ and $W_{51}$ may form a ring structure by bonding to each other. Rings formed by X and W include a saturated or unsaturated carbon ring or heterocyclic ring, which may be provided with a condensed ring, and also a cyclic ketone. Heterocyclic rings are preferably those having at least one atom among N, O, and S and more preferably those containing one or two of said atoms.

$R_{51}$ includes a hydroxyl group or organic or inorganic salts of the hydroxyl group. Specific examples of alkyl groups, alkenyl groups, alkynyl groups, aryl groups and heterocyclic groups represented by $R_{52}$ include each example of alkyl groups, alkenyl groups, alkynyl groups, aryl groups and heterocyclic groups exemplified as $W_{51}$.

Further, in this invention, any of $X_{51}$, $W_{51}$ and $R_{52}$ may contain a ballast group. A ballast group means a so-called ballast group in such as a photographic coupler, which makes the added compound have a bulky molecular weight not to migrate in a coated film of a light-sensitive material.

Further, in this invention, $X_{51}$, $W_{51}$ and $R_{52}$ may contain a group enhancing adsorption to a silver salt. Groups enhancing adsorption to a silver salt include a thioamido group, an aliphatic mercapto group, an aromatic mercapto group, a heterocyclic mercapto group, and each group represented by 5- or 6-membered nitrogen-containing heterocyclic rings such as benzotriazole, triazole, tetrazole, indazole, benzimidazole, imidazole, benzothiazole, thiazole, benzoxazole, oxazole, thiadiazole, oxadiazole and triazine.

In this invention, it is preferred that at least one of $X_{51}$ and $W_{51}$ represents a cyano group, or $X_{51}$ and $W_{51}$ form a cyclic structure by bonding to each other.

Further, in this invention, preferable are compounds in which a thioether group (—S—) is contained in the substituents represented by $X_{51}$, $W_{51}$ and $R_{52}$.

Further, preferable are those in which at least one of $X_{51}$ and $W_{51}$ is provided with an alkene group.

In this invention, alkene compounds represented by General Formula (CV) include every isomers when they can take isomeric structures with respect to a double bond, where $X_{51}$, $W_{51}$, $R_{51}$ and $R_{52}$ substitute, and also include every isomers when they can take tautomeric structures such as a keto-enol form.

Listed examples of the compounds represented by General Formula (CV) are PR-01 to PR-08 shown in Japanese Translated PCT Patent Publication No. 2000-515995.

Compounds represented by General Formula (CV) of this invention can be synthesized by various methods, and they can be synthesized by referring to, for example, a method described in Japanese Translated PCT Patent Publication No. 2000-515995.

The compound represented by General Formula (CV) is incorporated at least in one of a light-sensitive layer and light-insensitive layers on said light-sensitive layer side, of a thermally developable light-sensitive material, and preferably at least in a light-sensitive layer. The addition amount of compounds represented by General Formula (1) is preferably $1\times10^{-8}$–1 mol/Ag mol, more preferably $1\times10^{-6}$–$1\times10^{-1}$ mol/Ag mol and most preferably $1\times10^{-4}$–$1\times10^{-2}$ mol/Ag mol.

The compound represented by General Formula (CV) can be added in a light-sensitive layer or a light-insensitive layer according to commonly known methods. That is, they can be added in light-sensitive layer or light-insensitive layer coating solution by being dissolved in alcohols such as methanol and ethanol, ketones such as methyl ethyl ketone and acetone, and polar solvents such as dimethylsulfoxide and dimethylformamide. Further, they can be added also by being made into micro-particles of not more than 1 μm followed by being dispersed in water or in an organic solvent. As for microparticle dispersion techniques, many techniques have been disclosed and the compound can be dispersed according to these techniques.

<Silver Ion Reducing Agents>

In the present invention, employed as a silver ion reducing agent (hereinafter occasionally referred simply to as a reducing agent) may be polyphenols described in U.S. Pat. Nos. 3,589,903 and 4,021,249, British Patent No. 1,486,148, JP-A Nos. 51-5193350-36110, 50-116023, and 52-84727, and Japanese Patent Publication No. 51-35727; bisnaphthols such as 2,2'-dihydroxy-1,1'-binaphthyl and 6,6'-dibromo-2,2'-dihydroxy-1,1'-binaphthyl described in U.S. Pat. No. 3,672,904; sulfonamidophenols and sulfonamidonaphthols such as 4-benzenesulfonamidophenol, 2-benznesulfonamidophenol, 2,6-dichloro-4-benenesulfonamidophenol, and 4-benznesulfonamidonaphthol described in U.S. Pat. No. 3,801,321.

In the present invention, preferred reducing agents for silver ions are compounds represented by the following General Formula (RED).

General Formula (RED)

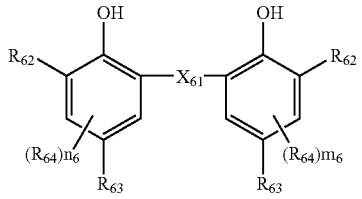

$X_{61}$ in General Formula (RED) represents a chalcogen atom or $CHR_{61}$. Specifically listed as chalcogen atoms are a sulfur atom, a selenium atom, and a tellurium atom. Of these, a sulfur atom is preferred.

$R_{61}$ in $CHR_{61}$ represents a hydrogen atom, a halogen atom, an alkyl group, an alkenyl group, an alkynyl group, an aryl group or a heterocyclic group. Listed as halogen atoms are, for example, a fluorine atom, a chlorine atom, and a bromine atom. Listed as alkyl groups are, alkyl groups having 1–20 carbon atoms, for example, a methyl group, an ethyl group, a propyl group, a butyl group, a hexyl group, a heptyl group and a cycloalkyl group. Examples of alkenyl groups are, a vinyl group, an allyl group, a butenyl group, a hexenyl group, a hexadienyl group, an ethenyl-2-propenyl group, a 3-butenyl group, a 1-methyl-3-propenyl group, a 3-pentenyl group, a 1-methyl-3-butenyl group and a cyclohexenyl group. Examples of aryl groups are, a phenyl group and a naphthyl group. Examples of heterocylic groups are, a thienyl group, a furyl group, an imidazolyl group, a pyrazolyl group and a pyrrolyl group. Of these, cyclic groups such as cycloalkyl groups and cycloalkenyl groups are preferred.

These groups may have a substituent. Listed as said substituents are a halogen atom (for example, a fluorine atom, a chlorine atom, or a bromine atom), a cycloalkyl group (for example, a cyclohexyl group or a cyclobutyl group), a cycloalkenyl group (for example, a 1-cycloalkenyl group or a 2-cycloalkenyl group), an alkoxy group (for example, a methoxy group, an ethoxy group, or a propoxy group), an alkylcarbonyloxy group (for example, an acetyloxy group), an alkylthio group (for example, a methylthio group or a trifluoromethylthio group), a carboxyl group, an alkylcarbonylamino group (for example, an acetylamino group), a ureido group (for example, a methylaminocarbonylamino group), an alkylsulfonylamino group (for example, a methanesulfonylamino group), an alkylsulfonyl group (for example, a methanesulfonyl group and a trifluoromethanesulfonyl group), a carbamoyl group (for example, a carbamoyl group, an N,N-dimethylcarbamoyl group, or an N-morpholinocarbonyl group), a sulfamoyl group (for example, a sulfamoyl group, an N,N-dimethylsulfamoyl group, or a morpholinosulfamoyl group), a trifluoromethyl group, a hydroxyl group, a nitro group, a cyano group, an alkylsulfonamido group (for example, a methanesulfonamido group or a butanesulfonamido group), an alkylamino group (for example, an amino group, an N,N-dimethylamino group, or an N,N-diethylamino group), a sulfo group, a phosphono group, a sulfite group, a sulfino group, an alkylsulfonylaminocarbonyl group (for example, a methanesulfonylaminocarbonyl group or an ethanesulfonylaminocarbonyl group), an alkylcarbonylaminosulfonyl group (for example, an acetamidosulfonyl group or a methoxyacetamidosulfonyl group), an alkynylaminocarbonyl group (for example, an acetamidocarbonyl group or a methoxyacetamidocarbonyl group), and an alkylsulfinylaminocarbonyl group (for example, a methanesulfinylaminocarbonyl group or an ethanesulfinylaminocarbonyl group). Further, when at least two substituents are present, they may be the same or different.

Most preferred substituent is an alkyl group.

$R_{62}$ represents an alkyl group. Preferred as the alkyl groups are those, having 1–20 carbon atoms, which are substituted or unsubstituted. Specific examples include a methyl, ethyl, i-propyl, butyl, i-butyl, t-butyl, t-pentyl, t-octyl, cyclohexyl, 1-methylcyclohexyl, or 1-methylcyclopropyl group.

Substituents of the alkyl group are not particularly limited and include, for example, an aryl group, a hydroxyl group, an alkoxy group, an aryloxy group, an alkylthio group, an arylthio group, an acylamino group, a sulfonamide group, a sulfonyl group, a phosphoryl group, an acyl group, a carbamoyl group, an ester group, and a halogen atom.

$R_{62}$ is preferably a secondary or tertiary alkyl group and preferably has 2–20 carbon atoms. $R_{62}$ is more preferably a tertiary alkyl group, is still more preferably a t-butyl group, a t-pentyl group, or a methylcyclohexyl group, and is most preferably a t-butyl group.

$R_{63}$ represents a hydrogen atom or a group capable of being substituted to a benzene ring. Listed as groups capable of being substituted to a benzene ring are, for example, a halogen atom such as fluorine, chlorine, or bromine, an alkyl group, an aryl group, a cycloalkyl group, an alkenyl group, a cycloalkenyl group, an alkynyl group, an amino group, an acyl group, an acyloxy group, an acylamino group, a sulfonylamino group, a sulfamoyl group, a carbamoyl group, an alkylthio group, a sulfonyl group, an alkylsulfonyl group, a sulfonyl group, a cyano group, and a heterocyclic group.

Preferably listed as $R_{63}$ are methyl, ethyl, i-propyl, t-butyl, cyclohexyl, 1-methylcyclohexyl, and 2-hydroxyethyl. Of these, more preferably listed is 2-hydroxyethyl.

These groups may further have a substituent. Employed as such substituents may be those listed in aforesaid $R_{61}$.

Further, $R_{63}$ is more preferably an alkyl group having 1–10 carbon atoms. Specifically listed is the hydroxyl group disclosed in Japanese Patent Application No. 2002-120842, or an alkyl group, such as a 2-hydroxyethyl group, which has as a substituent a group capable of forming a hydroxyl group while being deblocked. In order to achieve high maximum density (Dmax) at a definite silver coverage, namely to result in silver image density of high covering power (CP), sole use or use in combination with other kinds of reducing agents is preferred.

The most preferred combination of $R_{62}$ and $R_{63}$ is that $R_{62}$ is a tertiary alkyl group (t-butyl, or 1-methylcyclohexyl) and $R_{63}$ is an alkyl group, such as a 2-hydoxyethyl group, which has, as a substituent, a hydroxyl group or a group capable of forming a hydroxyl group while being deblocked. Incidentally, a plurality of $R_{62}$ and $R_{63}$ is may be the same or different.

$R_{64}$ represents a group capable of being substituted to a benzene ring. Listed as specific examples may be an alkyl group having 1–25 carbon atoms (methyl, ethyl, propyl, i-propyl, t-butyl, pentyl, hexyl, or cyclohexyl), a halogenated alkyl group (trifluoromethyl or perfluorooctyl), a cycloalkyl group (cyclohexyl or cyclopentyl); an alkynyl group (propagyl), a glycidyl group, an acrylate group, a methacrylate group, an aryl group (phenyl), a heterocyclic group (pyridyl, thiazolyl, oxazolyl, imidazolyl, furyl, pyrrolyl, pyradinyl, pyrimidyl, pyridadinyl, selenazolyl, piperidinyl, sliforanyl, piperidinyl, pyrazolyl, or tetrazolyl), a halogen atom (chlorine, bromine, iodine or fluorine), an alkoxy group (methoxy, ethoxy, propyloxy, pentyloxy, cyclopentyloxy, hexyloxy, or cyclohexyloxy), an aryloxy group (phenoxy), an alkoxycarbonyl group (methyloxycarbonyl, ethyloxycarbonyl, or butyloxycarbonyl), an aryloxycarbonyl group (phenyloxycarbonyl), a sulfonamido group (methanesulfonamide, ethanesulfonamide, butanesulfonamide, hexanesulfonamide group, cyclohexabesulfonamide, benzenesulfonamide), sulfamoyl group (aminosulfonyl, methyaminosulfonyl, dimethylaminosulfonyl, butylaminosulfonyl, hexylaminosulfonyl, cyclohexylaminosufonyl, phenylaminosulfonyl, or 2-pyridylaminosulfonyl), a urethane group (methylureido, ethylureido, pentylureido, cyclopentylureido, phenylureido, or 2-pyridylureido), an acyl group (acetyl, propionyl, butanoyl, hexanoyl, cyclohexanoyl, benzoyl, or pyridinoyl), a carbamoyl group (aminocarbonyl, methylaminocarbonyl, dimethylaminocarbonyl, propylaminocarbonyl, a pentylaminocarbonyl group, cyclohexylaminocarbonyl, phenylaminocarbonyl, or 2-pyridylaminocarbonyl), an amido group (acetamide, propionamide, butaneamide, hexaneamide, or benzamide), a sulfonyl group (methylsulfonyl, ethylsulfonyl, butylsulfonyl, cyclohexylsulfonyl, phenylsulfonyl, or 2-pyridylsulfonyl), an amino group (amino, ethylamino, dimethylamino, butylamino, cyclopentylamino, anilino, or 2-pyridylamino), a cyano group, a nitro group, a sulfo group, a carboxyl group, a hydroxyl group, and an oxamoyl group. Further, these groups may further be substituted with these groups. Each of n and m represents an integer of 0–2. However, the most preferred case is that both n6 and m6 are 0. A plurality of $R_{64}$s may be the same or different.

The amount of silver ion reducing agents employed in the photothermographic imaging materials of the present invention varies depending on the types of organic silver salts, reducing agents, and other additives. However, the aforesaid amount is customarily 0.05–10 mol per mol of organic silver salts and is preferably 0.1–3 mol. Further, in this amount range, silver ion reducing agents of the present invention may be employed in combinations of at least two types. Namely, in view of achieving images exhibiting excellent storage stability, high image quality, and high CP, it is preferable to simultaneously employ reducing agents which differ in reactivity due to different chemical structure.

In the present invention, preferred cases occasionally occur in which when the aforesaid reducing agents are added to and mixed with a photosensitive emulsion comprised of photosensitive silver halide, organic silver salt particles, and solvents just prior to coating, and then coated, variation of photographic performance during standing time is minimized.

In the photothermographic material of the present invention, it is preferable to use hydrazine compounds or phenol compounds as a developing accelerator in combination with a reducing agent described above. Formulas (1)–(4) shown in JP-A No. 2003-43614 and Formula (1)–(3) in JP-A No. 2003-66559 are preferably used.

A variety of reducing agents disclosed in EP 1278101 and JP-A No. 2003-15252 can also be used as a silver reducing agent of the present invention.

<Chemical Sensitization>

The photosensitive silver halide of the present invention may undergo chemical sensitization. For instance, it is possible to create chemical sensitization centers (being chemical sensitization nuclei) utilizing compounds which release chalcogen such as sulfur, as well as noble metal compounds which release noble metals ions, such as gold ions, while employing methods described in, for example, Japanese Patent Application Nos. 2000-057004 and 2000-061942.

The chemical sensitization nuclei is capable of trapping an electron or a hole produced by a photo-excitation of a sensitizing dye.

It is preferable that the aforesaid silver halide is chemically sensitized employing organic sensitizers containing chalcogen atoms, as described below.

It is preferable that the aforesaid organic sensitizers, comprising chalcogen atoms, have a group capable of being adsorbed onto silver halide grains as well as unstable chalcogen atom positions.

Employed as the aforesaid organic sensitizers may be those having various structures, as disclosed in JP-A Nos. 60-150046, 4-109240, and 11-218874. Of these, the aforesaid organic sensitizer is preferably at least one of compounds having a structure in which the chalcogen atom bonds to a carbon atom, or to a phosphorus atom, via a double bond. More specifically, a thiourea derivative having a heterocylic group and a triphenylphosphine derivative are preferred.

Chemical sensitization methods of the present invention can be applied based on a variety of methods known in the field of wet type silver halide materials. Examples are disclosed in: (1) T. H. James ed., "The Theory of the Photographic Process" $4^{th}$ edition, Macmillan Publishing Co., Ltd. 1977; and (2) Japan Photographic Society, "Shashin Kogaku no Kiso" (Basics of Photographic Engineering), Corona Publishing, 1998.

Specifically, when a silver halide emulsion is chemically sensitized, then mixed with a light-insensitive organic silver salt, the conventionally known chemical sensitizing methods can be applied.

The employed amount of chalcogen compounds as an organic sensitizer varies depending on the types of employed chalcogen compounds, silver halide grains, and reaction environments during performing chemical sensitization, but is preferably from $10^{-8}$ to $10^{-2}$ mol per mol of silver halide, and is more preferably from $10^{-7}$ to $10^{-3}$ mol. The chemical sensitization environments are not particularly limited. However, it is preferable that in the presence of compounds which diminish chalcogenized silver or silver nuclei, or decrease their size, especially in the presence of oxidizing agents capable of oxidizing silver nuclei, chalcogen sensitization is performed employing organic sensitizers, containing chalcogen atoms. The sensitization conditions are that the pAg is preferably from 6 to 11, but is more preferably from 7 to 10, while the pH is preferably from 4 to 10, but is more preferably from 5 to 8. Further, the sensitization is preferably carried out at a temperature of lass than or equal to 30° C.

Further, it is preferable that chemical sensitization, employing the aforesaid organic sensitizers, is carried out in the presence of either spectral sensitizing dyes or compounds containing heteroatoms, which exhibit the adsorption onto silver halide grains. By carrying out chemical sensitization in the presence of compounds which exhibit adsorption onto silver halide grains, it is possible to minimize the dispersion of chemical sensitization center nuclei, whereby it is possible to achieve higher speed as well as lower fogging. Though spectral sensitizing dyes will be described below, the compounds comprising heteroatoms, which result in adsorption onto silver halide grains, as described herein, refer to, as preferable examples, nitrogen containing heterocyclic compounds described in JP-A No. 3-24537. Listed as heterocycles in nitrogen-containing heterocyclic compounds may be a pyrazole ring, a pyrimidine ring, a 1,2,4-triazine ring, a 1,2,3-triazole ring, a 1,3,4-thiazole ring, a 1,2,3-thiazole ring, a 1,2,4-thiadiazole ring, a 1,2,5-thiadiazole ring, 1,2,3,4-tetrazole ring, a pyridazine ring, and a 1,2,3-triazine ring, and a ring which is formed by combining 2 or 3 of the rings such as a triazolotriazole ring, a diazaindene ring, a triazaindene ring, and a pentaazaindenes ring. It is also possible to employ heterocyclic rings such as a phthalazine ring, a benzimidazole ring, an indazole ring and a benzothiazole ring, which are formed by condensing a single heterocyclic ring and an aromatic ring.

Of these, preferred is an azaindene ring. Further, preferred are azaindene compounds having a hydroxyl group, as a substituent, which include compounds such as hydroxytriazaindene, tetrahydroxyazaindene, and hydroxypentaazaindene.

The aforesaid heterocyclic ring may have substituents other than a hydroxyl group. As substituents, the aforesaid heterocyclic ring may have, for example, an alkyl group, a substituted alkyl group, an alkylthio group, an amino group, a hydroxyamino group, an alkylamino group, a dialkylamino group, an arylamino group, a carboxyl group, an alkoxycarbonyl group, a halogen atom, and a cyano group.

The added amount of these heterocyclic compounds varies widely depending on the size and composition of silver halide grains, and other conditions. However, the amount is in the range of about $10^{-6}$ to 1 mol per mol with respect to silver halide, and is preferably in the range of $10^{-4}$ to $10^{-1}$ mol.

The photosensitive silver halide of the present invention may undergo noble metal sensitization utilizing compounds which release noble metal ions such as gold ions. For example, employed as gold sensitizers may be chloroaurates and organic gold compounds disclosed in JP-A No. 11-194447.

Further, other than the aforesaid sensitization methods, it is possible to employ a reduction sensitization method. Employed as specific compounds for the reduction sensitization may be ascorbic acid, thiourea dioxide, stannous chloride, hydrazine derivatives, boron compounds, silane compounds, and polyamine compounds. Further, it is possible to perform reduction sensitization by ripening an emulsion while maintaining a pH higher than or equal to 7 or a pAg less than or equal to 8.3.

Silver halide which undergoes the chemical sensitization, according to the present invention, includes one which has been formed in the presence of organic silver salts, another which has been formed in the absence of organic silver salts, or still another which has been formed by mixing those above.

In the present invention, it is preferable that the surface of photosensitive silver halide grains undergoes chemical sensitization and the resulting chemical sensitizing effects are substantially lost after the thermal development process. "Chemical sensitization effects are substantially lost after the thermal development process", as described herein, means that the speed of the aforesaid imaging material which has been achieved by the aforesaid chemical sensitization techniques decreases to 1.1 times or less compared to the speed of aforesaid material which does not undergo chemical sensitization.

In order to decrease the effect of chemical sensitization after thermal development treatment, it is required to incorporate sufficient amount of an oxidizing agent capable to destroy the center of chemical sensitization by oxidation in an photosensitive emulsion layer or non-photosensitive layer of the imaging material. An example of such compound is a aforementioned compound which release a halogen radical. An amount of incorporated oxidizing agent is preferably adjusted by considering an oxidizing power of the oxidizing agent and the degree of the decrease the effect of chemical sensitization.

<Spectral Sensitization>

It is preferable that photosensitive silver halide in the present invention is adsorbed by spectral sensitizing dyes so as to result in spectral sensitization. Employed as spectral sensitizing dyes may be cyanine dyes, merocyanine dyes, complex cyanine dyes, complex merocyanine dyes, homopolar cyanine dyes, styryl dyes, hemicyanine dyes, oxonol dyes, and hemioxonol dyes. For example, employed may be sensitizing dyes described in JP-A Nos. 63-159841, 60-140335, 63-231437, 63-259651, 63-304242, and 63-15245, and U.S. Pat. Nos. 4,639,414, 4,740,455, 4,741,966, 4,751,175, and 4,835,096.

Useful sensitizing dyes, employed in the present invention, are described in, for example, Research Disclosure, Item 17645, Section IV-A (page 23, December 1978) and Item 18431, Section X (page 437, August 1978) and publications further cited therein. It is specifically preferable that those sensitizing dyes are used which exhibit spectral sensitivity suitable for spectral characteristics of light sources of various types of laser imagers, as well as of scanners. For example, preferably employed are compounds described in JP-A Nos. 9-34078, 9-54409, and 9-80679.

Useful cyanine dyes include, for example, cyanine dyes having basic nuclei such as a thiazoline nucleus, an oxazoline nucleus, a pyrroline nucleus, a pyridine nucleus, an oxazole nucleus, a thiazole nucleus, a selenazole nucleus, and an imidazole nucleus. Useful merocyanine dyes, which are preferred, comprise, in addition to the basic nuclei, acidic nuclei such as a thiohydantoin nucleus, a rhodanine nucleus, an oxazolizinedione nucleus, a thiazolinedione nucleus, a barbituric acid nucleus, a thiazolinone nucleus, a maronitryl nucleus, and a pyrazolone nucleus.

In the present invention, it is possible to employ sensitizing dyes which exhibit spectral sensitivity, specifically in the infrared region. Listed as preferably employed infrared spectral sensitizing dyes are infrared spectral sensitizing dyes disclosed in U.S. Pat. Nos. 4,536,473, 4,515,888, and 4,959,294.

It is possible to easily synthesize the aforesaid infrared sensitizing dyes, employing the method described in F. M. Harmer, "The Chemistry of Heterocyclic Compounds, Volume 18, The Cyanine Dyes and Related Compounds (A. Weissberger ed., published by Interscience, New York, 1964).

These infrared sensitizing dyes may be added at any time after preparing the silver halide. For example, the dyes may be added to solvents, or the dyes, in a so-called solid dispersion state in which the dyes are dispersed into minute particles, may be added to a photosensitive emulsion comprising silver halide grains or silver halide grains/aliphatic carboxylic acid silver salts. Further, in the same manner as the aforesaid heteroatoms containing compounds which exhibit adsorption onto silver halide grains, the dyes are adsorbed onto silver halide grains prior to chemical sensitization, and subsequently, undergo chemical sensitization, whereby it is possible to minimize the dispersion of chemical sensitization center nuclei so at to enhance speed, as well as to decrease fogging. In the present invention, the aforesaid spectral sensitizing dyes may be employed individually or in combination. Combinations of sensitizing dyes are frequently employed when specifically aiming for supersensitization, for expanding or adjusting a spectral sensitization range.

An emulsion comprising photosensitive silver halide as well as aliphatic carboxylic acid silver salts, which are employed in the silver salt photothermographic dry imaging material of the present invention, may comprise sensitizing dyes together with compounds which are dyes having no spectral sensitization or have substantially no absorption of visible light and exhibit supersensitization, whereby the aforesaid silver halide grains may be supersensitized.

Useful combinations of sensitizing dyes and dyes exhibiting supersensitization, as well as materials exhibiting supersensitization, are described in Research Disclosure Item 17643 (published December 1978), page 23, Section J of IV; Japanese Patent Publication Nos. 9-25500 and 43-4933; and JP-A Nos. 59-19032, 59-192242, and 5-431432. Preferred as supersensitizers are hetero-aromatic mercapto compounds or mercapto derivatives.

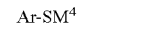

$Ar\text{-}SM^4$ wherein $M^4$ represents a hydrogen atom or an alkali metal atom, and Ar represents an aromatic ring or a condensed aromatic ring, having at least one of a nitrogen, sulfur, oxygen, selenium, or tellurium atom. Hetero-aromatic rings are preferably benzimidazole, naphthoimidazole, benzimidazole, naphthothiazole, benzoxazole, naphthooxazole, benzoselenazole, benztellurazole, imidazole, oxazole, pyrazole, triazole, triazine, pyrimidine, pyridazine, pyrazine, pyridine, purine, quinoline, or quinazoline. On the other hand, other hetero-aromatic rings are also included.

Incidentally, mercapto derivatives, when incorporated in the dispersion of aliphatic carboxylic acid silver salts and/or a silver halide grain emulsion, are also included which substantially prepare the mercapto compounds. Specifically, listed as preferred examples are the mercapto derivatives described below.

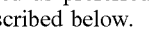

Ar-S—S-Ar wherein Ar is the same as the mercapto compounds defined above.

The aforesaid hetero-aromatic rings may have a substituent selected from the group consisting of, for example, a halogen atom (for example, Cl, Br, and I), a hydroxyl group, an amino group, a carboxyl group, an alkyl group (for example, an alkyl group having at least one carbon atom and preferably having from 1 to 4 carbon atoms), and an alkoxy group (for example, an alkoxy group having at least one carbon atom and preferably having from 1 to 4 carbon atoms).

Other than the aforesaid supersensitizers, employed as supersensitizers may be compounds represented by General Formula (5), shown below, which is disclosed in JP-A No. 2001-330918 and large ring compounds containing a hetero atom.

The amount of a supersensitizer of the present invention used in a photosensitive layer containing an organic silver salt and silver halide grains and in the present invention is in the range of 0.001 to 1.0 mol per mol of Ag. More preferably, it is 0.01 to 0.5 mol per mol of Ag.

In the present invention, it is preferable that the surface of photosensitive silver halide grains undergoes chemical sensitization and the resulting chemical sensitizing effects are substantially lost after the thermal development process. "Chemical sensitization effects are substantially lost after the thermal development process", as described herein, means that the speed of the aforesaid imaging material which has been achieved by the aforesaid chemical sensitization techniques decreases to 1.1 times or less compared to the speed of aforesaid material which does not undergo chemical sensitization.

In order to decrease the effect of chemical sensitization after thermal development treatment, it is required to incorporate sufficient amount of an oxidizing agent capable to destroy the center of chemical sensitization by oxidation in an photosensitive emulsion layer or non-photosensitive layer of the imaging material. An example of such compound is a aforementioned compound which release a halogen radical. An amount of incorporated oxidizing agent is preferably adjusted by considering an oxidizing power of the oxidizing agent and the degree of the decrease the effect of chemical sensitization.

<Silver Saving Agent>

In the present invention, either a photosensitive layer or a light-insensitive layer may comprise silver saving agents.

The silver saving agents, used in the present invention, refer to compounds capable of reducing the silver amount to obtain a definite silver image density. Even though various mechanisms may be considered to explain functions regarding a decrease in the silver amount, compounds having functions to enhance covering power of developed silver are preferable. The covering power of developed silver, as described herein, refers to optical density per unit amount of silver. These silver saving agents may be incorporated in either a photosensitive layer or a light-insensitive layer or in both such layers.

Listed as preferred examples of silver saving agents are hydrazine derivatives represented by General Formula (H) described below, vinyl compounds represented by General Formula (G) described below, and quaternary onium compounds represented by General Formula (P) described below.

General Formula (H)

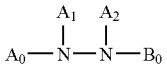

General Formula (G)

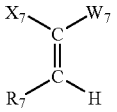

General Formula (P)

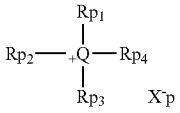

In General Formula (H), $A_0$ represents an aliphatic group, an aromatic group, a heterocyclic group, or a $-G_0-D_0$ group, each of which may have a substituent; $B_0$ represents a blocking group; and $A_1$ and $A_2$ each represents a hydrogen atom, or one represents a hydrogen atom and the other represents an acyl group, a sulfonyl group, or a oxalyl group. Herein, $G_0$ represents a —CO— group, a —COCO— group, a —CS— group, a $—C(=NG_1D_1)-$ group, a —SO— group, a $—SO_2—$ group, or a $—P(O)(G_1D_1)-$ group, wherein $G_1$ represents a simple bonding atom or a group such as an —O— group, a —S— group, or an $—N(D_1)-$ group, wherein $D_1$ represents an aliphatic group, an aromatic group, a heterocyclic group, or a hydrogen atom; when there is a plurality of $D_1$ in the molecule, those may be the same or different; and $D_0$ represents a hydrogen atom, an aliphatic group, an aromatic group, a heterocyclic group, an amino group, an alkoxy group, an aryloxy group, an alkylthio group, or an arylthio group. Listed as preferred $D_0$ are a hydrogen atom, an alkyl group, an alkoxy group, and an amino group.

In General Formula (H), the aliphatic group represented by $A_0$ is preferably a straight chain, branched, or cyclic alkyl group having from 1 to 30 carbon atoms and more preferably from 1 to 20 carbon atoms. Listed as the alkyl groups are, for example, a methyl group, an ethyl group, a t-butyl group, an octyl group, a cyclohexyl group, and a benzyl group. The groups may be substituted with a suitable substituent (for example, an aryl group, an alkoxy group, an aryloxy group, an alkylthio group, an arylthio group, a sulfoxyl group, a sulfonamido group, a sulfamoyl group, an acylamino group, and a ureido group).

In General Formula (H), the aromatic group represented by $A_0$ is preferably a single ring or fused ring aryl group. Listed as examples are a benzene ring or a naphthalene ring. Preferably listed as heterocyclic groups represented by $A_0$ are those containing at least one heteroatom selected from nitrogen, sulfur and oxygen atoms. Listed as examples are a pyrrolidine ring, an imidazole ring, a tetrahydrofuran ring, a morpholine ring, a pyridine ring, a pyrimidine ring, a quinoline ring, a thiazole ring, a benzothiazole ring, a thiophene ring, and a furan ring. The aromatic ring, heterocyclic group, and $-G_0-D_0$ group may each have a substituent. Particularly preferred as $A_0$ are an aryl group and a $-G_0-D_0-$ group.

Further, in General Formula (H), $A_0$ preferably contains at least one of non-diffusive groups or silver halide adsorbing groups. Preferred as the non-diffusive groups are ballast groups which are commonly employed for immobilized photographic additives such as couplers. Listed as ballast groups are an alkyl group, an alkenyl group, an alkynyl group, an alkoxy group, a phenyl group, a phenoxy group, and an alkylphenoxy group, which are photographically inactive. The total number of carbon atoms of the portion of the substituent is preferably at least 8.

In General Formula (H), listed as silver halide adsorption enhancing groups are thiourea, a thiourethane group, a mercapto group, a thioether group, a thione group, a heterocyclic group, a thioamido heterocyclic group, a mercapto heterocyclic group, or the adsorption group described in JP-A No. 64-90439.

In General Formula (H), $B_0$ represents a blocking group, and preferably represents $-G_0-D_0$ group, wherein $G_0$ represents a —CO— group, a —COCO— group, a —CS— group, a $—C(=NG_1D_1)-$ group, an —SO— group, an $—SO_2—$ group, or a $—P(O)(G_1D_1)$ group. Listed as preferred $G_0$ are a —CO— group and a —COCO— group. $G_1$ represents a simple bonding atom or group such as an —O— atom, an —S— atom or an $—N(D_1)-$ group, wherein $D_1$ represents an aliphatic group, an aromatic group, a heterocyclic group, or a hydrogen atom, and when there is a plurality of $D_1$ in a molecule, they may be the same or different. $D_0$ represents a hydrogen atom, an aliphatic group, an aromatic group, a heterocyclic group, an amino group, an alkoxy group, an aryloxy group, an alkylthio group, and an arylthio group. Listed as preferred $D_0$ are a hydrogen atom, an alkyl group, an alkoxy group, or an amino group. $A_1$ and $A_2$ each represents a hydrogen atom, or when one represents a hydrogen atom, the other represents an acyl group (such as an acetyl group, a trifluoroacetyl group, and a benzoyl group), a sulfonyl group (such as a methanesulfonyl group and a toluenesulfonyl group), or an oxalyl group (such as an ethoxalyl group).

The compounds represented by General Formula (H) can be easily synthesized employing methods known in the art. They can be synthesized based on, for example, U.S. Pat. Nos. 5,464,738 and 5,496,695.

Other than those, preferably usable hydrazine derivatives include Compounds H-1 through H-29 described in columns 11 through 20 of U.S. Pat. No. 5,545,505, and Compounds 1 through 12 in columns 9 through 11 of U.S. Pat. No. 5,464,738. The hydrazine derivatives can be synthesized employing methods known in the art.

In General Formula (G), $X_7$ as well as $R_7$ are illustrated utilizing a cis form, while $X_7$ and $R_7$ include a trans form. This is applied to the structure illustration of specific compounds.

In General Formula (G), $X_7$ represents an electron attractive group, while $W_7$ represents a hydrogen atom, an alkyl group, an alkenyl group, an alkynyl group, an aryl group, a heterocyclic group, a halogen atom, an acyl group, a thioacyl group, an oxalyl group, an oxyoxalyl group, a thioxyalyl group, an oxamoyl group, an oxycarbonyl group, a thiocarbonyl group, a carbamoyl group, a thiocarbamoyl group, a sulfonyl group, a sulfinyl group, an oxysulfinyl group, a thiosulfinyl group, a sulfamoyl group, an oxysulfinyl group, a thiosulfinyl group, a sulfamoyl group, a phosphoryl group, a nitro group, an imino group, an N-carbonylimino group, an N-sulfonylimino group, a dicyanoethylene group, an ammonium group, a sulfonium group, a phosphonium group, a pyrylium group, and an immonium group.

$R_7$ represents a halogen atom, a hydroxyl group, an alkoxy group, an aryloxy group, a heterocyclic oxy group, an alkenyloxy group, an acyloxy group, an alkoxycarbonyloxy group, an aminocarbonyloxy group, a mercapto group, an alkylthio group, an arylthio group, a heterocyclic thio group, an alkenylthio group, an acylthio group, an alkoxycarbonylthio group, an aminocarbonylthio group, a hydroxyl group, an organic or inorganic salt (for example, a sodium salt, a potassium salt, and a silver salt) of a mercapto group, an amino group, an alkylamino group, a cyclic amino group (for example, a pyrrolidino group), an acylamino group, an oxycarbonylamino group, a heterocyclic group (a nitrogen-containing 5- or 6-membered heterocyclic ring such as a benztriazolyl group, an imidazolyl group, a triazolyl group, and a tetrazolyl group), a ureido group, and a sulfonamido group. X and W may be joined together to form a ring structure, while X and R may also be joined together in the same manner. Listed as rings which are formed by X and W are, for example, pyrazolone, pyrazolidinone, cyclopentanedione, β-ketolactone, β-ketolactum.

General Formula (G) will be described further. The electron attractive group represented by $X_7$ refers to the substituent of which substituent constant σp is able to take a positive value. Specifically, included are a substituted alkyl group (such as a halogen-substituted alkyl group), a substituted alkenyl group (such as a cyanovinyl group), a substituted or unsubstituted alkynyl group (such as a trifluoromethylacetylenyl group and a cyanoacetylenyl group), a substituted aryl group (such as a cyanophenyl group), a substituted or unsubstituted heterocyclic group (such as a pyridyl group, a triazinyl group, or a benzoxazolyl group), a halogen atom, a cyano group, an acyl group (such as an acetyl group, a trifluoroacetyl group, and a formyl group), a thioacetyl group (such as a thioacetyl group and a thioformyl group), an oxalyl group (such as a methyloxalyl group), an oxyoxalyl group (such as an ethoxyoxalyl group), a thiooxyalyl group (such as an ethylthiooxyalyl group), an oxamoyl group (such as a methyloxamoyl group), an oxycarbonyl group (such as an ethoxycarbonyl group), a carboxyl group, a thiocarbonyl group (such as an ethylthiocarbonyl group), a carbamoyl group, a thiocarbamoyl group, a sulfonyl group, a sulfinyl group, an oxysulfonyl group (such as an ethoxysulfonyl group), a thiosulfonyl group (such as an ethylthiosulfonyl group), a sulfamoyl group, an oxysulfinyl group (such as a methoxysulfinyl group), a thiosulfinyl group (such as a methylthiosulfinyl group), a sulfinamoyl group, a phosphoryl group, a nitro group, an imino group, an N-carbonylimino group (such as an N-acetylimino group), an N-sulfonylimino group (such as an N-methanesulfonylimino group), a dicyanoethylene group, an ammonium group, a sulfonium group, a phosphonium group, a pyrylium group, and an immonium group. However, also included are heterocyclic rings which are formed employing an ammonium group, a sulfonium group, a phosphonium group, or an immonium group. Substituents having a σp value of at least 0.30 are particularly preferred.

Alkyl groups represented by $W_7$ include a methyl group, an ethyl group, and a trifluoromethyl group; alkenyl groups represented by W include a vinyl group, a halogen-substituted vinyl group, and a cyanovinyl group; aryl groups represented by W include a nitrophenol group, a cyanophenyl group, and a pentafluorophenyl group; heterocyclic groups represented by W include a pyridyl group, a triazinyl group, a succinimido group, a tetrazolyl group, an imidazolyl group, and a benzoxyazolyl group. Preferred as W are electron attractive groups having a positive σp value, and more preferred are those having a σp value of at least 0.30.

Of the aforesaid substituents of $R_7$, preferably listed are a hydroxyl group, a mercapto group, an alkoxy group, an alkylthio group, a halogen atom, an organic or inorganic salt of a hydroxyl group or a mercapto group, and a heterocyclic group, and of these, more preferably listed are a hydroxyl group, and an organic or inorganic salt of a hydroxyl group or a mercapto group.

Further, of the aforesaid substituents of $X_7$ and $W_7$, preferred are those having an thioether bond in the substituent.

In General Formula (P), $Q_{p3}$ represents a nitrogen atom or a phosphorus atom; $R_{p1}$, $R_{p2}$, $R_{p3}$, and $R_{p4}$ each represents a hydrogen atom or a substituents; and $X_p^-$ represents an anion. Incidentally, $R_{p1}$ through $R_{p4}$ may be joined together to form a ring.

Listed as substituents represented by $R_{p1}$ through $R_{p4}$ are an alkyl group (such as a methyl group, an ethyl group, a propyl group, a butyl group, a hexyl group, and a cyclohexyl group), an alkenyl group (such as an allyl group and a butenyl group), an alkynyl group (such as a propargyl group and a butynyl group), an aryl group (such as a phenyl group and a naphthyl group), a heterocyclic group (such as a piperidinyl group, a piperazinyl group, a morpholinyl group, a pyridyl group, a furyl group, a thienyl group, a tetrahydrofuryl group, a tetrahydrothienyl group, and a sulforanyl group), and an amino group.

Listed as rings which are formed by joining $R_{p1}$ through $R_{p4}$ are a piperidine ring, a morpholine ring, a piperazine ring, quinuclidine ring, a pyridine ring, a pyrrole ring, an imidazole ring, a triazole ring, and a tetrazole ring.

Groups represented by $R_{p1}$ through $R_{p4}$ may have a substituent such as a hydroxyl group, an alkoxy group, an aryloxy group, a carboxyl group, a sulfo group, an alkyl group, and an aryl group. $R_{p1}$, $R_{p2}$, $R_{p3}$, and $R_{p4}$ each is preferably a hydrogen atom or an alkyl group.

Listed as anions represented by $X_p^-$ are inorganic or organic anions such as a halogen ion, a sulfate ion, a nitrate ion, an acetate ion, and a p-toluenesulfonate ion.

The aforesaid quaternary onium compounds can easily be synthesized employing methods known in the art. For instance, the aforesaid tetrazolium compounds can be synthesized based on the method described in Chemical Reviews Vol. 55. pages 335 through 483. The added amount of the aforesaid silver saving agents is commonly from $10^{-5}$ to 1 mol with respect to mol of aliphatic carboxylic acid silver salts, and is preferably from $10^{-4}$ to $5\times10^{-1}$ mol.

In the present invention, it is preferable that at least one of silver saving agents is a silane compound.

The silane compounds employed as a silver saving agent in present invention are preferably alkoxysilane compounds having at least two primary or secondary amino groups or salts thereof, as described in Japanese Patent Application No. 2003-5324.

When alkoxysilane compounds or salts thereof or Schiff bases are incorporated in the image forming layer as a silver saving agent, the added amount of these compound is preferably in the range of 0.00001 to 0.05 mol per mol of silver. Further, both of alkoxysilane compounds or salt thereof and Schiff bases are added, the added amount is in the same range as above.

<Tone Controlling Agent>

The tone of images obtained by thermal development of the imaging material is described.

It has been pointed out that in regard to the output image tone for medical diagnosis, cold image tone tends to result in more accurate diagnostic observation of radiographs. The cold image tone, as described herein, refers to pure black tone or blue black tone in which black images are tinted to blue. On the other hand, warm image tone refers to warm black tone in which black images are tinted to brown. The tone is more described below based on an expression defined by a method recommended by the Commission Internationale de l'Eclairage (CIE) in order to define more quantitatively.

"Colder tone" as well as "warmer tone", which is terminology of image tone, is expressed, employing minimum density $D_{min}$ and hue angle $h_{ab}$ at an optical density D of 1.0. The hue angle $h_{ab}$ is obtained by the following formula, utilizing color specifications a* and b* of L*a*b* Color Space which is a color space perceptively having approximately a uniform rate, recommended by Commission Internationale de l'Eclairage (CIE) in 1976.

$$h_{ab}=\tan^{-1}(b^*/a^*)$$

In the present invention, $h_{ab}$ is preferably in the range of 180 degrees<$h_{ab}$<270 degrees, is more preferably in the range of 200 degrees<$h_{ab}$<270 degrees, and is most preferably in the range of 220 degrees<$h_{ab}$<260 degrees.

This finding is also disclosed in JP-A 2002-6463.

Incidentally, as described, for example, in JP-A No. 2000-29164, it is conventionally known that diagnostic images with visually preferred color tone are obtained by adjusting, to the specified values, u* and v* or a* and b* in CIE 1976 (L*u*v*) color space or (L*a*b*) color space near an optical density of 1.0.

Diligent investigation was performed for the silver salt photothermographic imaging material according to the present invention. As a result, it was discovered that when a linear regression line was formed on a graph in which in the CIE 1976 (L*u*v*) color space or the (L*a*b*) color space, u* or a* was used as the abscissa and v* or b* was used as the ordinate, the aforesaid materiel exhibited diagnostic properties which were equal to or better than conventional wet type silver salt photosensitive materials by regulating the resulting linear regression line to the specified range. The condition ranges of the present invention will now be described.

(1) The coefficient of determination value $R^2$ of the linear regression line is 0.998–1.000, which is formed in such a manner that each of optical density of 0.5, 1.0, and 1.5 and the minimum optical density of the aforesaid imaging material is measured, and u* and v* in terms of each of the above optical densities are arranged in two-dimensional coordinates in which u* is used as the abscissa of the CIE 1976 (L*u*v*) color space, while v* is used as the ordinate of the same.

The value v* of the intersection point of the aforesaid linear regression line with the ordinate is −5–+5; and the gradient (v*/u*) is 0.7–2.5.

(2) The coefficient of determination value $R^2$ of the linear regression line is 0.998–1.000, which is formed in such a manner that each of optical density of 0.5, 1.0, and 1.5 and the minimum optical density of the aforesaid imaging material is measured, and a* and b* in terms of each of the above optical densities are arranged in two-dimensional coordinates in which a* is used as the abscissa of the CIE 1976 (L*a*b*) color space, while b* is used as the ordinate of the same.

In addition, value b* of the intersection point of the aforesaid linear regression line with the ordinate is −5–+5, while gradient (b*/a*) is 0.7–2.5.

A method for making the above-mentioned linear regression line, namely one example of a method for determining u* and v* as well as a* and b* in the CIE 1976 color space, will now be described.

By employing a thermal development apparatus, a 4-step wedge sample including an unexposed portion and optical densities of 0.5, 1.0, and 1.5 is prepared. Each of the wedge density portions prepared as above is determined employing a spectral chronometer (for example, CM-3600d, manufactured by Minolta Co., Ltd.) and either u* and v* or a* and b* are calculated. Measurement conditions are such that an F7 light source is used as a light source, the visual field angle is 10 degrees, and the transmission measurement mode is used. Subsequently, either measured u* and v* or measured a* and b* are plotted on the graph in which u* or a* is used as the abscissa, while v* or b* is used as the ordinate, and a linear regression line is formed, whereby the coefficient of determination value $R^2$ as well as intersection points and gradients are determined.

The specific method enabling to obtain a linear regression line having the above-described characteristics will be described below.

In the present invention, by regulating the added amount of the aforesaid toning agents, developing agents, silver halide grains, and aliphatic carboxylic acid silver, which are directly or indirectly involved in the development reaction process, it is possible to optimize the shape of developed silver so as to result in the desired tone. For example, when the developed silver is shaped to dendrite, the resulting image tends to be bluish, while when shaped to filament, the resulting imager tends to be yellowish. Namely, it is possible to adjust the image tone taking into account the properties of shape of developed silver.

Usually, toning agents such as phthalazinones or a combinations of phthalazine with phthalic acids, or phthalic anhydride are employed.

Examples of suitable image toning agents are disclosed in Research-Disclosure, Item 17029, and U.S. Pat. Nos. 4,123,282, 3,994,732, 3,846,136, and 4,021,249.

Other than such toners, it is preferable to control color tone employing couplers disclosed in JP-A No. 11-288057 and EP 1134611A2 as well as leuco dyes detailed below.

Further, it is possible to unexpectedly minimize variation of tone during storage of silver images by simultaneously employing silver halide grains which are converted into an internal latent image-forming type after the thermal development according to the present invention.

<Leuco Dyes>

Leuco dyes are employed in the silver salt photothermographic dry imaging materials of the present invention.

Employed as leuco dyes may be any of the colorless or slightly tinted compounds which are oxidized to form a colored state when heated at temperatures of about 80–about 200° C. for about 0.5–about 30 seconds. It is possible to use any of the leuco dyes which are oxidized by silver ions to form dyes. Compounds are useful which are sensitive to pH and oxidizable to a colored state.

Representative leuco dyes suitable for the use in the present invention are not particularly limited. Examples include biphenol leuco dyes, phenol leuco dyes, indoaniline leuco dyes, acrylated azine leuco dyes, phenoxazine leuco dyes, phenodiazine leuco dyes, and phenothiazine leuco dyes. Further, other useful leuco dyes are those disclosed in U.S. Pat. Nos. 3,445,234, 3,846,136, 3,994,732, 4,021,249, 4,021,250, 4,022,617, 4,123,282, 4,368,247, and 4,461,681, as well as JP-A Nos. 50-36110, 59-206831, 5-204087, 11-231460, 2002-169249, and 2002-236334.

In order to control images to specified color tones, it is preferable that various color leuco dyes are employed individually or in combinations of a plurality of types. In the present invention, for minimizing excessive yellowish color tone due to the use of highly active reducing agents, as well as excessive reddish images especially at a density of at least 2.0 due to the use of minute silver halide grains, it is preferable to employ leuco dyes which change to cyan. Further, in order to achieve precise adjustment of color tone, it is further preferable to simultaneously use yellow leuco dyes as well as other leuco dyes which change to cyan.

It is preferable to appropriately control the density of the resulting color while taking into account the relationship with the color tone of developed silver itself. In the present invention, color formation is performed so that the sum of maximum densities at the maximum adsorption wavelengths of dye images formed by leuco dyes is customarily 0.01–0.30, is preferably 0.02–0.20, and is most preferably 0.02–0.10. Further, it is preferable that images be controlled within the preferred color tone range described below.

(Yellow Forming Leuco byes)

In the present invention, particularly preferably employed as yellow forming leuco dyes are color image forming agents represented by following General Formula (YL) which increase absorbance between 360 and 450 nm via oxidation.

General Formula (YL)

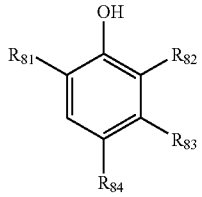

In aforesaid General Formula (YL), preferably as the alkyl groups represented by $R_{81}$ are those having 1–30 carbon atoms, which may have a substituent. Specifically preferred is methyl, ethyl, butyl, octyl, i-propyl, t-butyl, t-octyl, t-pentyl, sec-butyl, cyclohexyl, or 1-methyl-cyclohexyl. Groups (i-propyl, i-nonyl, t-butyl, t-amyl, t-octyl, cyclohexyl, 1-methyl-cyclohexyl or adamantyl) which are three-dimensionally larger than i-propyl are preferred. Of these, preferred are secondary or tertiary alkyl groups and t-butyl, t-octyl, and t-pentyl, which are tertiary alkyl groups, are particularly preferred. Listed as substituents which $R_{81}$ may have are a halogen atom, an aryl group, an alkoxy group, an amino group, an acyl group, an acylamino group, an alkylthio group, an arylthio group, a sulfonamide group, an acyloxy group, an oxycarbonyl group, a carbamoyl group, a sulfamoyl group, a sulfonyl group, and a phosphoryl group.

$R_{82}$ represents a hydrogen atom, a substituted or unsubstituted alkyl group, or an acylamino group. The alkyl group represented by $R_{82}$ is preferably one having 1–30 carbon atoms, while the acylamino group is preferably one having 1–30 carbon atoms. Of these, description for the alkyl group is the same as for aforesaid $R_{81}$.

The acylamino group represented by $R_{82}$ may be unsubstituted or have a substituent. Specifically listed are an acetylamino group, an alkoxyacetylamino group, and an aryloxyacetylamino group. $R_2$ is preferably a hydrogen atom or an unsubstituted group having 1–24 carbon atoms, and specifically listed are methyl, i-propyl, and t-butyl. Further, neither $R_{81}$ nor $R_{82}$ is a 2-hydroxyphenylmethyl group.

$R_{83}$ represents a hydrogen atom, and a substituted or unsubstituted alkyl group. Preferred as alkyl groups are those having 1–30 carbon atoms. Description for the above alkyl groups is the same as for $R_{81}$. Preferred as $R_{83}$ are a hydrogen atom and an unsubstituted alkyl group having 1–24 carbon atoms, and specifically listed are methyl, i-propyl and t-butyl. It is preferable that either $R_{81}$ or $R_{83}$ represents a hydrogen atom.

$R_{84}$ represents a group capable of being substituted to a benzene ring, and represents the same group which is described for substituent $R_{84}$, for example, in aforesaid General Formula (RED). $R_4$ is preferably a substituted or unsubstituted alkyl group having 1–30 carbon atoms, as well as an oxycarbonyl group having 2–30 carbon atoms. The alkyl group having 1–24 carbon atoms is more preferred. Listed as substituents of the alkyl group are an aryl group, an amino group, an alkoxy group, an oxycarbonyl group, an acylamino group, an acyloxy group, an imide group, and a ureido group. Of these, more preferred are an aryl group, an amino group, an oxycarbonyl group, and an alkoxy group. The substituent of these alkyl group may be substituted with any of the above alkyl groups.

Among the compounds represented by General Formula (YL), preferred compounds are bis-phenol compounds represented by the following General Formula.

General Formula (YL')

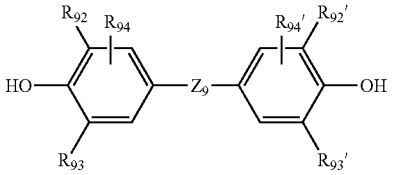

wherein, $Z_9$ represents a —S— or —C($R_{91}$)($R_{91'}$)— group. $R_{91}$ and $R_{91'}$ each represent a hydrogen atom or a substituent. The substituents represented by $R_{91}$ and $R_{91'}$ are the same substituents listed for $R_{61}$ in the aforementioned General Formula (RED). $R_{91}$ and $R_{91'}$ are preferably a hydrogen atom or an alkyl group.

$R_{92}$, $R_{93}$, $R_{92'}$ and $R_{93'}$ each represent a substituent. The substituents represented by $R_{92}$, $R_{93}$, $R_{92'}$ and $R_{93}$' are the same substituents listed for $R_{62}$ and $R_{63}$ in the aforementioned General Formula (RED).

$R_{92}$, $R_{93}$, $R_{92'}$ and $R_{93'}$ are preferably, an alkyl group, an alkenyl group, an alkynyl group, an aryl group, a heterocyclic group, and more preferably, an alkyl group. Substituents on the alkyl group are the same substituents listed for the substituents in the aforementioned General Formula (RED).

$R_{92}$, $R_{93}$, $R_{92'}$ and $R_{93'}$ are more preferably tertiary alkyl groups such as t-butyl, t-amino, t-octyl and 1-methyl-cyclohexyl.

$R_{94}$ and $R_{94'}$ each represent a hydrogen atom or a substituent, and the substituents are the same substituents listed for $R_{64}$ in the aforementioned General Formula (RED).

Examples of the bis-phenol compounds represented by General Formula (YL) are, the compounds disclosed in JP-A No. 2002-169249, Compounds (II-1) to (II-40), paragraph Nos. [0032]-[0038]; and EP 1211093, Compounds (ITS-1) to (ITS-12), paragraph No. [0026].

An amount of an incorporated compound represented by General Formula (YL) is; usually, 0.00001 to 0.01 mol, and preferably, 0.0005 to 0.01 mol, and more preferably, 0.001 to 0.008 mol per mol of Ag.

(Cyan Forming Leuco Dyes)

Cyan forming leuco dyes will now be described. In the present invention, particularly preferably employed as cyan forming leuco dyes are color image forming agents which increase absorbance between 600 and 700 nm via oxidation, and include the compounds described in JP-A No. 59-206831 (particularly, compounds of λmax in the range of 600–700 nm), compounds represented by General Formulas (I)–(IV) of JP-A No. 5-204087 (specifically, compounds (1)–(18) described in paragraphs ⌈0032⌋–⌈0037⌋), and compounds represented by General Formulas 4–7 (specifically, compound Nos. 1–79 described in paragraph ⌈0105⌋) of JP-A No. 11-231460.

Cyan forming leuco dyes which are particularly preferably employed in the present invention are represented by following General Formula (CL).

General Formula (CL)

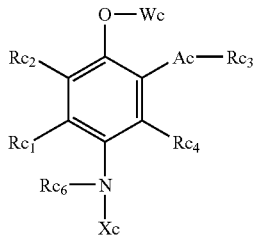

wherein $R_{c1}$ and $R_{c2}$ each represent a hydrogen atom, a substituted or unsubstituted alkyl group, an NHCO—$R_{c10}$ group wherein $R_{c10}$ is an alkyl group, an aryl group, or a heterocyclic group, while $R_{c1}$ and $R_{c2}$ may bond to each other to form an aliphatic hydrocarbon ring, an aromatic hydrocarbon ring, or a heterocyclic ring; $A_c$ represents a —NHCO— group, a —CONH— group, or a —NHCONH— group; $R_{c3}$ represents a substituted or unsubstituted alkyl group, an aryl group, or a heterocyclic group, or -$A_c$-$R_{c3}$ is a hydrogen atom; $W_c$ represents a hydrogen atom or a —CONH$R_{c5}$— group, —CO$R_{c5}$ or a —CO—O—$R_{c5}$ group wherein $R_{c5}$ represents a substituted or unsubstituted alkyl group, an aryl group, or a heterocyclic group; $R_{c4}$ represents a hydrogen atom, a halogen atom, a substituted or unsubstituted alkyl group, an alkoxy group, a carbamoyl group, or a nitrile group; $R_{c6}$ represents a —CONH—$R_{c7}$ group, a —CO—$R_{c7}$ group, or a —CO—O—$R_{c7}$ group wherein $R_{c7}$ is a substituted or unsubstituted alkyl group, an aryl group, or a heterocyclic group; and $X_c$ represents a substituted or unsubstituted aryl group or a heterocyclic group.

In General Formula (CL), halogen atoms include fluorine, bromine, and chlorine; alkyl groups include those having at most 20 carbon atoms (methyl, ethyl, butyl, or dodecyl); alkenyl groups include those having at most 20 carbon atoms (vinyl, allyl, butenyl, hexenyl, hexadienyl, ethenyl-2-propenyl, 3-butenyl, 1-methyl-3-propenyl, 3-pentenyl, or 1-methyl-3-butenyl); alkoxy groups include those having at most 20 carbon atoms (methoxy or ethoxy); aryl groups include those having 6–20 carbon atoms such as a phenyl group, a naphthyl group, or a thienyl group; heterocyclic groups include each of thiophene, furan, imidazole, pyrazole, and pyrrole groups. $A_c$ represents a —NHCO— group, a —CONH— group, or a —NHCONH— group; $R_{c3}$ represents a substituted or unsubstituted alkyl group (preferably having at most 20 carbon atoms such as methyl, ethyl, butyl, or dodecyl), an aryl group (preferably having 6 –20 carbon atoms, such as phenyl, naphthyl, or thienyl), or a heterocyclic group (thiophene, furan, imidazole, pyrazole, or pyrrole); -$A_c$-$R_{c3}$ is a hydrogen atom; $W_c$ represents a hydrogen atom or a —CONH$R_{c5}$ group, a —CO—$R_{c5}$ group or a —CO—O$R_{c5}$ group wherein $R_{c5}$ represents a substituted or unsubstituted alkyl group (preferably having at most 20 carbon atoms, such as methyl, ethyl, butyl, or dodecyl), an aryl group (preferably having 6–20 carbon atoms, such as phenyl, naphthyl, or thienyl), or a heterocyclic group (such as thiophene, furan, imidazole, pyrazole, or pyrrole); $R_4$ is preferably a hydrogen atom, a halogen atom (e.g., fluorine, chlorine, bromine, iodine), a chain or cyclic alkyl group (e.g., a methyl group, a butyl group, a dodecyl group, or a cyclohexyl group), an alkoxy group (e.g., a methoxy group, a butoxy group, or a tetradecyloxy group), a carbamoyl group (e.g., a diethylcarbamoyl group or a phenylcarbamoyl group), and a nitrile group and of these, a hydrogen atom and an alkyl group are more preferred. Aforesaid $R_{c1}$ and $R_{c2}$, and $R_{c3}$ and $R_{c4}$ bond to each other to form a ring structure. The aforesaid groups may have a single substituent or a plurality of substituents. For example, typical substituents which may be introduced into aryl groups include a halogen atom (fluorine, chlorine, or bromine), an alkyl group (methyl, ethyl, propyl, butyl, or dodecyl), a hydroxyl group, a cyan group, a nitro group, an alkoxy group (methoxy or ethoxy), an alkylsulfonamide group (methylsulfonamido or octylsulfonamido), an arylsulfonamide group (phenylsulfonamido or naphthylsulfonamido), an alkylsulfamoyl group (butylsulfamoyl), an arylsulfamoyl group (phenylsulfamoyl), an alkyloxycarbonyl group (methoxycarbonyl), an aryloxycarbonyl group (phenyloxycarbonyl), an aminosulfonamide group, an acylamino group, a carbamoyl group, a sulfonyl group, a sulfinyl group, a sulfoxy group, a sulfo group, an aryloxy group, an alkoxy group, an alkylcarbonyl group, an arylcarbonyl group, or an aminocarbonyl group. It is possible to introduce two different groups of these groups into an aryl group. Either $R_{c10}$ or $R_{c5}$ is preferably a phenyl group, and is more preferably a phenyl group having a plurality of substituents containing a halogen atom or a cyano group.

$R_{c6}$ is a —CONH—$R_{c7}$ group, a —CO—$R_{c7}$ group, or —CO—O—$R_{c7}$ group, wherein $R_{c7}$ is a substituted or unsubstituted alkyl group (preferably having at most 20 carbon atoms, such as methyl, ethyl, butyl, or dodecyl), an aryl group (preferably having 6–20 carbon atoms, such as phenyl, naphthol, or thienyl), or a heterocyclic group (thiophene, furan, imidazole, pyrazole, or pyrrole). Employed as substituents of the alkyl group represented by $R_{c7}$ may be the same ones as substituents in $R_{c1}$–$R_{c4}$. $X_c$ represents a substituted or unsubstituted aryl group or a heterocyclic group. These aryl groups include groups having 6–20 carbon atoms such as phenyl, naphthyl, or thienyl, while the heterocyclic groups include any of the groups such as thiophene, furan, imidazole, pyrazole, or pyrrole. Employed as substituents which may be substituted to the group represented by $X_c$ may be the same ones as the substituents in $R_{c1}$–$R_{c4}$. As the groups represented by $X_c$, preferred are an aryl group, which is substituted with an alkylamino group (a diethylamino group) at the para position, or a heterocyclic group. These may contain other photographically useful groups.

The added amount of cyan forming leuco dyes is customarily 0.00001–0.05 mol/mol of Ag, is preferably 0.0005–0.02 mol/mol, and is more preferably 0.001–0.01 mol.

The compounds represented by General Formula (YL) and cyan forming leuco dyes may be added employing the same method as for the reducing agents represented by General Formula (RED). They may be incorporated in liquid coating compositions employing an optional method to result in a solution form, an emulsified dispersion form, or a minute solid particle dispersion form, and then incorporated in a photosensitive material.

It is preferable to incorporate the compounds represented by General Formula (YL) and cyan forming leuco dyes into an image forming layer containing organic silver salts. On the other hand, the former may be incorporated in the image forming layer, while the latter may be incorporated in a non-image forming layer adjacent to the aforesaid image forming layer. Alternatively, both may be incorporated in the non-image forming layer. Further, when the image forming layer is comprised of a plurality of layers, incorporation may be performed for each of the layers.

<Coating Auxiliaries and Others>

In the present invention, in order to minimize image abrasion caused by handling prior to development as well as after thermal development, matting agents are preferably incorporated in the surface layer (on the photosensitive layer side, and also on the other side when the light-insensitive layer is provided on the opposite side across the support). The added amount is preferably from 0.1 to 30.0 percent by weight with respect to the binders.

Matting agents may be comprised of organic or inorganic materials. Employed as inorganic materials for the matting agents may be, for example, silica described in Swiss Patent No. 330,158, glass powder described in French Patent No. 1,296,995, and carbonates of alkali earth metals or cadmium and zinc described in British Patent No. 1,173,181. Employed as organic materials for the matting agents are starch described in U.S. Pat. No. 2,322,037, starch derivatives described in Belgian Patent No. 625,451 and British Patent No. 981,198, polyvinyl alcohol described in Japanese Patent Publication No. 44–3643, polystyrene or polymethacrylate described in Swiss Patent No. 330,158, acrylonitrile described in U.S. Pat. No. 3,079,257, and polycarbonate described in U.S. Pat. No. 3,022,169.

The average particle diameter of the matting agents is preferably from 0.5 to 10.0 μm, and is more preferably from 1.0 to 8.0 μm. Further, the variation coefficient of the particle size distribution of the same is preferably less than or equal to 50 percent, is more preferably less than or equal to 40 percent, and is most preferably from less than or equal to 30 percent.

Herein, the variation coefficient of the particle size distribution refers to the value expressed by the formula described below.

((Standard deviation of particle diameter)/(particle diameter average))×100

Addition methods of the matting agent according to the present invention may include one in which the matting agent is previously dispersed in a coating composition and the resultant dispersion is applied onto a support, and the other in which after applying a coating composition onto a support, a matting agent is sprayed onto the resultant coating prior to completion of drying. Further, when a plurality of matting agents is employed, both methods may be used in combination.

<Fluorine Based Surface Active Agents>

It is preferable to employ the fluorine based surface active agents represented by following General Formulas (SA-1)–(SA-3) in the imaging materials according to the present invention.

$(Rf\text{-}L_f)_{pf}\text{-}Y_f\text{-}(A)_{qf}$ General Formula (SA-1)

$LiO_3S—(CF_2)_{nf}—SO_3Li$ General Formula (SA-2)

$MO_3S—(CF_2)_{nf}—SO_3M_f$ General Formula (SA-3)

wherein $M_f$ represents a hydrogen atom, a sodium atom, a potassium atom, and an ammonium group; nf represents a positive integer, while in the case in which $M_f$ represents H, nf represents an integer of 1–6 and 8, and in the case in which $M_f$ represents an ammonium group, nf represents an integer of 1–8.

In aforesaid General Formula (SA-1), Rf represents a substituent containing a fluorine atom. Listed as fluorine atom-containing substituents are, for example, an alkyl group having 1–25 carbon atoms (such as a methyl group, an ethyl group, a butyl group, an octyl group, a dodecyl group, or an octadecyl group), and an alkenyl group (such as a propenyl group, a butenyl group, a nonenyl group or a dodecenyl group).

$L_f$ represents a divalent linking group having no fluorine atom. Listed as divalent linking groups having no fluorine atom are, for example, an alkylene group (e.g., a methylene group, an ethylene group, and a butylene group), an alkyleneoxy group (such as a methyleneoxy group, an ethyleneoxy group, or a butyleneoxy group), an oxyalkylene group (e.g., an oxymethylene group, an oxyethylene group, and an oxybutylene group), an oxyalkyleneoxy group (e.g., an oxymethyleneoxy group, an oxyethyleneoxy group, and an oxyethyleneoxyethyleneoxy group), a phenylene group, and an oxyphenylene group, a phenyloxy group, and an oxyphenyloxy group, or a group formed by combining these groups.

$A_f$ represents an anion group or a salt group thereof. Examples include a carboxylic acid group or salt groups thereof (sodium salts, potassium salts and lithium salts), a sulfonic acid group or salt groups thereof (sodium salts, potassium salts and lithium salts), and a phosphoric acid group and salt groups thereof (sodium salts, potassium salts and lithium salts).

$Y_f$ represents a trivalent or tetravalent linking group having no fluorine atom. Examples include trivalent or tetravalent linking groups having no fluorine atom, which are groups of atoms comprised of a nitrogen atom as the center. P represents an integer from 1 to 3, while q represents an integer of 2 or 3.

The fluorine based surface active agents represented by General Formula (SA-1) are prepared as follows. Alkyl compounds having 1–25 carbon atoms into which fluorine atoms are introduced (e.g., compounds having a trifluoromethyl group, a pentafluoroethyl group, a perfluorobutyl group, a perfluorooctyl group, or a perfluorooctadecyl group) and alkenyl compounds (e.g., a perfluorohexenyl group or a perfluorononenyl group) undergo addition reaction or condensation reaction with each of the trivalent-hexavalent alknaol compounds into which fluorine atom(s) are not introduced, aromatic compounds having 3–4 hydroxyl groups or hetero compounds. Anion group ($A_f$) is further introduced into the resulting compounds (including alknaol compounds which have been partially subjected to introduction of Rf) employing, for example, sulfuric acid esterification.

Listed as the aforesaid trivalent-hexavalent alkanol compounds are glycerin, pentaerythritol, 2-methyl-2-hydroxymethyl-1,3-propanediol, 2,4-dihydroxy-3-hydroxymethylpentane, 1,2,6-hexanrtriol. 1,1,1-tris(hydroxymethyl)propane, 2,2-bis(butanol), aliphatic triol, tetramethylolmethane, D-sorbitol, xylitol, and D-mannitol.

Listed as the aforesaid aromatic compounds, having 3–4 hydroxyl groups and hetero compounds, are 1,3,5-trihydroxybenzene and 2,4,6-trihydroxypyridine.

In General Formula (SA-2), nf represents an integer of 1–4.

In General Formula (SA-3), $M_f$ represents a hydrogen atom, a potassium atom, or an ammonium group and nf represents a positive integer. In the case in which $M_f$ represents H, nf represents an integer from 1 to 6 or 8; in the case in which $M_f$ represents Na, nf represents 4; in the case in which $M_f$ represents K, nf represents an integer from 1 to 6; and in the case in which $M_f$ represents an ammonium group, nf represents an integer from 1 to 8.

It is possible to add the fluorine based surface active agents represented by General Formulas (SA-1)–(SA-3) to liquid coating compositions, employing any conventional addition methods known in the art. Namely, they are dissolved in solvents such as alcohols including methanol or ethanol, ketones such as methyl ethyl ketone or acetone, and polar solvents such as dimethylformamide, and then added. Further, they may be dispersed into water or organic solvents in the form of minute particles at a maximum size of 1 μm, employing a sand mill, a jet mill, or an ultrasonic homogenizer and then added. Many techniques are disclosed for minute particle dispersion, and it is possible to perform dispersion based on any of these. It is preferable that the aforesaid fluorine based surface active agents are added to the protective layer which is the outermost layer.

The added amount of the aforesaid fluorine based surface active agents is preferably $1\times10^{-8}$–$1\times10^{-1}$ mol per $m^2$. When the added amount is less than the lower limit, it is not possible to achieve desired charging characteristics, while it exceeds the upper limit, storage stability degrades due to an increase in humidity dependence.

Incidentally, surface active agents represented by General Formulas (SA-1), (SA-2), and (SA-3) are disclosed in JP-A No. 2003-57786, and Japanese Patent Application Nos. 2002-178386 and 2003-237982.

Listed as materials of the support employed in the silver salt photothermographic dry imaging material of the present invention are various kinds of polymers, glass, wool fabric, cotton fabric, paper, and metal (for example, aluminum). From the viewpoint of handling as information recording materials, flexible materials, which can be employed as a sheet or can be wound in a roll, are suitable. Accordingly, preferred as supports in the silver salt photothermographic dry imaging material of the present invention are plastic films (for example, cellulose acetate film, polyester film, polyethylene terephthalate film, polyethylene naphthalate film, polyamide film, polyimide film, cellulose triacetate film or polycarbonate film). Of these, in the present invention, biaxially stretched polyethylene terephthalate film is particularly preferred. The thickness of the supports is commonly from about 50 to about 300 μm, and is preferably from 70 to 180 μm.

In the present invention, in order to minimize static-charge buildup, electrically conductive compounds such as metal oxides and/or electrically conductive polymers may be incorporated in composition layers. The compounds may be incorporated in any layer, but are preferably incorporated in a subbing layer, a backing layer, and an interlayer between the photosensitive layer and the subbing layer. In the present invention, preferably employed are electrically conductive compounds described in columns 14 through 20 of U.S. Pat. No. 5,244,773.

The silver salt photothermographic dry imaging material of the present invention comprises a support having thereon at least one photosensitive layer. The photosensitive layer may only be formed on the support. However, it is preferable that at least one light-insensitive layer is formed on the photosensitive layer. For example, it is preferable that for the purpose of protecting a photosensitive layer, a protective layer is formed on the photosensitive layer, and in order to minimize adhesion between photosensitive materials as well as adhesion in a wound roll, a backing layer is provided on the opposite side of the support. As binders employed in the protective layer as well as the backing layer, polymers such as cellulose acetate, cellulose acetate butyrate, which has a higher glass transition point from the thermal development layer and exhibit abrasion resistance as well as distortion resistance are selected from the aforesaid binders. Incidentally, for the purpose of increasing latitude, one of the preferred embodiments of the present invention is that at least two photosensitive layers are provided on the one side of the support or at least one photosensitive layer is provided on both sides of the support.

In the silver salt photothermographic dry imaging material of the present invention, in order to control the light amount as well as the wavelength distribution of light which transmits the photosensitive layer, it is preferable that a filter layer is formed on the photosensitive layer side or on the opposite side, or dyes or pigments are incorporated in the photosensitive layer.

Employed as dyes may be compounds, known in the art, which absorb various wavelength regions according to the spectral sensitivity of photosensitive materials.

For example, when the silver salt photothermographic dry imaging material of the present invention is used as an image recording material utilizing infrared radiation, it is preferable to employ squarylium dyes having a thiopyrylium nucleus (hereinafter referred to as thiopyriliumsquarylium dyes) and squarylium dyes having a pyrylium nucleus (hereinafter referred to as pyryliumsquarylium dyes), as described in JP-A No. 2001-83655, and thiopyryliumcroconium dyes or pyryliumcroconium dyes which are analogous to the squarylium dyes.

Incidentally, the compounds having a squarylium nucleus, as described herein, refers to ones having 1-cyclobutene-2-hydroxy-4-one in their molecular structure. Herein, the hydroxyl group may be dissociated. Hereinafter, all of these dyes are referred to as squarylium dyes.

Incidentally, preferably employed as the dyes are compounds described in JP-A No. 8-201959.

<Layer Structures and Coating Conditions>

It is preferable to prepare the silver salt photothermographic dry imaging material of the present invention as follows. Materials of each constitution layer as above are dissolved or dispersed in solvents to prepare coating compositions. Resultant coating compositions are subjected to simultaneous multilayer coating and subsequently, the resultant coating is subjected to a thermal treatment. "Simultaneous multilayer coating", as described herein, refers to the following. The coating composition of each constitution layer (for example, a photosensitive layer and a protective layer) is prepared. When the resultant coating compositions are applied onto a support, the coating compositions are not applied onto a support in such a manner that they are individually applied and subsequently dried, and the operation is repeated, but are simultaneously applied onto a support and subsequently dried. Namely, before the residual amount of the total solvents of the lower layer reaches 70 percent by weight, the upper layer is applied.

Simultaneous multilayer coating methods, which are applied to each constitution layer, are not particularly limited. For example, are employed methods, known in the art, such as a bar coater method, a curtain coating method, a dipping method, an air knife method, a hopper coating method, and an extrusion method. Of these, more preferred is the pre-weighing type coating system called an extrusion coating method. The aforesaid extrusion coating method is suitable for accurate coating as well as organic solvent coating because volatilization on a slide surface, which occurs in a slide coating system, does not occur. Coating methods have been described for coating layers on the photosensitive layer side. However, the backing layer and the subbing layer are applied onto a support in the same manner as above.

In the present invention, silver coverage is preferably from 0.5 to 2.0 g/m$^2$, and is more preferably from 1.0 to 1.5 g/m$^2$.

Further, in the present invention, it is preferable that in the silver halide grain emulsion, the content ratio of silver halide grains, having a grain diameter of 0.030 to 0.055 μm in term of the silver weight, is from 3 to 15 percent in the range of a silver coverage of 0.5 to 1.5 g/m$^2$.

The ratio of the silver coverage which is resulted from silver halide is preferably from 2 to 18 percent with respect to the total silver, and is more preferably from 3 to 15 percent.

Further, in the present invention, the number of coated silver halide grains, having a grain diameter (being a sphere equivalent grain diameter) of at least 0.01 μm, is preferably from $1\times10^{14}$ to $1\times10^{18}$ grains/m$^2$, and is more preferably from $1\times10^{15}$ to $1\times10^{17}$.

Further, the coated weight of aliphatic carboxylic acid silver salts of the present invention is from $10^{-17}$ to $10^{-15}$ g per silver halide grain having a diameter (being a sphere equivalent grain diameter) of at least 0.01 μm, and is more preferably from $10^{-16}$ to $10^{-14}$ g.

When coating is carried out under conditions within the aforesaid range, from the viewpoint of maximum optical silver image density per definite silver coverage, namely covering power as well as silver image tone, desired results are obtained.

(Re-Drying)

The silver salt photothermographic dry imaging materials prepared according to the present invention are composed of a support having thereon photosensitive layers and non-photosensitive layers, and are characterized in that the compounds employed in the aforesaid photosensitive layers or non-photosensitive layers are sufficiently dried to a powder state.

Drying methods generally include:

1. countercurrent drying, 2. radiation, 3. indirect heat conductive drying, 4. fluidized-bed drying, 5. heated steam drying, 6. microwave drying, and 7. vacuum drying. In the present invention, any of the above drying methods may be accepted. However, fluidized-bed drying is preferred since the dryer dimensions are reduced in such a manner that the powder to be dried is subjected to rotation in a fluidized-bed, resulting in ease of installation of such dryer in the manufacturing process and time load to the production process is small due to the fact that in one operation, it is possible to apply heat re-drying treatments to a large amount of powder. Further, examples of heating dryers include a conveyer type, a flat type, a shelf type, and a drum rotating type. In the present invention, preferred is a rotating drum type drier which is a common fluidized-bed drying, however, the present invention is not limited thereto.

In order to heat-dry the above compounds, the methods listed below are applicable:

(1) A method in which, during synthesis of compounds, heated drying is achieved.

(2) Drying is initiated not successively following the synthesis of compounds, but at least one time, heated drying (hereinafter referred to as heated re-drying) is performed between the time immediately after the synthesis of the above compound and the time just prior to preparation of a liquid coating composition.

Further, in the present invention, temperature during heated re-drying is preferably between about 60 to about 130° C. The maximum temperature is a maximum image development temperature, but is more preferably at a maximum of the glass transition temperature of the above compound. Further, it is more preferable that heated re-drying is performed at 100° C. or higher since unpleasant odor causing volatile substances are vaporized via heating while induced by water evaporation in the above compound.

Further, in the present invention, excessively short drying time may result in insufficient drying, while excessively long drying time results in delay of the production process to decrease production efficiency. Accordingly, it is desired to shorten the drying time at the highest heating temperature possible in the above heating temperature range. It is essential to set the heating time so that production efficiency is not decreased. The heating time is preferably 30 seconds–30 minutes, but is more preferably 30 second–10 minutes.

In the present invention, since it is possible to use commercially available compounds as the above compounds, (2) heated re-drying is more preferred as a drying method of the compounds of the present invention.

Further, since the above compounds, after heated re-drying, tend to undesirably adsorb water vapor and other compounds from atmosphere, it is preferable that the above compounds are stored in a sealed vessel at a relative humidity of 30 percent or less after heated re-drying, and are added within 24 hours. But it is more preferable that they are added to a liquid coating composition immediately after heated re-drying.

When the above compounds are heat re-dried, the compounds and a plurality of additives may be heat re-dried individually or simultaneously in combinations of them.

The compounds of the present invention, which are subjected to powder drying, include organic, inorganic, and crystalline compounds (inorganic, organic, and mica). Preferred examples include natural polymers, synthetic resins as well as polymers and copolymers, and film-forming media such as gelatin, gum Arabic, poly(vinyl alcohol), hydroxyethyl cellulose, cellulose acetate, cellulose acetate butyrate, poly(vinylpyrrolidone), casein, starch, poly(acrylic acid), poly(methylmethacrylic acid), poly(vinyl chloride), poly(methacrylic acid), copoly(styrene-maleic anhydride), copoly(styrene-acrylonitrile), copoly(styrene-butadiene), poly(vinyl acetal)s (for example, poly(vinyl formal), and poly(vinyl butyral)), poly(ester)s, poly(urethane)s, phenoxy resins, poly(vinylidene chloride), poly(epoxide)s, poly(carbonate)s, poly(vinyl acetate)s, cellulose esters, and poly(amide)s. More preferred are polyvinyl acetate polymers. The above binders may be employed in combinations of at least two types.

<Exposure Conditions>

When the silver salt photothermographic dry imaging material of the present invention is exposed, it is preferable to employ an optimal light source for the spectral sensitivity provided to the aforesaid photosensitive material. For example, when the aforesaid photosensitive material is sensitive to infrared radiation, it is possible to use any radiation source which emits radiation in the infrared region. However, infrared semiconductor lasers (at 780 nm and 820 nm) are preferably employed due to their high power, as well as ability to make photosensitive materials transparent.

In the present invention, it is preferable that exposure is carried out utilizing laser scanning. Employed as the exposure methods are various ones. For example, listed as a firstly preferable method is the method utilizing a laser scanning exposure apparatus in which the angle between the scanning surface of a photosensitive material and the scanning laser beam does not substantially become vertical.

"Does not substantially become vertical", as described herein, means that during laser scanning, the nearest vertical angle is preferably from 55 to 88 degrees, is more preferably from 60 to 86 degrees, and is most preferably from 70 to 82 degrees.

When the laser beam scans photosensitive materials, the beam spot diameter on the exposed surface of the photosensitive material is preferably at most 200 μm, and is more preferably at most 100 mm, and is more preferably at most 100 μm. It is preferable to decrease the spot diameter due to the fact that it is possible to decrease the deviated angle from the verticality of laser beam incident angle. Incidentally, the lower limit of the laser beam spot diameter is 10 μm. By performing the laser beam scanning exposure, it is possible to minimize degradation of image quality according to reflection light such as generation of unevenness analogous to interference fringes.

Further, as the second method, exposure in the present invention is also preferably carried out employing a laser scanning exposure apparatus which generates a scanning laser beam in a longitudinal multiple mode, which minimizes degradation of image quality such as generation of unevenness analogous to interference fringes, compared to the scanning laser beam in a longitudinal single mode.

The longitudinal multiple mode is achieved utilizing methods in which return light due to integrated wave is employed, or high frequency superposition is applied. The longitudinal multiple mode, as described herein, means that the wavelength of radiation employed for exposure is not single. The wavelength distribution of the radiation is commonly at least 5 nm, and is preferably at least 10 nm. The upper limit of the wavelength of the radiation is not particularly limited, but is commonly about 60 nm.

Incidentally, in the recording methods of the aforesaid first and second embodiments, it is possible to suitably select any of the following lasers employed for scanning exposure, which are generally well known, while matching the use. The aforesaid lasers include solid lasers such as a ruby laser, a YAG laser, and a glass laser; gas lasers such as a HeNe laser, an Ar ion laser, a Kr ion laser, a $CO_2$ laser a CO laser, a HeCd laser, an $N_2$ laser, and an excimer laser; semiconductor lasers such as an InGaP laser, an AlGaAs laser, a GaASP laser, an InGaAs laser, an InAsP laser, a $CdSnP_2$ laser, and a GaSb laser; chemical lasers; and dye lasers. Of these, from the viewpoint of maintenance as well as the size of light sources, it is preferable to employ any of the semiconductor lasers having a wavelength of 600 to 1,200 nm.

The beam spot diameter of lasers employed in laser imagers, as well as laser image setters, is commonly in the range of 5 to 75 μm in terms of a short axis diameter and in the range of 5 to 100 μm in terms of a long axis diameter. Further, it is possible to set a laser beam scanning rate at the optimal value for each photosensitive material depending on the inherent speed of the silver salt photothermographic dry imaging material at laser transmitting wavelength and the laser power.

<Development Conditions>

In the present invention, development conditions vary depending on employed devices and apparatuses, or means. Typically, an imagewise exposed silver salt photothermographic dry imaging material is heated at optimal high temperature. It is possible to develop a latent image formed by exposure by heating the material at relatively high temperature (for example, from about 100 to about 200° C.) for a sufficient period (commonly from about 1 second to about 2 minutes). When heating temperature is less than or equal to 100° C., it is difficult to obtain sufficient image density within a relatively short period. On the other hand, at more than or equal to 200° C., binders melt so as to be transferred to rollers, and adverse effects result not only for images but also for transportability as well as processing devices. Upon heating the material, silver images are formed through an oxidation-reduction reaction between aliphatic carboxylic acid silver salts (which function as an oxidizing agent) and reducing agents. This reaction proceeds without any supply of processing solutions such as water from the exterior.

Heating may be carried out employing typical heating means such as hot plates, irons, hot rollers and heat generators employing carbon and white titanium. When the protective layer-provided silver salt photothermographic dry imaging material of the present invention is heated, from the viewpoint of uniform heating, heating efficiency, and workability, it is preferable that heating is carried out while the surface of the side provided with the protective layer comes into contact with a heating means, and thermal development is carried out during the transport of the material while the surface comes into contact with the heating rollers.

EXAMPLES

The present invention will now be detailed with reference to examples. However, the present invention is not limited to these examples. Without specific indication, "%" in the following examples indicates "weight %".

Example 1

<<Preparation of Subbed Photographic Supports>>

A photographic support comprised of a 175 μm thick biaxially oriented polyethylene terephthalate film with blue tinted at an optical density of 0.170 (determined by Densitometer PDA-65, manufactured by Konica Corp.), which had been subjected to corona discharge treatment of 8 W·minute/$m^2$ on both sides, was subjected to subbing. Namely, subbing liquid coating composition a-1 was applied onto one side of the above photographic support at 22° C. and 100 m/minute to result in a dried layer thickness of 0.2 μm and dried at 140° C., whereby a subbing layer on the image forming layer side (designated as Subbing Layer A-1) was formed. Further, subbing liquid coating composition b-1 described below was applied, as a backing layer subbing layer, onto the opposite side at 22° C. and 100 m/minute to result in a dried layer thickness of 0.12 μm and dried at 140° C. An electrically conductive subbing layer (designated as Subbing Lower Layer B-1), which exhibited an antistatic function, was applied onto the backing layer side. The surface of Subbing Lower Layer A-1 and Subbing Lower Layer B-1 was subjected to corona discharge treatment of 8 W·minute/$m^2$ Subsequently, subbing liquid coating composition a-2 was applied onto Subbing Lower Layer A-1 was applied at 33° C. and 100 m/minute to result in a dried layer thickness of 0.03 μm and dried at 140° C. The resulting layer was designated as Subbing Upper Layer A-2. Subbing liquid coating composition b-2 described below was applied onto Subbing Lower Layer B-1 at 33° C. and 100 m/minute to results in a dried layer thickness of 0.2 μm and dried at 140° C. The resulting layer was designated as Subbing Upper Layer B-2. Thereafter, the resulting support was subjected to heat treatment at 123° C. for two minutes and wound up under the conditions of 25° C. and 50 percent relative humidity, whereby a subbed sample was prepared.

(Preparation of Water-Based Polyester A-1)

A mixture consisting of 35.4 parts by weight of dimethyl terephthalate, 33.63 parts by weight of dimethyl isophthalate, 17.92 parts by weight of sodium salt of dimethyl 5-sulfoisophthalate, 62 parts by weight of ethylene glycol, 0.065 part by weight of calcium acetate monohydrate, and 0.022 part by weight of manganese acetate tetrahydrate underwent transesterification at 170–220° C. under a flow of nitrogen while distilling out methanol. Thereafter, 0.04 part by weight of trimethyl phosphate, 0.04 part by weight of antimony trioxide, and 6.8 parts by weight of 4-cyclohexanedicarboxylic acid were added. The resulting mixture underwent esterification at a reaction temperature of 220–235° C. while distilling out a nearly theoretical amount of water.

Thereafter, the reaction system was subjected to pressure reduction and heating over a period of one hour and was subjected to polycondensation at a final temperature of 280° C. and a maximum pressure of 133 Pa for one hour, whereby Water-soluble Polyester A-1 was synthesized. The intrinsic viscosity of the resulting Water-soluble Polyester A-1 was 0.33, the average particle diameters was 40 nm, and Mw was 80,000–100,000.

Subsequently, 850 ml of pure water was placed in a 2-liter three-necked flask fitted with stirring blades, a refluxing cooling pipe, and a thermometer, and while rotating the stirring blades, 150 g of Water-soluble Polyester A-1 was gradually added. The resulting mixture was stirred at room temperature for 30 minutes without any modification. Thereafter, the interior temperature was raised to 98° C. over a period of 1.5 hours and at that resulting temperature, dissolution was performed. Thereafter, the temperature was lowered to room temperature over a period of one hour and the resulting product was allow to stand overnight, whereby Water-based Polyester A-1 Solution was prepared.

(Preparation of Modified Water-based Polyester B-1 and B-2 Solutions)

Placed in a 3-liter four-necked flask fitted with stirring blades, a reflux cooling pipe, a thermometer, and a dripping funnel was 1,900 ml of the aforesaid 15 percent by weight Water-based Polyester A-1 Solution, and the interior temperature was raised to 80° C., while rotating the stirring blades. Into this added was 6.52 ml of a 24 percent aqueous ammonium peroxide solution, and a monomer mixed liquid composition (consisting of 28.5 g of glycidyl methacrylate, 21.4 g of ethyl acrylate, and 21.4 g of methyl methacrylate) was dripped over a period of 30 minutes, and reaction was allowed for an additional 3 hours. Thereafter, the resulting product was cooled to at most 30° C., and filtrated, whereby Modified Water-based Polyesters B-1 Solution (vinyl based component modification ratio of 20 percent by weight) at a solid concentration of 18 percent by weight was obtained.

Modified Water-based Polyester B-2 at a solid concentration of 18 percent by weight (a vinyl based component modification ratio of 20 percent by weight) was prepared in the same manner as above except that the vinyl modification ratio was changed to 36 percent by weight and the modified component was changed to styrene:glycidyl methacrylate: acetacetoxyethyl methacrylate:n-butyl acrylate=39.5:40:20: 0.5.

(Preparation of Acryl Based Polymer Latexes C-1–C-3)

Acryl Based Polymer Latexes C-1–C-3 having the monomer compositions shown in the following table were synthesized employing emulsion polymerization. All the solid concentrations were adjusted to 30 percent by weight.

TABLE 2

| Latex No. | Monomer Composition (weight ratio) | Tg (° C.) |
|---|---|---|
| C-1 | styrene:glycidyl methacrylate:n-butyl acrylate = 20:40:40 | 20 |
| C-2 | styrene:n-butyl acrylate:t-butyl acrylate:hydroxyethyl methacrylate = 27:10:35:28 | 55 |
| C-3 | styrene:glycidyl methacrylate:acetacetoxyethyl methacrylate = 40:40:20 | 50 |

<<Water Based Polymers Containing Polyvinyl Alcohol Units>>

D-1: PVA-617 (Water Dispersion (5 percent solids): degree of saponification of 95, manufactured by Kuraray Co., Ltd.)

(Subbing Lower Layer Liquid Coating Composition a-1 on Image Forming Layer Side)

| | |
|---|---|
| Acryl Based Polymer Latex C-3 (30 percent solids) | 70.0 g |
| Water dispersion of ethoxylated alcohol and ethylene homopolymer (10 percent solids) | 5.0 g |
| Surface Active Agent (A) | 0.1 g |

A coating liquid composition was prepared by adding water to make 1,000 ml.

<<Image Forming Layer Side Subbing Upper Layer Liquid Coating Composition a-2>>

| | |
|---|---|
| Modified Water-based Polyester B-2 (18 percent by weight) | 30.0 g |
| Surface Active Agent (A) | 0.1 g |
| Spherical silica matting agent (Sea Hoster KE-P50, manufactured by Nippon Shokubai Co., Ltd.) | 0.04 g |

A liquid coating composition was prepared by adding water to make 1,000 ml.

(Backing Layer Side Subbing Lower Layer Liquid Coating Composition b-1)

| | |
|---|---|
| Acryl Based Polymer Late C-1 (30 percent solids) | 30.0 g |
| Acryl Based Polymer Late C-2 (30 percent solids) | 7.6 g |
| $SnO_2$ sol (the solid concentration of $SnO_2$ sol synthesized employing the method described in Example 1 of Japanese Patent Publication 35-6616 was heated and concentrated to reach a solid concentration of 10 percent by weight, and subsequently, the pH was adjusted to 10 by the addition of ammonia water) | 180 g |
| Surface Active Agent (A) | 0.5 g |
| 5 percent by weight of PVA-613 (PVA, manufactured by Kuraray Co., Ltd.) | 0.4 g |

A liquid coating composition was prepared by adding water to make 1,000 ml.

(Backing Layer Side Subbing Upper Layer Liquid Coatings Composition b-2)

| | |
|---|---|
| Modified Water-based Polyester B-1 (18 percent by weight) | 145.0 g |
| Spherical silica matting agent (Sea Hoster KE-P50, manufactured by Nippon Shokubai Co., Ltd.) | 0.2 g |
| Surface Active Agent (A) | 0.1 g |

A liquid coating composition was prepared by adding water to make 1,000 ml.

Incidentally, the back coat layer and the back coat layer protective layer, composed as described below, were applied onto Sublayer A-2 of the support coated with the aforesaid sublayer.

<Re-Drying of Back Coat Layer Compounds>

Cellulose acetate propionate was charged into "Small Type Drum Rotation System Drier", produced by Kuroda Industry Co., Ltd. and heat re-dried at the temperature and for the duration listed in the table.

<Preparation of Back Coat Layer Liquid Coating Composition>

While stirring, added to 830 g of methyl ethyl ketone (MEK) were 84.2 g of cellulose acetate propionate (CAP482-20, produced by Eastman Chemical Co.) and 4.5 g of a polyester resin (VITTEL PE2200B, available from Bostic Co.) and were dissolved.

Subsequently added to the resulting solution was 0.30 g of Infrared Dye 1 described below. Further, 4.5 g of a fluorine based surface active agent (SURFRON KH40, produced by Asahi Glass Co., Ltd.) and 2.3 g of a fluorine based surface active agent (MEGAFAG F120K, produced by Dainippon Ink and Chemicals, Inc.), were dissolved in 43.2 g of methanol, and the resulting mixture was vigorously stirred to complete dissolution. Subsequently, while stirring, 2.5 g of oleyl oleate was added, whereby a back coat layer liquid coating composition was prepared.

<Preparation of Back Coat Layer Liquid Coating Composition 2>

Back Coat Layer Liquid Coating Composition 2 was prepared in the same manner as above (Preparation of Back Coat Layer Liquid Coating Composition 1), except that cellulose acetate propionate (CAP482-20, produced by Eastman Chemical Co.), which had not been subjected to a heated re-drying treatment, was incorporated.

Surface Active Agent (A)

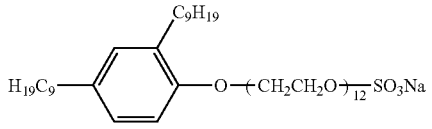

-continued

Infrared Dye 1

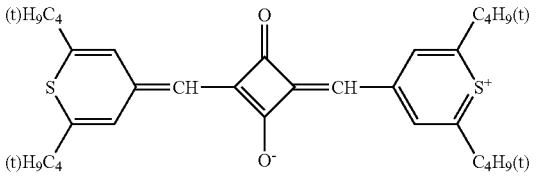

<Preparation of Back Coat Layer (Surface Protective Layer) Liquid Coating Composition 1>

A back coat layer liquid coating composition was prepared in the same manner as Back Coat Layer Liquid Coating Composition 1 at the composition ratio below. Silica in MEK at a concentration of 1 percent was dispersed employing a dissolver type homogenizer and finally added.

| | |
|---|---|
| Cellulose acetate propionate (10% MEK solution) (CAP482-20, produced by Eastman Chemical Co.) | 15 g |
| $C_8F_{17}(CH_2CH_2O)_{12}C_8F_{17}$ | 0.05 g |
| Fluorine based surface active agent ($LiO_2S—C_3F_6—SO_3Li$) | 0.01 g |
| Stearic acid | 0.1 g |
| Oleyl oleate | 0.1 g |
| α-alumina (at a Mohs hardness of 9) | 0.1 g |

<Preparation of Back Coat Layer Protective Layer Liquid Coating Composition>

Back Coat Protective Layer Liquid Coating Composition 2 was prepared in the same manner as above (Preparation of Back Coat Protective Layer Liquid Coating Composition 1), except that cellulose acetate propionate (CAP482-20, produced by Eastman Chemical Co.), which was not subjected to the heat re-drying treatment, was incorporated.

<<Preparation of Photosensitive Silver Halide Emulsion>>

(Preparation of Photosensitive Silver Halide Emulsion 1)

| | |
|---|---|
| (Solution A1) | |
| Phenylcarbamoyl-modified gelatin | 88.3 g |
| Compound (*1) (10% aqueous methanol solution) | 10 ml |
| Potassium bromide | 0.32 g |
| Water to make | 5429 ml |
| (Solution B1) | |
| 0.67 mol/L aqueous silver nitrate solution | 2635 ml |
| (Solution C1) | |
| Potassium bromide | 51.55 g |
| Potassium iodide | 1.47 g |
| Water to make | 660 ml |
| (Solution D1) | |
| Potassium bromide | 154.9 g |
| Potassium iodide | 4.41 g |

-continued

| | |
|---|---|
| $K_3IrCl_6 + K_4[Fe(CN)_6]$ (equivalent to $2 \times 10^{-5}$ mol/Ag) | 50.0 ml |
| Water to make | 1982 ml |
| (Solution E1) | |
| 0.4 mol/L aqueous potassium bromide solution the following amount controlled by silver potential | |
| (Solution F1) | |
| Potassium hydroxide | 0.71 g |
| Water to make | 20 ml |
| (Solution G1) | |
| 56 percent aqueous acetic acid solution | 18.0 ml |
| (Solution H1) | |
| Sodium carbonate anhydride | 1.72 g |
| Water to make | 151 ml |

(*1) Compound A: $HO(CH_2CH_2O)_n(CH(CH_3)CH_2O)_{17}(CH_2CH_2O)_mH$ (m + N = 5 through 7)

Upon employing a mixing stirrer shown in Japanese Patent Publication Nos. 58-58288 and 58-58289, ¼ portion of Solution B1 and whole Solution C1 were added to Solution A1 over 4 minutes 45 seconds, employing a double-jet precipitation method while adjusting the temperature to 30° C. and the pAg to 8.09, whereby nuclei were formed. After one minute, whole Solution F1 was added. During the addition, the pAg was appropriately adjusted employing Solution E1. After 6 minutes, ¾ portion of Solution B1 and whole Solution D1 were added over 14 minutes 15 seconds, employing a double-jet precipitation method while adjusting the temperature to 30° C. and the pAg to 8.09. After stirring for 5 minutes, the mixture was cooled to 40° C., and whole Solution G1 was added, whereby a silver halide emulsion was flocculated. Subsequently, while leaving 2000 ml of the flocculated portion, the supernatant was removed, and 10 L of water was added. After stirring, the silver halide emulsion was again flocculated. While leaving 1,500 ml of the flocculated portion, the supernatant was removed. Further, 10 L of water was added. After stirring, the silver halide emulsion was flocculated. While leaving 1,500 ml of the flocculated portion, the supernatant was removed. Subsequently, Solution H1 was added and the resultant mixture was heated to 60° C., and then stirred for an additional 120 minutes. Finally, the pH was adjusted to 5.8 and water was added so that the weight was adjusted to 1,161 g per mol of silver, whereby an emulsion was prepared.

The prepared emulsion was comprised of monodispersed cubic silver iodobromide grains having an average grain size of 0.040 μm, a grain size variation coefficient of 12 percent and a (100) surface ratio of 92 percent.

(Preparation of Photosensitive Silver Halide Emulsion 2)

Photosensitive Silver Halide Emulsion 2 was prepared in the same manner as aforesaid Photosensitive Silver Halide Emulsion 1, except that after nucleus formation, all Solution F1 was added, and subsequently 4 ml of a 0.1 percent ethanol solution of ETTU (indicated below) was added.

Incidentally, the prepared emulsion was comprised of monodispersed cubic silver iodobromide grains having an average grain size of 0.042 μm, a grain size variation coefficient of 10 percent and a (100) surface ratio of 94%.

<<Preparation of Photosensitive Layer Coating Composition>>

(Preparation of Powder Aliphatic Carboxylic Acid Silver Salt A)

Dissolved in 4,720 ml of pure water were 117.7 g of behenic acid, 60.9 g of arachidic acid, 39.2 g of stearic acid, and 2.1 g of palmitic acid at 80° C. Subsequently, 486.2 ml of a 1.5 M aqueous sodium hydroxide solution was added, and further, 6.2 ml of concentrated nitric acid was added. Thereafter, the resultant mixture was cooled to 55° C., whereby an aliphatic acid sodium salt solution was prepared. After 347 ml of t-butyl alcohol was added and stirred for 20 min, the above-described Photosensitive Silver Halide Emulsion 1 as well as 450 ml of pure water was added and stirred for 5 minutes.

Subsequently, 702.6 ml of one mol silver nitrate solution was added over two minutes and stirred for 10 minutes, whereby an aliphatic carboxylic acid silver salt dispersion was prepared. Thereafter, the resultant aliphatic carboxylic acid silver salt dispersion was transferred to a water washing machine, and deionized water was added. After stirring, the resultant dispersion was allowed to stand, whereby a flocculated aliphatic carboxylic acid silver salt was allowed to float and was separated, and the lower portion, containing water-soluble salts, were removed. Thereafter, washing was repeated employing deionized water until electric conductivity of the resultant effluent reached 50 μS/cm. After centrifugal dehydration, the resultant cake-shaped aliphatic carboxylic acid silver salt was dried employing an gas flow type dryer Flush Jet Dryer (manufactured by Seishin Kikaku Co., Ltd.), while setting the drying conditions such as nitrogen gas as well as heating flow temperature at the inlet of the dryer, until its water content ratio reached 0.1 percent, whereby Powder Aliphatic Carboxylic Acid Silver Salt A was prepared. The water content ratio of aliphatic carboxylic acid silver salt compositions was determined employing an infrared moisture meter.

A silver salt conversion ratio of the aliphatic carboxylic acid was confirmed to be about 95%, measured by the above-described method.

<<Preparation of Preliminary Dispersion A>>

Dissolved in 1457 g of methyl ethyl ketone (hereinafter referred to as MEK) was 14.57 g of poly(vinyl butyral) resin P-9. While stirring, employing Dissolver DISPERMAT Type CA-40M, manufactured by VMA-Getzmann Co., 500 g of aforesaid Powder Aliphatic Carboxylic Acid Silver Salt A was gradually added and sufficiently mixed, whereby Preliminary Dispersion A was prepared.

(Preparation of Photosensitive Emulsion A)

Preliminary Dispersion A, prepared as above, was charged into a media type homogenizer DISPERMAT Type SL-C12EX (manufactured by VMA-Getzmann Co.), filled with 0.5 mm diameter zirconia beads so as to occupy 80 percent of the interior volume so that the retention time in the mill reached 1.5 minutes and was dispersed at a peripheral rate of the mill of 8 m/second, whereby Photosensitive Emulsion A was prepared.

(Preparation of Stabilizer Solution)

Stabilizer Solution was prepared by dissolving 1.0 g of Stabilizer 1 and 0.31 g of potassium acetate in 4.97 g of methanol.

(Preparation of Infrared Sensitizing Dye A Solution)

Infrared Sensitizing Dye A Solution was prepared by dissolving 19.2 mg of Infrared Sensitizing Dye 1, 10 mg of Infrared Sensitizing Dye 2, 1.48 g of 2-chloro-benzoic acid, 2.78 g of Stabilizer 2, and 365 mg of 5-methyl-2-mercaptobenzimidazole in 31.3 ml of MEK in a light-shielded room.

(Preparation of Additive Solution "a")

Additive Solution "a" was prepared by dissolving 27.98 g of 1,1-bis(2-hydroxy-3,5-dimethylphenyl)-3,5,5-trimethylhexane (Developing Agent A) and 1.54 g of 4-methylphthalic acid, and 0.20 g of aforesaid Infrared Dye 1 in 110 g of MEK.

(Preparation of Additive Solution "b")

Additive Solution "b" was prepared by dissolving 3.56 g of Antifoggant 2 and 3.43 g of phthalazine in 40.9 g of MEK.

(Preparation of Photosensitive Layer Coating Composition A)

While stirring, 50 g of aforesaid Photosensitive Emulsion A and 15.11 g of MEK were mixed and the resultant mixture was maintained at 21° C. Subsequently, 390 μl of Antifoggant 1 (being a 10 percent methanol solution) was added and stirred for one hour. Further, 494 μl of calcium bromide (being a 10 percent methanol solution) was added and stirred for 20 minutes. Subsequently, 167 ml of aforesaid Stabilizer Solution was added and stirred for 10 minutes. Thereafter, 1.32 g of aforesaid Infrared Sensitizing Dye A was added and the resulting mixture was stirred for one hour. Subsequently, the resulting mixture was cooled to 13° C. and stirred for an additional 30 minutes. While maintaining at 13° C., 13.31 g of poly(vinyl acetal) Resin P-1 as a binder was added and stirred for 30 minutes. Thereafter, 1.084 g of tetrachlorophthalic acid (being a 9.4 weight percent MEK solution) was added and stirred for 15 minutes. Further, while stirring, 12.43 g of Additive Solution "a", 1.6 ml of Desmodur N300/aliphatic isocyanate, manufactured by Mobay Chemical Co. (being a 10 percent MEK solution), and 4.27 g of Additive Solution "b" were successively added, whereby Photosensitive Layer Coating Composition A was prepared.

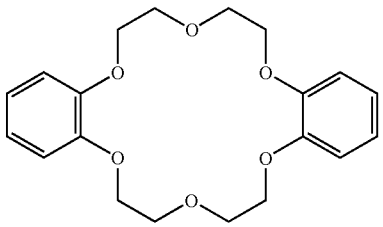

Stabilizer 1

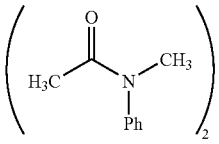

Antifoggant 1

HBr $Br_2$

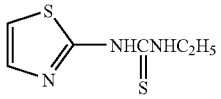

ETTU

-continued

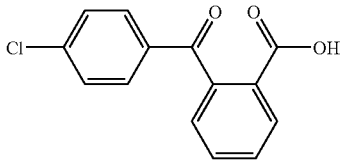

Stabilizer 2

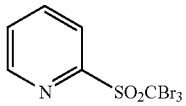

Antifoggant 2

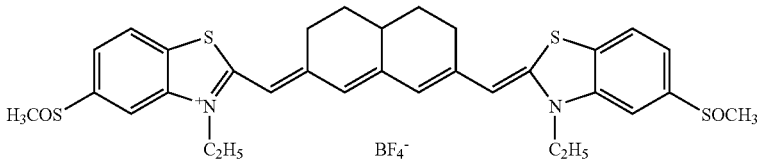

Infrared sensitizing dye 1

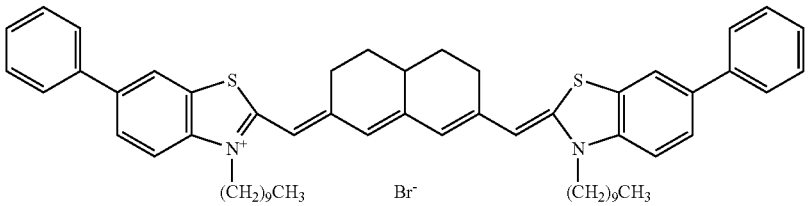

Infrared sensitizing dye 2

<<Surface Protective Layer>>

<Re-Drying of Surface Protective Layer Addition Components>

Cellulose acetate propionate (CAP-141-20 at glass transition temperature Tg of 190° C., produced by Eastman Chemical Co.) was charged into "Drum Rotation System Small Type Drier", produced by Kuroda Industry Co., Ltd. and heat re-dried at the temperature and for duration listed in the table.

<Preparation of Image Forming Layer Protective Layer (Surface Protective Layer Underlayer) 1>

| | |
|---|---|
| Acetone | 5 g |
| MEK | 21 g |
| Cellulose acetate propionate (CAP-141-20 at a glass transition temperature of 190° C., produced by Eastman Chemical Co.) | 2.3 g |
| PARALOID A-21 (produced by Rohm & Haas Co.) | 0.07 g |
| Benzotriazole | 0.03 g |
| Methanol | 7 g |
| Phthalazine | 0.25 g |
| $CH_2{=}CHSO_2CH_2CH_2CH_2OCH_2CH_2SO_2CH{=}CH_2$ | 0.035 g |
| $C_{12}F_{25}(CH_2CH_2O)_{10}C_{12}F_{25}$ | 0.01 g |
| Fluorine based surface active agent ($LiO_3S{-}C_3F_6{-}SO_3Li$) | 0.01 g |
| Stearic acid | 0.1 g |
| Butyl stearate | 0.1 g |
| α-alumina (at a Mohs hardness of 9) | 0.1 g |

<Preparation of Image Forming Layer Upper Protective Layer (Upper Surface Protective Layer)>

| | |
|---|---|
| Acetone | 5 g |
| Methyl ethyl ketone | 21 g |
| Binder (listed in Table 3) | 2.3 g |
| PARALOID A-21 (produced by Rohm & Haas Co.) | 0.07 g |

-continued

| | |
|---|---|
| Benzotriazole | 0.03 g |
| Methanol | 7 g |
| Phthalazine | 0.25 g |
| Tabular particles | type and amount listed in Table 3 |
| Cross-linking agent | type and amount listed in Table 3 |
| Acid group capturing agent | type and amount listed in Table 3 |

| | |
|---|---|
| $C_{12}F_{25}(CH_2CH_2O)_{10}C_{12}F_{25}$ | 0.01 g |
| Fluorine based surface active agent ($LiO_3S{-}C_3F_6{-}SO_3Li$) | 0.01 g |
| Stearic acid | 0.1 g |
| Butyl stearate | 0.1 g |
| α-alumina (at a Mohs hardness of 9) | 0.1 g |
| S400 N5 (produced by Shamrock Co.) | 0.1 g |

Incidentally, image forming layer protective layer upper layer and underlayer were prepared in the same manner as the back coat layer liquid coating composition at the above composition ratio. In the same manner as the back coat layer protective layer, silica in MEK at a concentration of 1 percent was dispersed employing a dissolver type homogenizer and finally added while stirring, whereby image forming layer upper and lower protective layer liquid coating compositions were prepared.

<Preparation of Image Forming Layer Protective Layer Underlayer (Surface Protective Layer Underlayer) 2>

Image Forming Layer Protective Layer Underlayer (surface Protective layer Underlayer) 1 was prepared in the same manner as above (Preparation of Image Forming Layer Protective Layer Underlayer (Surface Protective Layer Underlayer) 1), except that CAP482-20, produced by Eastman Chemical Co.), which was not subjected to the heated drying treatment, was incorporated.

<Preparation of Heat Developable Photosensitive Materials>

The back coat layer liquid coating composition and the back-coat layer protective layer liquid coating composition, prepared as above, were applied onto upper sublayer B-2 to result in a dried coating thickness of 3.5 μm of each layer at a coating rate of 50 m/minute, employing an extrusion coater. Further, drying was performed over 5 minutes at a drying temperature of 100° C. and a dew point of 10° C.

The above image forming layer liquid coating composition and image forming layer protective layer (surface protective layer) liquid coating composition were simultaneously applied onto upper sublayer A-2 at a coating rate of 50 m/minute, employing an extrusion coater, while changing the kinds of silver halide emulsions and protective layer binders, as well as adding each of the cross-linking agents and acid group capturing agents, as listed in Table 3, whereby Samples 101–128 were prepared.

Coating was performed in such a manner that the coated silver amount on the image forming layer reached 1.3 g/m$^2$, and the thickness of the dried image forming layer protective layer (being a surface protective layer) reached 3.0μ (the thickness of the surface protective layer upper layer was 1.5 μ, while the thickness of the surface protective layer underlayer was another 1.5 μm). Subsequently, drying was performed over 10 minutes, employing an air flow at a drying temperature of 75° C. and a dew point of 10° C.

The pH of the layer surface of the resulting heat developable photosensitive material (Sample No. 101) on the image forming layer side was 5.3 and its Bekk smoothness was 6,000 seconds, while the pH of the layer surface on the back coat layer side was 5.5 and its Bekk smoothness was 9,000 seconds.

<<Evaluation of Each Characteristic>>

(Exposure and Development Process)

Scanning exposure was given onto the emulsion side surface of each sample prepared as above, employing an exposure apparatus in which a semiconductor laser, which was subjected to longitudinal multi mode of a wavelength of 800 to 820 nm, employing high frequency superposition, was employed as a laser beam source. In such a case, images were formed while adjusting the angle between the exposed surface of the sample and the exposure laser beam to 75 degrees. By employing such a method, compared to the case in which the angle was adjusted to 90 degrees, images were obtained which minimized unevenness and surprisingly exhibited excellent sharpness.

Thereafter, while employing an automatic processor having a heating drum, the protective layer of each sample was brought into contact with the surface of the drum and thermal development was carried out at 110° C. for 15 seconds. In such a case, exposure as well as development was carried out in the room which was conditioned at 23° C. and 50 percent relative humidity.

(Light-fastness of Images)

Each of the heat developable photosensitive materials was exposed and developed in the same manner as above. Subsequently, the density of the fog portions was determined. Thereafter, the resulting material was allowed to adhere onto a 5,000 lux viewing box of at 45° C. (55 percent relative humidity) and left for 10 hours. Thereafter, the density in the fog portions was determined, and the density difference (ΔDmin) of the fog portions was employed for evaluation.

(Sensory Evaluation of Unpleasant Odor)

A black image sample of a density of 3.0 was prepared employing the same exposure and processing method as above. Placed into a sample bag was 10 g of the resulting sample, and sensory evaluation of unpleasant odor was performed and ranked as below.

A: no odor was noted
B: very slight odor was noted
C: weak odor, transferable to the odorources, was noted
D: odor was readily noted
E: strong odor was noted
F: intense odor was noted

TABLE 3

| | | Re-Drying Temperature | Re-Drying Time | Protective Layer Binder | | Tabular Grain | | Crosslinking Agent: Type of Crosslinking Agent | | Acid Group Capturing Agent: Acid Group Capturing Agent | | | | | |
|---|---|---|---|---|---|---|---|---|---|---|---|---|---|---|---|
| | *2 | (° C.) | (seconds) | *3 | *4 | *5 | *6 | | *7 | | *8 | *9 | *10 | *11 | *12 |
| 2 | 2 | | | CAP | none | none | 0.00 | none | 0.00 | none | 0.00 | 5 | 1 | E | 0.140 Comp. |
| 2 | 2 | | | PVA-403 | 78.5–81.5 | ME-100 | 0.40 | Epoxy (H12) | 0.03 | none | 0.00 | 5 | 2 | E | 0.139 Comp. |
| 2 | 2 | | | PVA-505 | 72.5–74.5 | ME-100 | 0.40 | Epoxy (H12) | 0.03 | none | 0.00 | 5 | 2 | D | 0.139 Comp. |
| 1 | 1 | 72 | 180 | PVA-505 | 72.5–74.5 | MK-300 | 0.40 | *13 | 0.03 | none | 0.00 | 5 | 2 | C | 0.135 Inv. |
| 1 | 1 | 72 | 210 | PVA-505 | 72.5–74.5 | MK-300 | 0.40 | *13 | 0.10 | CI-3 | 0.10 | 5 | 2 | C | 0.135 Inv. |
| 1 | 1 | 123 | 60 | PVA-505 | 72.5–74.5 | MK-200 | 0.30 | *13 | 0.03 | CI-3 | 0.10 | 5 | 2 | B | 0.132 Inv. |
| 1 | 1 | 123 | 60 | PVA-505 | 72.5–74.5 | MK-200 | 0.40 | *13 | 0.03 | CI-3 | 0.10 | 5 | 2 | B | 0.132 Inv. |
| 1 | 1 | 123 | 60 | PVA-505 | 72.5–74.5 | MK-100 | 0.40 | *13 | 0.10 | CI-3 | 0.10 | 5 | 2 | B | 0.131 Inv. |
| 1 | 1 | 72 | 180 | PVA-505 | 72.5–74.5 | MK-100 | 0.30 | *14 | 0.03 | CI-3 | 0.10 | 5 | 1 | C | 0.136 Inv. |
| 1 | 1 | 123 | 60 | PVA-505 | 72.5–74.5 | MK-100 | 0.40 | *14 | 0.10 | CI-3 | 0.10 | 5 | 1 | A | 0.134 Inv. |
| 1 | 1 | 123 | 60 | PVA-505 | 72.5–74.5 | MK-100 | 0.30 | *14 | 0.03 | CI-3 | 0.10 | 25 | 2 | A | 0.131 Inv. |
| 1 | 1 | 123 | 60 | PVA-505 | 72.5–74.5 | MK-300 | 0.40 | *14 | 0.03 | CI-3 | 0.10 | 5 | 2 | B | 0.131 Inv. |
| 1 | 1 | 123 | 60 | PVA-505 | 72.5–74.5 | MK-100 | 0.30 | *14 | 0.03 | CI-3 | 0.10 | 5 | 2 | A | 0.129 Inv. |
| 1 | 1 | 123 | 60 | PVA-505 | 72.5–74.5 | MK-100 | 0.40 | *14 | 0.10 | CI-3 | 0.10 | 5 | 2 | A | 0.128 Inv. |
| 2 | 2 | | | L-30 | 55% | ME-100 | 0.40 | Epoxy (H12) | 0.03 | none | 0.00 | 5 | 2 | E | 0.138 Comp. |
| 2 | 2 | | | L-35 | 61.60% | MK-100 | 0.40 | *14 | 0.10 | none | 0.00 | 5 | 2 | E | 0.132 Comp. |
| 2 | 2 | | | LL-10 | 43–45% | MK-100 | 0.40 | *14 | 0.10 | none | 0.00 | 5 | 2 | D | 0.133 Comp. |
| 1 | 1 | 72 | 180 | L-30 | 55% | MK-300 | 0.40 | *13 | 0.03 | none | 0.00 | 5 | 2 | C | 0.136 Inv. |
| 1 | 1 | 72 | 210 | L-30 | 55% | MK-300 | 0.40 | *13 | 0.10 | CI-3 | 0.10 | 5 | 2 | C | 0.136 Inv. |

TABLE 3-continued

| | | Re-Drying Temperature | Re-Drying Time | Protective Layer Binder | | Tabular Grain | | Crosslinking Agent | | Acid Group Capturing Agent | | | | | | |
|---|---|---|---|---|---|---|---|---|---|---|---|---|---|---|---|---|
| | *2 | (° C.) | (seconds) | *3 | *4 | *5 | *6 | Type of Crosslinking Agent | *7 | Acid Group Capturing Agent | *8 | *9 | *10 | *11 | *12 | |
| 1 | 1 | 72 | 240 | L-30 | 55% | MK-200 | 0.30 | *13 | 0.03 | CI-3 | 0.10 | 5 | 2 | C | 0.133 | Inv. |
| 1 | 1 | 123 | 60 | L-30 | 55% | MK-200 | 0.40 | *13 | 0.03 | CI-3 | 0.10 | 5 | 2 | B | 0.132 | Inv. |
| 1 | 1 | 123 | 60 | L-30 | 55% | MK-100 | 0.40 | *13 | 0.10 | CI-3 | 0.10 | 5 | 2 | B | 0.131 | Inv. |
| 1 | 1 | 123 | 60 | L-30 | 55% | MK-100 | 0.30 | *14 | 0.03 | CI-3 | 0.10 | 5 | 1 | B | 0.136 | Inv. |
| 1 | 1 | 123 | 30 | L-30 | 55% | MK-100 | 0.40 | *14 | 0.10 | CI-3 | 0.10 | 5 | 1 | B | 0.134 | Inv. |
| 1 | 1 | 123 | 60 | L-30 | 55% | MK-100 | 0.30 | *14 | 0.03 | CI-3 | 0.10 | 25 | 2 | A | 0.132 | Inv. |
| 1 | 1 | 123 | 60 | L-30 | 55% | MK-300 | 0.40 | *14 | 0.03 | CI-3 | 0.10 | 5 | 2 | A | 0.131 | Inv. |
| 1 | 1 | 123 | 60 | L-30 | 55% | MK-100 | 0.30 | *14 | 0.03 | CI-3 | 0.10 | 5 | 2 | A | 0.129 | Inv. |
| 1 | 1 | 123 | 60 | L-30 | 55% | MK-100 | 0.40 | *14 | 0.10 | CI-3 | 0.10 | 5 | 2 | A | 0.128 | Inv. |

Comp.: Comparative Example
Inv.: Present Invention
*1: image forming layer protective layer underlayer liquid coating composition
*2: back coat layer protective layer liquid coating composition
*3: image forming layer protective layer upper layer binder
*4: degree of saponification or degree of acetylation
*5: type of tabular grains
*6: particle added weight ratio (particle weight/binder weight)
*7: cross-linking agent added weight ratio (cross-linking agent weight/binder weight
*8: added amount of acid group capturing agent (acid group capturing agent weight/fatty acid weight)
*9: distance between exposure section and development section (cm)
*10: photosensitive silver halide emulsion
*11: sensory evaluation of unpleasant odor
*12: image light-fastness Δmin (45° C., 5,000 lx, and 10 hours)
*13: BARNOCK D-500
*14: DURANATE MF-K60X CAP-141-20 cellulose acetate propionate (at a glass transition temperature Tg of 190° C., produced by Eastman Chemical Co.)

PVA-403 and -505 (polyvinyl alcohol, produced by Kuraray Co., Ltd.)

L-30 and -35, and LL-10 (cellulose acetate, produced by Daicel Chemical Industries, Ltd.)

BARNOCK D-500 (cellulose acetate, produced by Dainippon Ink and Chemicals, Inc.)

DURANATE MF-K60X (cellulose acetate, produced by Asahi Chemical Industry Co., Ltd.)

As can clearly be seen from Table 3, the silver salt photothermographic dry imaging materials of the present invention resulted in lower formation of unpleasant odor and higher image light-fastness, compared to the comparative examples. Accordingly, it is possible to provide silver salt photothermographic dry imaging materials which minimize unpleasant odor after development and result in enhanced image light-fastness.

What is claimed is:

1. A photothermographic imaging material comprising a support having thereon:

(i) a photosensitive layer containing photosensitive silver halide grains, light-insensitive organic silver salt grains, a binder, and a reducing agent for silver ions; and (ii) one or more non-photosensitive layers, wherein:

one of the non-photosensitive layers is a protective layer containing:

(a) a cross-linking agent;

(b) a polymer having a vinyl alcohol repeating unit and having a saponification degree of not more than 75%; and (c) an acid group trapping agent capable of trapping a volatile compound during thermal development;

said protective layer and said photosensitive layer are positioned on the same side of said support; and said protective layer is positioned farther from said support than said photosensitive layer.

2. The photothermographic imaging material of claim 1, wherein the protective layer contains tablet shaped grains.

3. The photothermographic imaging material of claim 1, wherein the silver halide grains produce a larger number of inner latent images than surface latent images after the imaging material is subjected to thermal development.

4. The photothermographic imaging material of claim 1, wherein the cross-linking agent is a blocked isocyanate compound.

5. The photothermographic imaging material of claim 1, wherein the cross-linking agent is a carbodiimide compound.

6. A method of forming an image comprising the steps of:

(a) setting the photothermographic imaging material of claim 1 in a thermal developing apparatus having a exposure portion and a thermal development portion;

(b) exposing the photothermographic imaging material with the exposure portion to obtain an latent image, and (c) thermally developing the latent image with the thermal developing portion, wherein a distance from the exposure portion and the thermal developing portion is between 0 and 20 cm.

* * * * *